US006850205B2

(12) United States Patent
Yamamoto et al.

(10) Patent No.: US 6,850,205 B2
(45) Date of Patent: Feb. 1, 2005

(54) WAVEGUIDE ANTENNA APPARATUS PROVIDED WITH RECTANGULAR WAVEGUIDE AND ARRAY ANTENNA APPARATUS EMPLOYING THE WAVEGUIDE ANTENNA APPARATUS

(75) Inventors: Atsushi Yamamoto, Osaka (JP); Hiroshi Iwai, Katano (JP); Koichi Ogawa, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/629,786

(22) Filed: Jul. 30, 2003

(65) Prior Publication Data

US 2004/0061657 A1 Apr. 1, 2004

(30) Foreign Application Priority Data

Jul. 31, 2002 (JP) ..... 2002-223239

(51) Int. Cl.[7] ..... H01Q 13/00
(52) U.S. Cl. ..... 343/772; 343/786
(58) Field of Search ..... 343/700 MS, 762, 343/772, 786, 789

(56) References Cited

U.S. PATENT DOCUMENTS 4,086,598 A * 4/1978 Bogner ..... 343/768
4,912,482 A * 3/1990 Woloszczuk ..... 343/841
5,331,332 A * 7/1994 West et al. ..... 343/786
6,275,196 B1 * 8/2001 Bobier ..... 343/840
6,538,618 B2 * 3/2003 Yamamoto et al. ..... 343/789
6,680,712 B2 * 1/2004 Yamamoto et al. ..... 343/789
2002/0044099 A1 4/2002 Yamamoto et al. ..... 343/772

FOREIGN PATENT DOCUMENTS

JP 9-135115 5/1997

* cited by examiner

*Primary Examiner*—Tho Phan
(74) *Attorney, Agent, or Firm*—Wenderoth, Lind & Ponack, L.L.P.

(57) ABSTRACT

A waveguide antenna apparatus is provided including a rectangular waveguide having one end short-circuited by a terminating conductor and another end opened. The rectangular waveguide includes a grounding conductor and a ceiling conductor opposed to each other, and includes two side surface conductors joining the grounding conductor with the ceiling conductor and being opposed to each other. An antenna element has one end and another end, where one end thereof is connected with a position in the ceiling conductor in a vicinity of opened another end of the rectangular waveguide, and another end thereof is connected with a feeding portion located in the grounding conductor. The ceiling conductor includes a removed portion on the side of opened another end of the rectangular waveguide. Then an electromagnetic wave of a fed radio signal is radiated from the removed portion and opened another end of the rectangular waveguide.

32 Claims, 43 Drawing Sheets

FIRST PREFERRED EMBODIMENT

FIRST PREFERRED EMBODIMENT

FIRST IMPLEMENTAL EXAMPLE OF FIRST PREFERRED EMBODIMENT

SECOND IMPLEMENTAL EXAMPLE OF FIRST PREFERRED EMBODIMENT

FIRST MODIFIED PREFERRED EMBODIMENT OF FIRST PREFERRED EMBODIMENT

SECOND MODIFIED PREFERRED EMBODIMENT OF FIRST PREFERRED EMBODIMENT

THIRD MODIFIED PREFERRED EMBODIMENT OF FIRST PREFERRED EMBODIMENT

FOURTH MODIFIED PREFERRED EMBODIMENT OF FIRST PREFERRED EMBODIMENT

FIFTH MODIFIED PREFERRED EMBODIMENT OF FIRST PREFERRED EMBODIMENT

IMPLEMENTAL EXAMPLE OF FIFTH MODIFIED PREFERRED EMBODIMENT OF FIRST PREFERRED EMBODIMENT

THIRD IMPLEMENTAL EXAMPLE OF FIRST PREFERRED EMBODIMENT

SECOND PREFERRED EMBODIMENT

FIRST IMPLEMENTAL EXAMPLE OF SECOND PREFERRED EMBODIMENT

SECOND IMPLEMENTAL EXAMPLE OF SECOND PREFERRED EMBODIMENT

FIRST MODIFIED PREFERRED EMBODIMENT OF SECOND PREFERRED EMBODIMENT

SECOND MODIFIED PREFERRED EMBODIMENT OF SECOND PREFERRED EMBODIMENT

THIRD MODIFIED PREFERRED EMBODIMENT OF SECOND PREFERRED EMBODIMENT

FOURTH MODIFIED PREFERRED EMBODIMENT OF SECOND PREFERRED EMBODIMENT

THIRD IMPLEMENTAL EXAMPLE OF SECOND PREFERRED EMBODIMENT

FOURTH IMPLEMENTAL EXAMPLE OF SECOND PREFERRED EMBODIMENT

THIRD PREFERRED EMBODIMENT

IMPLEMENTAL EXAMPLE OF THIRD PREFERRED EMBODIMENT

FIRST MODIFIED PREFERRED EMBODIMENT OF THIRD PREFERRED EMBODIMENT

SECOND MODIFIED PREFERRED EMBODIMENT OF THIRD PREFERRED EMBODIMENT

THIRD MODIFIED PREFERRED EMBODIMENT OF THIRD PREFERRED EMBODIMENT

FOURTH MODIFIED PREFERRED EMBODIMENT OF THIRD PREFERRED EMBODIMENT

FIFTH MODIFIED PREFERRED EMBODIMENT OF THIRD PREFERRED EMBODIMENT

IMPLEMENTAL EXAMPLE OF FIFTH MODIFIED PREFERRED EMBODIMENT OF THIRD PREFERRED EMBODIMENT

FOURTH PREFERRED EMBODIMENT

FIRST MODIFIED PREFERRED EMBODIMENT OF FOURTH PREFERRED EMBODIMENT

SECOND MODIFIED PREFERRED EMBODIMENT OF FOURTH PREFERRED EMBODIMENT

FIFTH PREFERRED EMBODIMENT

SIXTH MODIFIED PREFERRED EMBODIMENT OF FIRST PREFERRED EMBODIMENT

SEVENTH MODIFIED PREFERRED EMBODIMENT OF FIRST PREFERRED EMBODIMENT

EIGHTH MODIFIED PREFERRED EMBODIMENT OF FIRST PREFERRED EMBODIMENT

NINTH MODIFIED PREFERRED EMBODIMENT OF FIRST PREFERRED EMBODIMENT

TENTH MODIFIED PREFERRED EMBODIMENT OF FIRST PREFERRED EMBODIMENT

ELEVENTH MODIFIED PREFERRED EMBODIMENT OF FIRST PREFERRED EMBODIMENT

TWELFTH MODIFIED PREFERRED EMBODIMENT OF FIRST PREFERRED EMBODIMENT

SIXTH MODIFIED PREFERRED EMBODIMENT OF THIRD PREFERRED EMBODIMENT

SEVENTH MODIFIED PREFERRED EMBODIMENT OF THIRD PREFERRED EMBODIMENT

EIGHTH MODIFIED PREFERRED EMBODIMENT OF THIRD PREFERRED EMBODIMENT

SIXTH PREFERRED EMBODIMENT

SEVENTH PREFERRED EMBODIMENT

WAVEGUIDE ANTENNA APPARATUS PROVIDED WITH RECTANGULAR WAVEGUIDE AND ARRAY ANTENNA APPARATUS EMPLOYING THE WAVEGUIDE ANTENNA APPARATUS

BACKGROUND OF THE INVENTION

1. Field of the Invention

The present invention relates to a waveguide antenna apparatus and an array antenna apparatus that employs the waveguide antenna apparatus, and in particular, to a waveguide antenna apparatus constituted by including a rectangular waveguide and an array antenna apparatus that employs the waveguide antenna apparatus.

2. Description of the Related Art

FIG. 59 is a perspective view showing a configuration of a prior art antenna apparatus (hereinafter referred to as a first prior art) that has a bi-directional pattern on the horizontal plane, and FIGS. 60A and 60B are graphs showing radiation directivity patterns of the antenna apparatus of FIG. 59. In this case, FIG. 60A is a graph showing a radiation directivity pattern on the X-Y plane, and FIG. 60B is a graph showing a radiation directivity pattern on the X-Z plane. In FIG. 59, reference is made to an X-Y-Z coordinates system illustrated for explanation. In this specification, the X-axis direction is referred to as an X-direction, a positive X-direction is referred to as a +X-direction, and a negative X-direction is referred to as a −X-direction. The similar thing can be applied to the Y-axis direction and the Z-axis direction.

Referring to FIG. 59, the first prior art antenna apparatus has a hollow housing formed by including a grounding conductor 112 of a bottom surface positioned on the X-Y plane, a linear ceiling conductor 111*a* and rectangular ceiling conductors 111*b* and 111*c*, which are arranged so as to oppose to the grounding conductor 111 and located on a top surface (hereinafter referred to as an antenna ceiling portion) of the antenna apparatus, and four side surface conductors 113*a*, 113*b*, 113*c* and 113*d*, which serve as the side surfaces of the antenna apparatus. The grounding conductor 112, the side surface conductors 113*a* to 113*d* and the ceiling conductors 111*a* and 111*b* are joined with each other so as to be electrically connected with each other, constituting a rectangular parallelepiped hollow housing symmetrical with respect to the Y-Z plane and the X-Z plane. In an approximate center portion of the antenna ceiling portion, a rectangular opening 116 is formed between the ceiling conductor 1111*a* and the ceiling conductor 111*b*, which extend parallel to the Y-axis, and a rectangular opening 117 is formed between the ceiling conductor 111*a* and the ceiling conductor 111*c*. With this arrangement, two rectangular opening spaces each having the same shape are arranged symmetrically with respect to the Y-Z plane in the antenna ceiling portion. One end of an antenna element 114 made of a conductor wire is connected mechanically and electrically with a connection point located in a center portion in the longitudinal direction of the ceiling conductor 111*a* by soldering or the like. Another end of the antenna element 114 is electrically connected with a central conductor (not shown) of a coaxial cable fed with a radio signal from a radio transceiver at a feeding point 115 in a circular hole 115*h* formed in a center portion of the top surface of the grounding conductor 112 (the center portion is located at an origin of the X-Y plane in the figure). At the feeding point 115, a grounding conductor of the coaxial cable is electrically connected with the grounding conductor 112.

In this case, a space, which is surrounded by the ceiling conductors 111*a* to 111*c*, the side surface conductors 113*a* to 113*d* and the grounding conductor 112, is referred to as an antenna interior, and a space on the outside of the antenna interior is referred to as an antenna exterior.

As an example, the grounding conductor 112 has a square shape of a side of 0.76 wavelengths with reference to a free space wavelength corresponding to the operation frequency, and the height of the side surface conductors 113*a* to 113*d* is 0.08 wavelengths. The antenna ceiling portion is constituted by including the ceiling conductor 111*a* made of one linear conductor and the ceiling conductors 111*b* and 111*c* made of the two rectangular conductors. The linear ceiling conductor 111*a* is arranged so as to be parallel to the Y-axis on the Y-Z plane and has a length of 0.76 wavelengths, and its both ends are electrically connected with the side surface conductors 113*a* and 113*c*. Both of the rectangular ceiling conductors 111*b* and 111*c* have a side parallel to the X-axis of a length of 0.19 wavelengths and a side parallel to the Y-axis of a length of 0.76 wavelengths. The conductors are arranged at both ends in the X-direction of the antenna ceiling portion, and are electrically connected with the side surface conductors 113*a* to 113*d*. The two opening portions 116 and 117 are formed so as to be a rectangle that has a side parallel to the X-axis of a length of 0.19 wavelengths and a side parallel to the Y-axis of a length of 0.76 wavelengths. The two opening portions 116 and 117 are arranged so as to be located to be adjacent to each other with interposition of the linear ceiling conductor 111*a* arranged in the center portion of the antenna ceiling portion, and the present antenna apparatus has a structure symmetrical with respect to the X-Z plane and the Y-Z plane. In this case, the antenna element 114 is made of a conductor wire, and the length of the antenna element 114 is 0.08 wavelengths. The antenna element is extended vertically so as to be perpendicular to the grounding conductor 112, and the top end portion of the antenna element 114 is electrically connected with the linear ceiling conductor 111*a* of the antenna ceiling portion in the center portion in the longitudinal direction of the ceiling conductor 111*a*.

FIGS. 60A and 60B are graphs showing radiation directivity patterns of the antenna apparatus provided with the two opening spaces of the above-mentioned structure as one example. FIG. 60A is a graph showing a radiation directivity pattern on the X-Y plane, and FIG. 60B is a graph showing a radiation directivity pattern on the X-Z plane. With regard to the scale in the radial direction representing the gain of the antenna apparatus, one interval is 10 dB, and there is used a unit of dBd of the relative gain with reference to the gain of a dipole antenna. In the antenna apparatus of the monopole antenna shown in FIG. 59, radiation of an electromagnetic wave in the Y-direction is suppressed, and a bi-directional pattern in the +X-direction and the −X-direction is obtained. Therefore, the above-mentioned prior art example shows excellent characteristics when used in an elongated indoor space of a corridor or the like.

Moreover, in the present antenna apparatus, the opening portions 116 and 117 for radiating an electromagnetic wave are arranged in the antenna ceiling portion, and the antenna element 114 of a radiation source is surrounded by the grounding conductor 112 and the side surface conductors 113*a* to 113*d*. Accordingly, there is caused a little influence of the antenna arrangement environment in the sidewise and downward directions of the antenna on the radiated electromagnetic wave. That is, in the case where the present antenna apparatus is installed on an indoor ceiling or the like, it is possible to embed the antenna apparatus in the indoor ceiling and install the antenna apparatus in alignment with the indoor ceiling so that the ceiling portion of the antenna apparatus face the radiation space. With this arrangement, no projection is present on the ceiling or the like, and an aesthetically preferable antenna apparatus that attracts little human attention is provided.

Moreover, the height of the antenna element 114 is 0.08 wavelengths which is smaller than that of the normal quarter-wavelength monopole antenna element. As described above, according to the structure of the present antenna apparatus, there is provided an aesthetically preferable antenna apparatus that attracts little human attention with a small projection on the ceiling also by virtue of the advantageous effect of the low-profile configuration of the antenna element in the case where the antenna apparatus cannot be embedded in the indoor ceiling.

Furthermore, with regard to the present antenna apparatus of the above-mentioned first prior art, there has been described the structure symmetrical with respect to the Y-Z plane and the X-Z plane. In this case, there is such an advantageous effect that the directivity pattern of the electromagnetic wave radiated from the antenna apparatus becomes symmetrical with respect to the Y-Z plane and the X-Z plane. As described above, according to the present antenna apparatus, there can be provided a compact excellent monopole antenna apparatus that has a desired bi-directional pattern.

Moreover, as an array antenna apparatus provided with a plurality of sector antennas that have radiated strong main beam in one direction on the horizontal plane, there is, for example, the antenna apparatus described in the Japanese Patent Laid-Open Publication No. JP 9-135115 A (hereinafter referred to as a second prior art).

Referring to FIG. 1 of the publication of the second prior art, there is provided a three-dimensional corner reflector antenna apparatus constituted by including a grounding conductor at least the surface made of a conductor, at least one antenna element provided vertically so as to be perpendicular to the grounding conductor, side surface conductors provided on both sides of the antenna element and a reflector conductor provided behind the antenna element (i.e., in the direction opposite to the direction of radiation of a radio signal). The published antenna apparatus is characterized in that one or a plurality of fins at least the surface of which is a conductor is attached to the side surface conductors located on both sides of the above-mentioned antenna element. It can be understood that the three-dimensional corner reflector antenna provided with the conductor fin (metal fin) disclosed in the publication of the second prior art is able to sharpen the beam width of only the radiation directivity pattern on the horizontal plane by the advantageous effect of the electromagnetic field distribution control with the conductor fin while scarcely changing the configuration of the radiation directivity pattern on the vertical plane and the tilt angle.

However, the first prior art antenna apparatus shown in FIG. 59 has the following problems. As described hereinabove, the bi-directional pattern has been able to be obtained, whereas a directivity having an extremely strong main beam in one direction was not obtained. The first prior art antenna apparatus, which is suitable for an elongated coverage area of a corridor or the like, can not effectively radiate an electromagnetic wave in the case where the antenna apparatus is allowed to be installed only at the end of the coverage area such as a place near an indoor wall or window. That is, there has been a restriction in the installation place of the antenna apparatus. Therefore, the structure of the antenna apparatus of the first prior art, which has not been able to effectively utilize the electromagnetic wave radiated from the antenna apparatus in the case where the antenna apparatus has been allowed to be installed only at the end of the coverage area, has been inevitably regarded as improper.

Moreover, the antenna apparatus disclosed in the publication of the second prior art has the following problems. The second prior art antenna apparatus has an antenna height (i.e., the height of the side surface conductors and the reflection conductor) of 0.6 wavelengths and is not able to be regarded as a low-profile antenna apparatus. When the antenna is arranged on the indoor ceiling or the like, a compact low-profile configuration is desired so that the antenna does not attract human attention. For example, if the frequency of the radio signal to be transmitted and received is 900 MHz, then 0.6 wavelengths correspond to 198 mm. Assuming that the antenna apparatus is provided with a cover, the height becomes equal to or smaller than a height of at least 200 mm. Therefore, the structure of the second prior art, which has had a tendency to attract human attention because of its incapability of having a low-profile configuration, has been inevitably regarded as improper.

SUMMARY OF THE INVENTION

An essential object of the present invention is to solve the above-mentioned problems and provide a compact and light-weight antenna apparatus capable of obtaining a directivity having an extremely strong main beam in one direction with a simple design.

Another object of the present invention is to provide a low-profile antenna apparatus in comparison with the prior arts in addition to the above-mentioned first object.

A further object of the present invention is to provide an array antenna apparatus that employs the above-mentioned antenna apparatus.

In order to achieve the above-mentioned objective, according to one aspect of the present invention, there is provided a waveguide antenna apparatus includes a rectangular waveguide having one end short-circuited by a terminating conductor and another end opened. The rectangular waveguide includes a grounding conductor and a ceiling conductor that are opposed to each other, and further includes two side surface conductors that join the grounding conductor with the ceiling conductor and are opposed to each other. An antenna element having one end and another end is provided, where one end of the antenna element is electrically connected with a position in the ceiling conductor in a vicinity of opened another end of the rectangular waveguide, and another end of the antenna element is electrically connected with a feeding portion located in the grounding conductor. The ceiling conductor includes a removed portion on the side of opened another end of the rectangular waveguide, and this leads to that an electromagnetic wave of a radio signal fed to the feeding portion is radiated from the removed portion of the ceiling conductor and opened another end of the rectangular waveguide.

The above-mentioned waveguide antenna apparatus preferably further includes at least one matching conductor for adjusting an input impedance of the waveguide antenna apparatus, and the matching conductor is electrically connected with the grounding conductor.

In the above-mentioned waveguide antenna apparatus, at least one of the matching conductors is preferably electrically connected with the antenna element.

In the above-mentioned waveguide antenna apparatus, at least one of the matching conductors is preferably electrically connected with the ceiling conductor.

The above-mentioned waveguide antenna apparatus preferably further includes at least one directivity pattern controlling conductor for changing a directivity pattern of the waveguide antenna apparatus, and the directivity pattern controlling conductor is electrically connected with the grounding conductor.

In the above-mentioned waveguide antenna apparatus, the directivity pattern controlling conductor preferably includes first and second conductor portions. The first conductor portion controls a directivity pattern on a plane substantially perpendicular to the grounding conductor, and the first conductor portion is electrically connected with the grounding conductor and is provided so as to be substantially perpendicular to the grounding conductor. The second conductor portion controls a directivity pattern on a plane substantially parallel to the grounding conductor, and the second conductor portion is connected with the first conductor portion and is provided so as to be substantially parallel to the grounding conductor.

In the above-mentioned waveguide antenna apparatus, the two side surface conductors are preferably formed so as to be further apart from each other at opened another end of the rectangular waveguide than at one end of the rectangular waveguide short-circuited by the terminating conductor.

In the above-mentioned waveguide antenna apparatus, the two side surface conductors are preferably formed so as to be closer to each other at opened another end of the rectangular waveguide than at one end of the rectangular waveguide short-circuited by the terminating conductor.

In the above-mentioned waveguide antenna apparatus, the terminating conductor is preferably formed so that a length in an electromagnetic wave propagation direction of the rectangular waveguide in an approximately center portion of the terminating conductor in a widthwise direction of the rectangular waveguide is larger than that at widthwise end portions of the terminating conductor respectively connected with the two side surface conductors.

According to another aspect of the present invention, there is provided a waveguide antenna apparatus including a rectangular waveguide having one end and another end both of which are short-circuited respectively by terminating conductors. The rectangular waveguide includes a grounding conductor and a ceiling conductor that are opposed to each other, and further includes two side surface conductors that join the grounding conductor with the ceiling conductor and are opposed to each other. The waveguide antenna apparatus further includes an antenna element having one end and another end, where one end of the antenna element is electrically connected with the ceiling conductor, another end of the antenna element is electrically connected with a feeding portion located in the grounding conductor. At least one slit is preferably formed in the ceiling conductor in the widthwise direction of the rectangular waveguide, and the slit is located in a position of which a distance to one end of the rectangular waveguide is substantially different from a distance to another end of the rectangular waveguide. This leads to that an electromagnetic wave of a radio signal fed to the feeding portion is radiated from the slit.

In the above-mentioned waveguide antenna apparatus, the slit is preferably formed in a position located between (a) a connection point in the ceiling conductor that connects the ceiling conductor with the antenna element, and (b) the terminating conductor.

The above-mentioned waveguide antenna apparatus preferably further includes at least one matching conductor for adjusting an input impedance of the waveguide antenna apparatus, and the matching conductor is electrically connected with the grounding conductor.

In the above-mentioned waveguide antenna apparatus, at least one of the matching conductors is preferably electrically connected with the antenna element.

In the above-mentioned waveguide antenna apparatus, at least one of the matching conductors is preferably electrically connected with the ceiling conductor.

According to a further aspect of the present invention, there is provided a waveguide antenna apparatus including a rectangular waveguide having one end short-circuited by a terminating conductor and another end opened. The rectangular waveguide includes a grounding conductor and a ceiling conductor that are opposed to each other, and further includes two side surface conductors that join the grounding conductor with the ceiling conductor and are opposed to each other. The waveguide antenna apparatus further includes an antenna element having one end and another end, where one end of the antenna element is electrically connected with a position in the ceiling conductor in a vicinity of opened another end of the rectangular waveguide, and another end of the antenna element is electrically connected with a feeding portion located in the grounding conductor. The waveguide antenna apparatus further includes at least one slit formed in the ceiling conductor in the widthwise direction of the rectangular waveguide. The ceiling conductor includes a first removed portion on the side of opened another end of the rectangular waveguide, and the two side surface conductors includes a second removed portion on the side of opened another end of the rectangular waveguide. This leads to that an electromagnetic wave of a radio signal fed to the feeding portion is radiated from the first removed portion of the ceiling conductor and opened another end of the rectangular waveguide.

The above-mentioned waveguide antenna apparatus further includes at least one matching conductor for adjusting an input impedance of the waveguide antenna apparatus, and the matching conductor is electrically connected with the grounding conductor.

In the above-mentioned waveguide antenna apparatus, at least one of the matching conductors is preferably electrically connected with the antenna element.

In the above-mentioned waveguide antenna apparatus, at least one of the matching conductors is preferably electrically connected with the ceiling conductor.

The above-mentioned waveguide antenna apparatus preferably further includes at least one directivity pattern controlling conductor for changing a directivity pattern of the waveguide antenna apparatus, and the directivity pattern controlling conductor is electrically connected with the grounding conductor.

In the above-mentioned waveguide antenna apparatus, the directivity pattern controlling conductor preferably includes first and second conductor portions. The first conductor portion controls a directivity pattern on a plane substantially perpendicular to the grounding conductor, and the first conductor portion is electrically connected with the grounding conductor and provided so as to be substantially perpendicular to the grounding conductor. The second conductor portion controls a directivity pattern on a plane substantially parallel to the grounding conductor, and the second conductor portion is connected with the first conductor portion and provided so as to be substantially parallel to the grounding conductor.

In the above-mentioned waveguide antenna apparatus, the two side surface conductors are preferably formed so as to be further apart from each other at opened another end of the rectangular waveguide than at one end of the rectangular waveguide short-circuited by the terminating conductor.

In the above-mentioned waveguide antenna apparatus, the two side surface conductors are preferably formed so as to be closer to each other at opened another end of the rectangular waveguide than at one end of the rectangular waveguide short-circuited by the terminating conductor.

In the above-mentioned waveguide antenna apparatus, the terminating conductor is preferably formed so that a length in an electromagnetic wave propagation direction of the rectangular waveguide in an approximately center portion of the terminating conductor in a widthwise direction of the rectangular waveguide is larger than that at widthwise end portions of the terminating conductor respectively connected with the two side surface conductors.

In the above-mentioned waveguide antenna apparatus, at least one part of an internal space of the rectangular waveguide is preferably filled with a dielectric material.

In the above-mentioned waveguide antenna apparatus, the grounding conductor is preferably formed by a conductor pattern formed on a first surface of a dielectric substrate having first and second surfaces that oppose to each other, and the ceiling conductor is formed by a conductor pattern formed on the second surface of the dielectric substrate. The side surface conductors and the terminating conductor are formed by a plurality of through hole conductors that are obtained by filling the dielectric substrate with through holes formed in a direction of thickness.

In the above-mentioned waveguide antenna, apparatus, the terminating conductor is preferably formed so that a length in an electromagnetic wave propagation direction of the rectangular waveguide is larger in an approximately center portion of the terminating conductor in a direction of height of the rectangular waveguide than that at end portions of the terminating conductor in the direction of height of the rectangular waveguide that are connected with the grounding conductor and the ceiling conductor.

In the above-mentioned waveguide antenna apparatus, the terminating conductor is preferably formed so that a length in an electromagnetic wave propagation direction of the rectangular waveguide is made larger from the ceiling conductor toward the grounding conductor.

In the above-mentioned waveguide antenna apparatus, the waveguide antenna apparatus is preferably covered with a radome having a circular bottom surface.

According to a still further aspect of the present invention, there is provided an array antenna apparatus including two ones of the above-mentioned waveguide antenna apparatus. The two waveguide antenna apparatuses are provided so that respective opened another ends of the rectangular waveguides of the waveguide antenna apparatuses are opposed to each other.

According to a still more further aspect of the present invention, there is provided an array antenna apparatus including two ones of the above-mentioned waveguide antenna apparatus. The two waveguide antenna apparatuses are provided so that respective short-circuited one ends of the rectangular waveguides of the waveguide antenna apparatuses are opposed to each other.

The above-mentioned array antenna apparatus preferably further includes diversity selection means for selecting and outputting a received signal having a larger signal intensity out of two received signals received respectively by the two waveguide antenna apparatuses.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
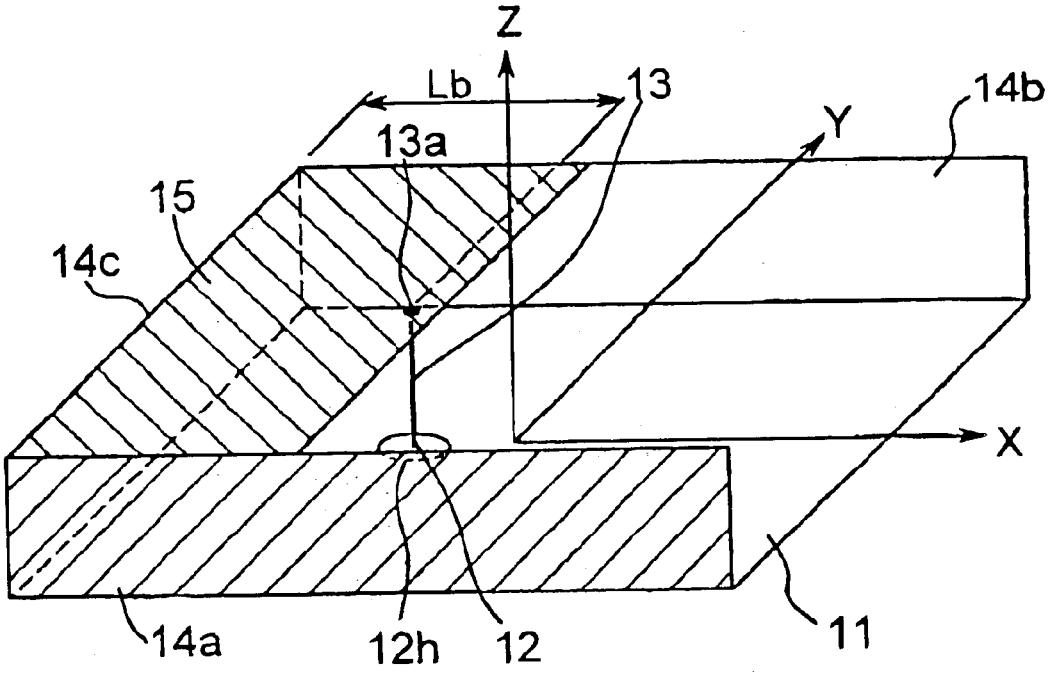
FIG. 1 is a perspective view showing a configuration of an open-ended waveguide antenna apparatus according to a first preferred embodiment of the present invention.

Preferred embodiments according to the present invention will be described below with reference to the drawings. For the sake of explanation, reference is made to the three-dimensional X-Y-Z coordinate system shown in each figure. Moreover, similar components are denoted by the same reference numerals in each figure.

First Preferred Embodiment

FIG. 1 is a perspective view showing a configuration of an open-ended waveguide antenna apparatus according to the first preferred embodiment of the present invention.

Referring to FIG. 1, the open-ended waveguide antenna apparatus of the first preferred embodiment includes a rectangular waveguide formed by including the following:

(a) a rectangular grounding conductor 11 located on the bottom surface on the X-Y plane;

(b) a rectangular ceiling conductor 15 arranged so as to oppose to the grounding conductor 11 on the top surface of the open-ended waveguide antenna apparatus; and (c) rectangular side surface conductors 14*a* and 14*b* that join the grounding conductor 11 with the ceiling conductor 15 and are opposed to each other.

One end portion of the rectangular waveguide is short-circuited by being terminated so as to be sealed with a rectangular terminating conductor 14*c*, while another end of the rectangular waveguide is opened because the ceiling conductor 15 is partially removed and is not terminated with any terminating conductor. In this case, the grounding conductor 11, the side surface conductors 14*a* and 14*b*, the ceiling conductor 15 and the terminating conductor 14*c* are joined with each other so as to be mechanically and electrically connected with each other, constituting an approximately rectangular parallelepiped rectangular waveguide that is extended with its longitudinal direction (a direction of an electromagnetic wave of a radio signal) arranged parallel to the X-direction and with its left-hand side (i.e., its end portion in the −X-direction) closed.

Further, one end of an antenna element 13 made of a conductor wire is mechanically and electrically connected with a connection point 13*a* by soldering to the connection point 13*a*, which is located in the vicinity of the right-hand end of the bottom surface of the ceiling conductor 15 (i.e., in the vicinity of the end portion in the +X-direction) and at the center in the Y-direction (a length Lb from the connection point 13*a* to the terminating conductor 14*c* is set to a quarter wavelength of the guide wavelength or a length of an odd multiple thereof from the terminating conductor 14*c*). Further, the antenna element 13 is vertically extended downward from the connection point 13*a*, and another end of the antenna element 13 is further connected with a feeding point 12 electrically insulated from the grounding conductor 11 in a circular hole 12*h* formed on the X-axis on the grounding conductor 1. The feeding point 12 is further electrically connected with, for example, a central conductor of a coaxial cable, and a grounding conductor of the coaxial cable is electrically connected with the grounding conductor 11. With this arrangement, a radio signal is fed from a radio transceiver via the coaxial cable to the feeding point 12.

The ceiling conductor 15 has a removed rectangular portion, which is extended from a position, which is located in the vicinity of the connection point 13*a* of the antenna element 13 and is slightly displaced in the +X-direction, to another end of the rectangular waveguide in the +X-direction. The size of the rectangular waveguide depends on the lowest frequency of the radio signal to be radiated. That is, the rectangular waveguide is required to have a size capable of propagating the lowest frequency.

In this case, in the above-mentioned open-ended waveguide antenna apparatus, a space, which is surrounded by the ceiling conductor 15, the side surface conductors 14*a* and 14*b*, the terminating conductor 14*c* and the grounding conductor 11, is referred to as an antenna interior, and a space located on the outside of the antenna interior is referred to as an antenna exterior.

The operation of the open-ended waveguide antenna apparatus will be described next with reference to FIGS. 1, 2A and 2B.

Figure 2A:
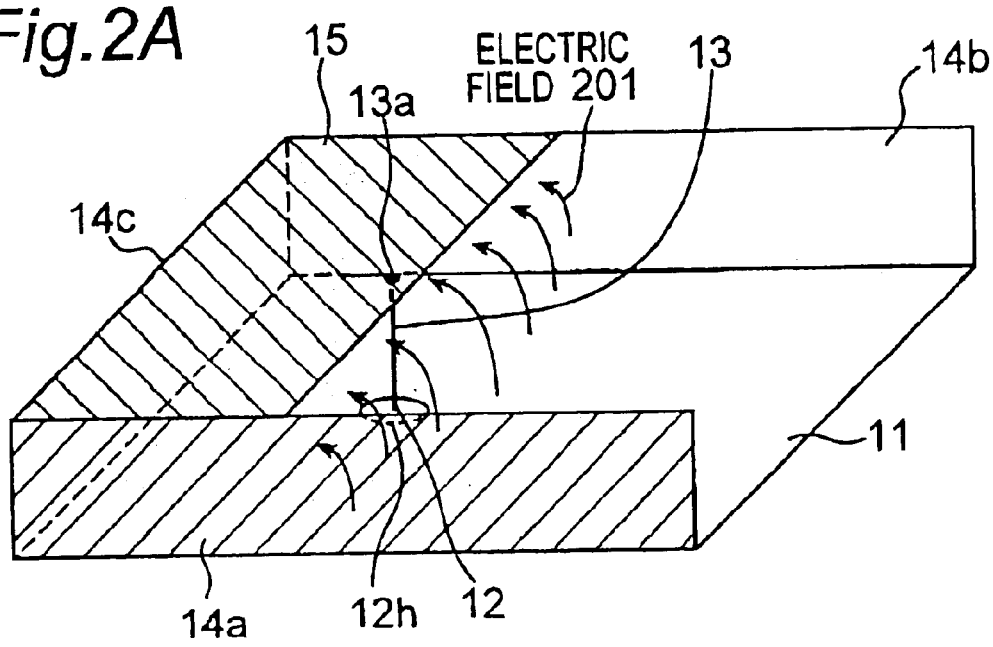
FIG. 2A is a perspective view showing an electric field distribution of the open-ended waveguide antenna apparatus of FIG. 1.
Figure 2B:
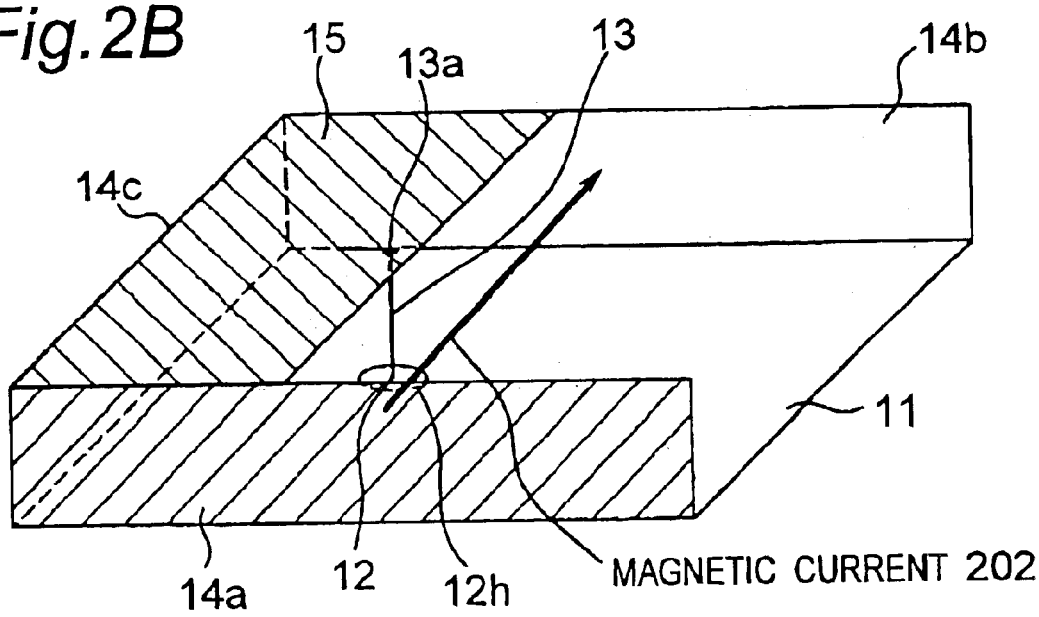
FIG. 2B is a perspective view showing a magnetic current distribution of the open-ended waveguide antenna apparatus of FIG. 1.

FIG. 2A is a perspective view showing an electric field distribution of the open-ended waveguide antenna apparatus of FIG. 1, and FIG. 2B is a perspective view showing a magnetic current distribution of the open-ended waveguide antenna apparatus of FIG. 1. In the present open-ended waveguide antenna apparatus, an electromagnetic wave is radiated by excitation of the antenna element 13, and the electromagnetic wave is radiated by an electric field 201 generated between the ceiling conductor 15 and the grounding conductor 11. The direction of the electric field 201 generated between the ceiling conductor 15 and the grounding conductor 11 is shown in FIG. 2A. Explaining the electric field 201 by replacing the same electric field 201 with a magnetic current, the electric field can be replaced by a linear magnetic current 202 parallel to the Y-axis as shown in FIG. 2B. That is, the radiation of an electromagnetic wave can be also regarded as radiation caused by the magnetic current 202. The amplitude of the magnetic current 202 changes according to a sinusoidal function so as to become zero at both ends in the Y-direction and maximized at the center portion thereof. That is, the present open-ended waveguide antenna apparatus exhibits a dipole directivity pattern of the magnetic current 202 parallel to the Y-axis. With the present dipole, a bi-directional pattern of vertical polarization is obtained on the X-Y plane and the Y-Z plane, and an omni-directional pattern is obtained on the X-Z plane.

The open-ended waveguide antenna apparatus of the present preferred embodiment has the grounding conductor 11 in the −Z-direction with respect to the dipole of the magnetic current 202, and the grounding conductor 11 serves as a reflector plate. Therefore, the electromagnetic wave is strongly radiated in the +Z-direction. Further, the open-ended waveguide antenna apparatus has the terminating conductor 14*c* in the −X-direction, and the terminating conductor 14*c* serves as a reflector plate. Therefore, a directivity having a strong main beam is exhibited in the +X-direction. That is, with the structure of the open-ended waveguide antenna apparatus, a directivity having a strong main beam can be obtained in the +Z-direction and the +X-direction of the X-Y-Z coordinate system.

Figure 3:
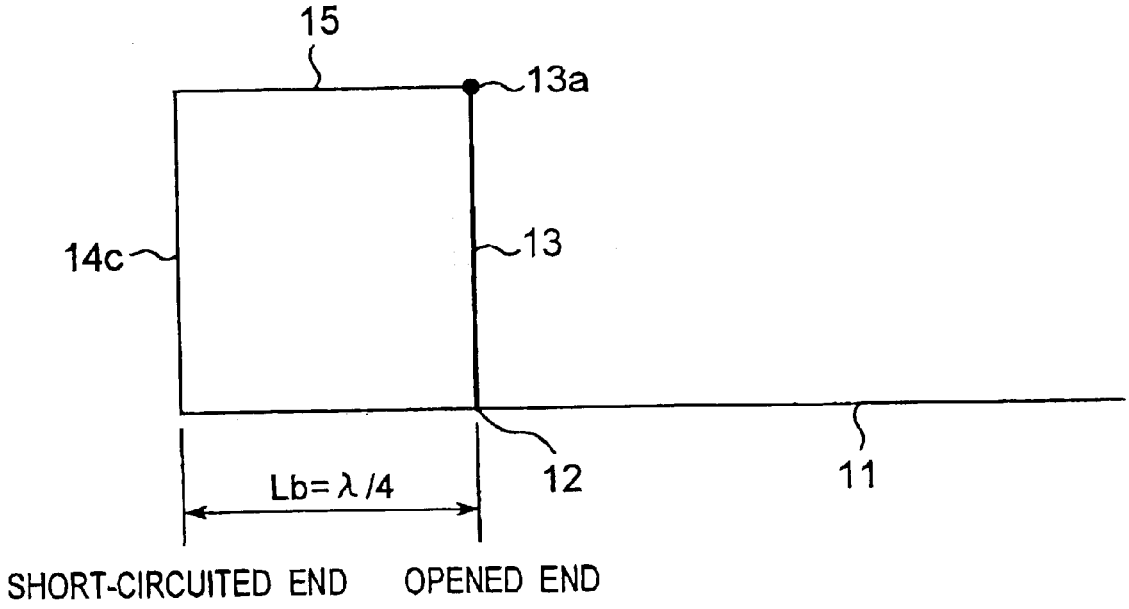
FIG. 3 is a sectional view taken along the X-Z plane of the open-ended waveguide antenna apparatus of FIG. 1.
Figure 4A:
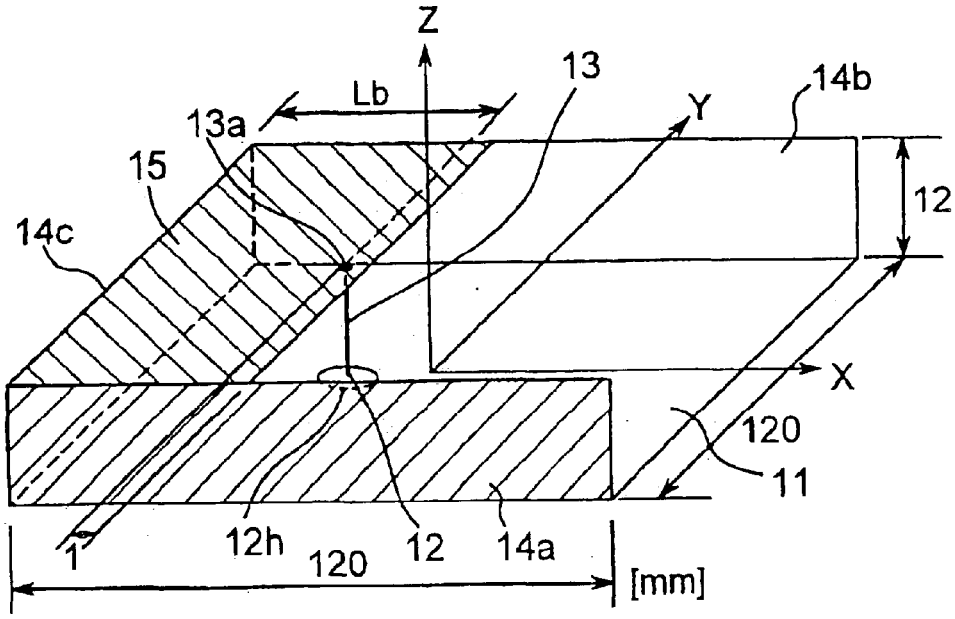
FIG. 4A is a perspective view showing a configuration of an open-ended waveguide antenna apparatus according to a first implemental example of the first preferred embodiment of the present invention.
Figure 4B:
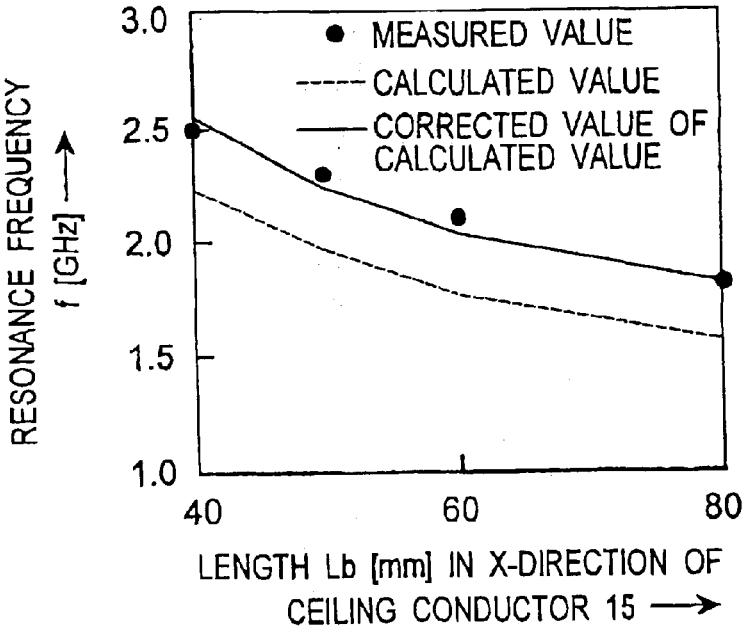
FIG. 4B is a graph showing a resonance frequency "f" of an open-ended waveguide antenna apparatus with respect to the length Lb in the X-direction of the ceiling conductor 15 of FIG. 4A.

FIG. 3 is a sectional view taken along the X-Z plane of the open-ended waveguide antenna apparatus of FIG. 1. FIG. 4A is a perspective view showing a configuration of the open-ended waveguide antenna apparatus according to the first implemental example of the first preferred embodiment of the present invention. FIG. 4B is a graph showing a resonance frequency "f" of the open-ended waveguide antenna apparatus with respect to the length Lb in the X-direction of the ceiling conductor 15 of FIG. 4A. The impedance characteristic of the open-ended waveguide antenna apparatus according to the present preferred embodiment will be described below with reference to FIGS. 3, 4A and 4B.

As is apparent from FIG. 1, the portion, which is surrounded by the grounding conductor 11, the ceiling conductor 15, the side surface conductors 14*a* and 14*b* and the terminating conductor 14*c*, can be regarded as a rectangular waveguide of which the right-hand side end is short-circuited, and the end portion in the vicinity of the connection point 13*a* at which the ceiling conductor 15 is connected with the antenna element 13 serves as the opened end of the rectangular waveguide. Therefore, in order to satisfy the resonance condition of the present rectangular waveguide, the open-ended waveguide antenna apparatus resonates at a frequency, such that the length Lb from the terminating conductor 14*c* to the connection point 13*a* of the antenna element 13 as shown in FIGS. 1 and 3, becomes a quarter wavelength of the guide wavelength or a length of an odd multiple of the quarter wavelength thereof. The guide wavelength λg [m] in the rectangular waveguide is expressed by the following equation:

$$\lambda g = \frac{1}{\sqrt{\left(\frac{f}{c}\right)^2 - \left(\frac{1}{2W}\right)^2}}, \tag{1}$$

where "f" represents the frequency to be used, "c" represents the speed of light (=$3\times10^8$ [m/sec]) and W represents the width of the rectangular waveguide, or the length in the Y-direction of the ceiling conductor 15 in this case. When the length Lb from the terminating conductor 14*c* to the connection point 13*a* of the antenna element 13 is set to λg/4, the resonance frequency "f" [Hz] is calculated by the following equation according to the Equation (1):

$$f = c\sqrt{\left(\frac{1}{4\,\mathrm{Lb}}\right)^2 + \left(\frac{1}{2W}\right)^2} \quad (2)$$

A change in the resonance frequency "f" when the length Lb of the open-ended waveguide antenna apparatus is changed will be described next. FIG. 4A shows dimensions of one implemental example of the open-ended waveguide antenna apparatus, and FIG. 4B shows change in the resonance frequency "f" of the op en-ended waveguide antenna apparatus. FIG. 4B also shows a measured value together with the calculated value obtained by the Equation (2).

As is apparent from FIG. 4B, the calculated value became slightly smaller than the measured value. This is because the resonance shifts as a result of the occurrence of leakage of an electric field since the length in the X-direction of the ceiling conductor 15 is smaller than the length in the X-direction of each of the grounding conductor 11 and the side surface conductors 14*a* and 14*b* in contrast to the fact that the Equation (1) expresses the calculated value in a complete rectangular waveguide. Therefore, in order to correct the above deviation, correction is made by multiplying the Equation (2) by a correction coefficient. FIG. 4B shows calculation results of the corrected value when the correction coefficient is 1.15. At this time, a value very close to the measured value can be obtained as a corrected value, and the resonance frequency "f" of the open-ended waveguide antenna apparatus can be obtained by the Equation (2) with the correction.

Figure 5:
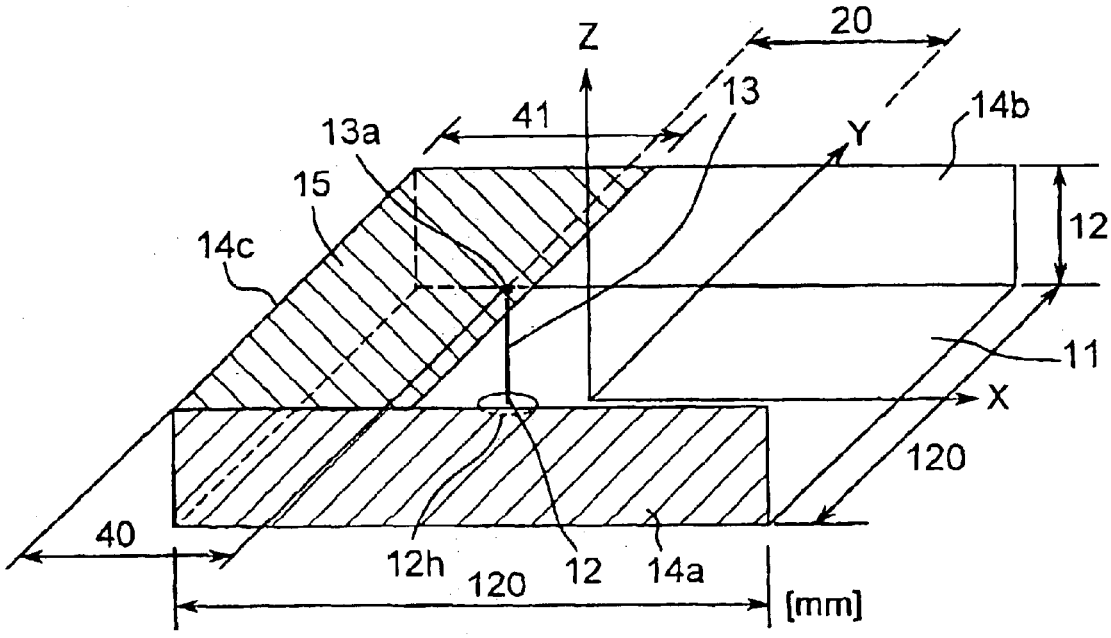
FIG. 5 is a perspective view showing a configuration of an open-ended waveguide antenna apparatus according to a second implemental example of the first preferred embodiment of the present invention.

Next, as a prototype waveguide antenna apparatus actually manufactured by the present inventors, FIG. 5 shows a perspective view showing a configuration of the open-ended waveguide antenna apparatus according to the second implemental example of the first preferred embodiment of the present invention.

Referring to FIG. 5, the grounding conductor 11 has a square shape of a side length of 120 mm, the height of the side surface conductors 14*a* and 14*b* and the terminating conductor 14*c* is set to 12 mm, and the length in the X-direction of the ceiling conductor 15 is set to 41 mm. It is to be noted that the feeding point 12 is arranged in a position located apart by 20 mm from the center of the grounding conductor 11 in the −X-direction on the X-axis.

Figure 6:
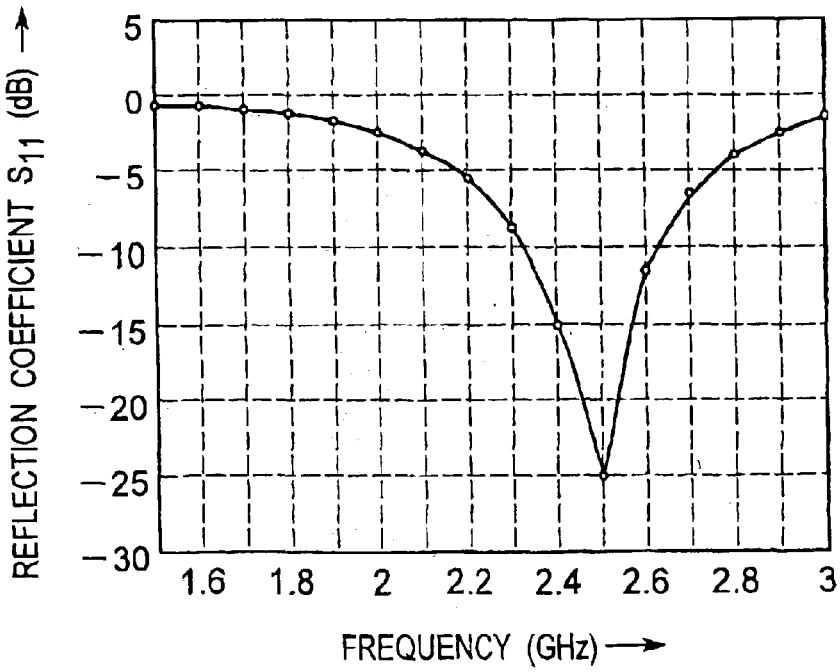
FIG. 6 is a graph showing a frequency characteristic of the reflection coefficient $S_{11}$ of the open-ended waveguide antenna apparatus of FIG. 5.

FIG. 6 is a graph showing a frequency characteristic of the reflection coefficient $S_{11}$ of the open-ended waveguide antenna apparatus of FIG. 5. As shown in FIG. 6, it can be understood that the prototype open-ended waveguide antenna apparatus of FIG. 5 manufactured by the present inventors at a frequency of about 2.5 GHz, exhibiting a satisfactory reflection characteristic.

Figure 7A:
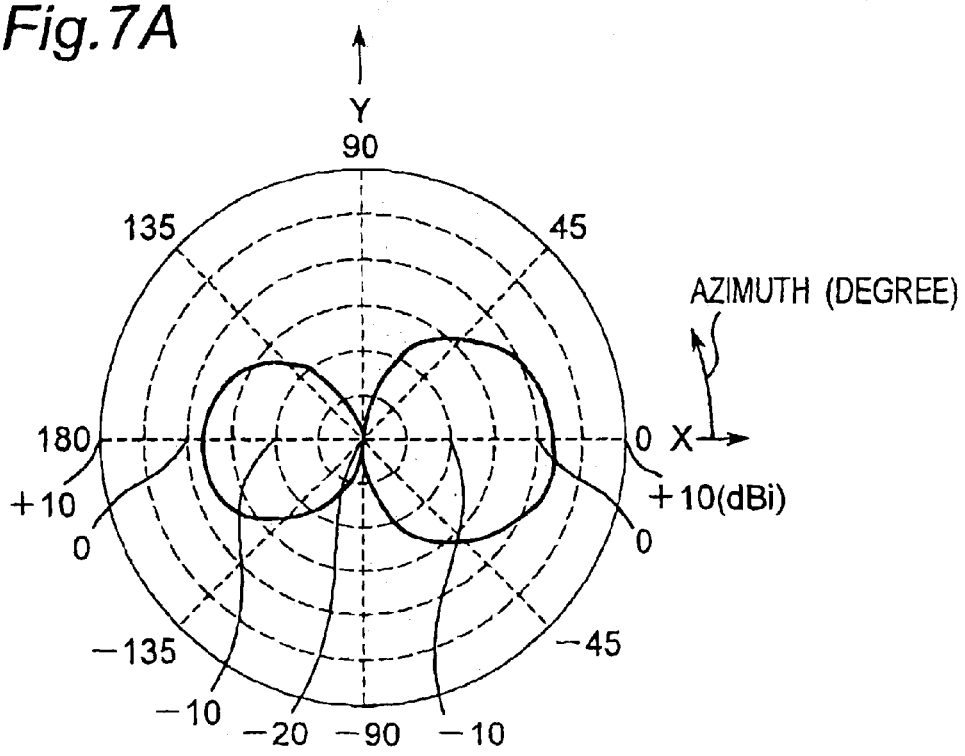
FIG. 7A is a graph showing a radiation directivity pattern on the X-Y plane of the open-ended waveguide antenna apparatus of FIG. 5.
Figure 7B:
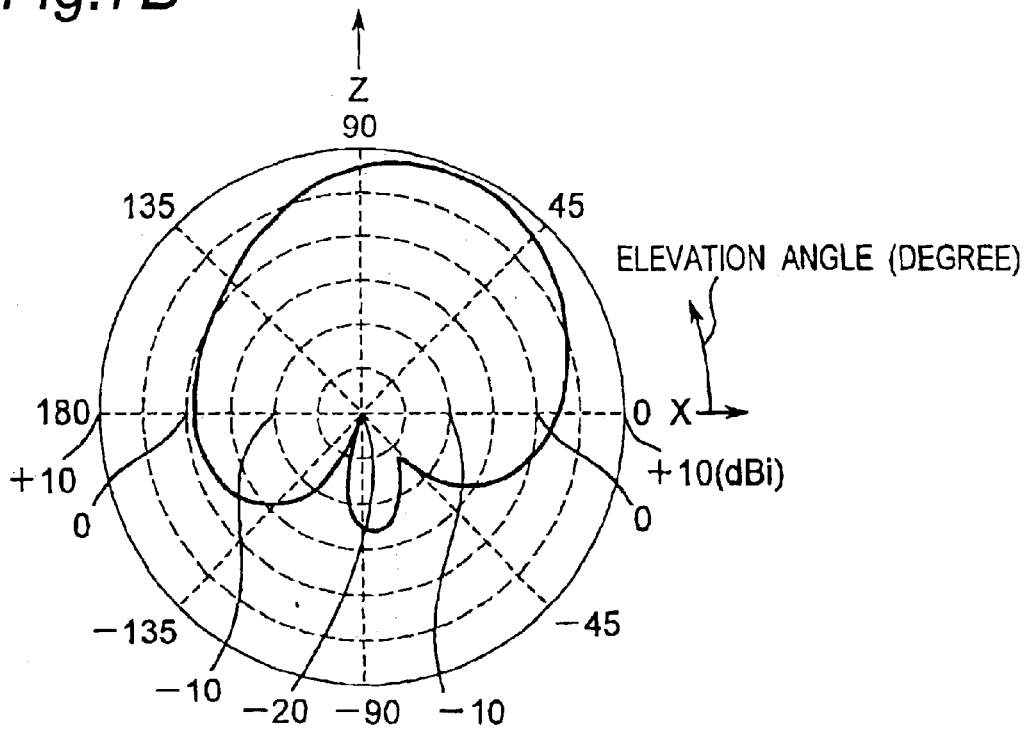
FIG. 7B is a graph showing a radiation directivity pattern on the X-Z plane of the open-ended waveguide antenna apparatus of FIG. 5.

FIGS. 7A and 7B are graphs showing radiation directivity patterns of the open-ended waveguide antenna apparatus of FIG. 5. FIG. 7A is a graph showing a radiation directivity pattern on the X-Y plane, and FIG. 7B is a graph showing a radiation directivity pattern on the X-Z plane. FIGS. 7A and 7B show the radiation directivity patterns when the operation frequency of the open-ended waveguide antenna apparatus is set to 2 GHz, and one interval of the scale in the radial direction representing the gain of the waveguide antenna apparatus is 10 dB, and the unit is dBi representing the relative gain with reference to the radiation power of an ideal point wave source.

FIGS. 7A and 7B show radiation directivity patterns on the horizontal plane (or the X-Y plane) and the vertical plane (or the X-Z plane), respectively. As is apparent from FIG. 7B, it can be understood that the radiation of an electromagnetic wave has a directivity having a strong main beam in the +Z-direction and the +X-direction of the X-Y-Z coordinate system, and the present waveguide antenna apparatus achieves a directivity having a strong main beam in one direction with a simple structure. In the maximum radiation direction (i.e., beam direction) on the X-Z plane, a high gain of 7.8 dBi was obtained at an angle of about 20 degrees from the +Z-direction of the Z-axis toward the +X-direction, and a gain of 2 dBi was obtained in the +X-direction of the X-axis also on the X-Y plane. This represents that the open-ended waveguide antenna apparatus is an antenna apparatus effective when installed in an end portion of a coverage area like a place near an indoor wall or window. Furthermore, the open-ended waveguide antenna apparatus, which achieves a height of 0.1 wavelengths at an operation frequency of 2.5 GHz, can be manufactured as a very low-profile antenna apparatus.

In the above-mentioned preferred embodiment and the prototype example described above, the waveguide antenna apparatus has a structure symmetrical with respect to the X-Z plane. However, in this case, there is such an advantageous effect that the directivity pattern of the radiated electromagnetic wave from the waveguide antenna apparatus becomes symmetrical with respect to the X-Z plane (See FIG. 7A).

As described above, according to the open-ended waveguide antenna apparatus of the present preferred embodiment, there can be provided an antenna apparatus that keeps a compact low-profile configuration and has a directivity having a strong main beam in one direction with a simple structure.

The above-mentioned preferred embodiment has been described taking as an example the open-ended waveguide antenna apparatus having the structure symmetrical with respect to the X-Z plane. However, the present invention is not limited to this, and the waveguide antenna apparatus may be formed so as to have a structure asymmetrical with respect to the X-Z plane in order to obtain, for example, a desired radiation directivity pattern or input impedance characteristic. By adopting such a structure, there may be provided an antenna apparatus that has a radiation directivity pattern suitable for the objective space of radiation.

The above-mentioned preferred embodiment has been described taking as an example the open-ended waveguide antenna apparatus of which the antenna element 13 is made of a conductor wire. However, the present invention is not limited to this, and the antenna element 13 may be made of, for example, a plate-shaped conductor. With this arrangement, there is such a unique advantageous effect that there can be obtained a high-efficiency antenna apparatus, which is able to obtain a desired input impedance characteristic and has a little reflection loss.

Figure 8:
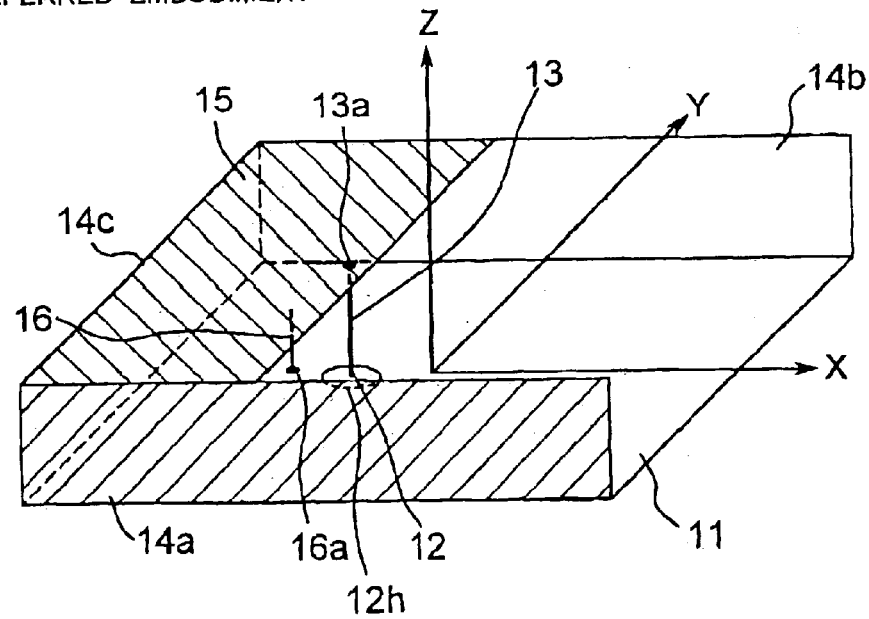
FIG. 8 is a perspective view showing a configuration of an open-ended waveguide antenna apparatus according to a first modified preferred embodiment of the first preferred embodiment of the present invention.

FIG. 8 is a perspective view showing a configuration of an open-ended waveguide antenna apparatus according to the first modified preferred embodiment of the first preferred embodiment of the present invention. In order to obtain a desired input impedance characteristic, it is acceptable to provide a matching conductor 16 on the inside of the antenna, as shown in FIG. 8, in addition to the structure of the open-ended waveguide antenna apparatus of FIG. 1. In the open-ended waveguide antenna apparatus of FIG. 8, the matching conductor 16 made of a linear conductor is electrically connected with the grounding conductor 11 in a position, which is located on the X-axis of the grounding conductor 11 parallel to the antenna element 13 and slightly displaced in the −X-direction from the antenna element 13 (i.e., a position that is slightly displaced in the direction directed from the antenna element 13 toward the terminating conductor 14*c* and is located in the vicinity of the feeding portion 12). The matching conductor 16 further extends upwardly from the above electrical connection point 16*a* and has a length smaller than the height of the rectangular waveguide. With this arrangement, by changing the electric field in the vicinity of the antenna element 13 and changing the current flowing through the antenna element 13, the input impedance of the open-ended waveguide antenna apparatus can be changed so that, for example, the input impedance of the open-ended waveguide antenna apparatus substantially coincides with the characteristic impedance of the coaxial cable. Accordingly, there is such a unique advantageous effect that there can be provided a high-efficiency antenna apparatus, which is able to obtain a desired input impedance characteristic and has a little reflection loss.

Figure 9:
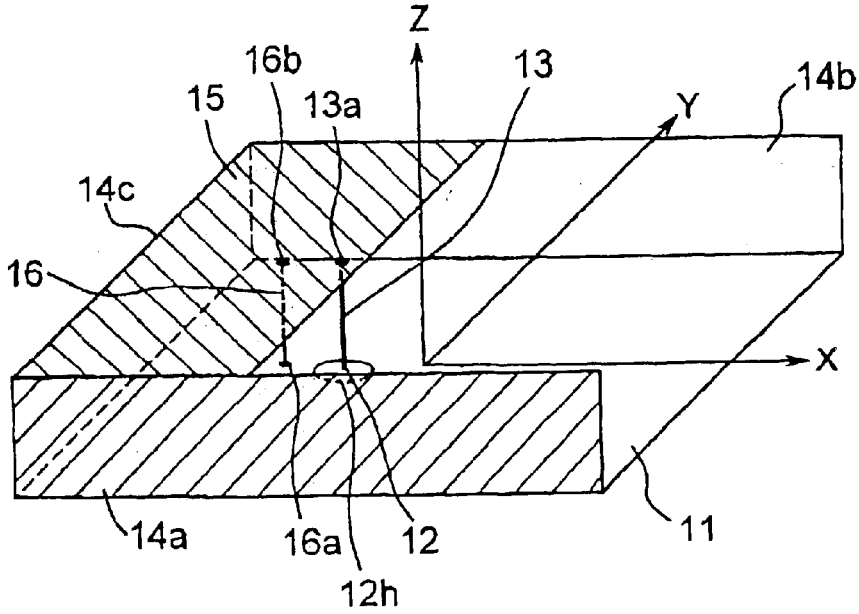
FIG. 9 is a perspective view showing a configuration of an open-ended waveguide antenna apparatus according to a second modified preferred embodiment of the first preferred embodiment of the present invention.

FIG. 9 is a perspective view showing a configuration of an open-ended waveguide antenna apparatus according to the second modified preferred embodiment of the first preferred embodiment of the present invention. In order to obtain a desired impedance characteristic, it is acceptable to connect a matching conductor 16 of the same length as that of the antenna element 13 parallel to the antenna element 13 on the inside of the antenna, as shown in FIG. 9, in addition to the structure of the open-ended waveguide antenna apparatus of FIG. 1. In this case, one end of the matching conductor 16 is connected with the grounding conductor 11 at a connection point 16*a*, while another end of the matching conductor 16 is connected with the ceiling conductor 15 at a connection point 16*b*.

Figure 10:
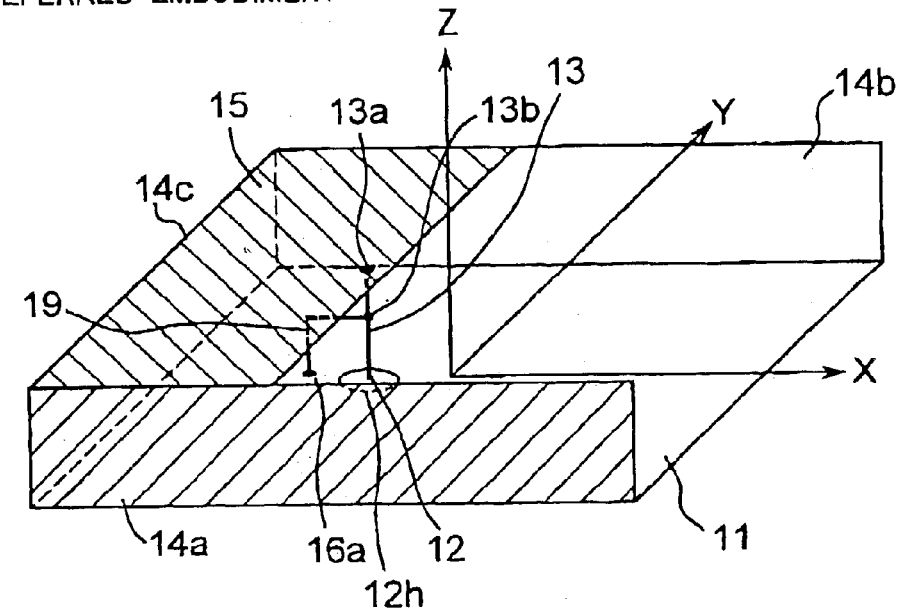
FIG. 10 is a perspective view showing a configuration of an open-ended waveguide antenna apparatus according to a third modified preferred embodiment of the first preferred embodiment of the present invention.

FIG. 10 is a perspective view showing a configuration of an open-ended waveguide antenna apparatus according to the third modified preferred embodiment of the first preferred embodiment of the present invention. In order to obtain a desired impedance characteristic, it is acceptable to connect a matching conductor 19 on the inside of the antenna, as shown in FIG. 10, in addition to the structure of the open-ended waveguide antenna apparatus of FIG. 1.

Referring to FIG. 10, the matching conductor 16 made of a linear conductor is electrically connected with the grounding conductor 11 at the above-mentioned connection point 16*a*, then is extended upward from the connection point 16*a*, then is bent substantially at a right angle and electrically connected with the approximate center portion of the antenna element 13. With this arrangement, there is such a unique advantageous effect that the impedance characteristic can be remarkably largely changed since the current flowing through the antenna element 13 can be directly changed by using the matching conductor 19. Therefore, the input impedance of the open-ended waveguide antenna apparatus can to be changed so that, for example, the input impedance of the open-ended waveguide antenna apparatus substantially coincides with the characteristic impedance of the coaxial cable, and there can be provided a high-efficiency antenna apparatus, which is able to obtain a desired input impedance characteristic and has a little reflection loss.

Figure 11:
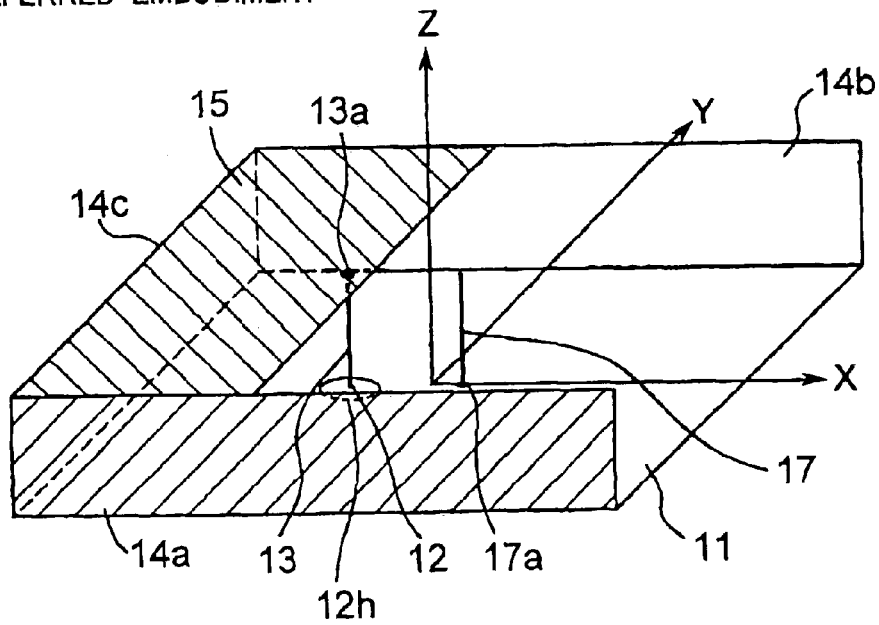
FIG. 11 is a perspective view showing a configuration of an open-ended waveguide antenna apparatus according to a fourth modified preferred embodiment of the first preferred embodiment of the present invention.

FIG. 11 is a perspective view showing a configuration of an open-ended waveguide antenna apparatus according to the fourth modified preferred embodiment of the first preferred embodiment of the present invention. In order to change the radiation directivity pattern of the waveguide antenna apparatus, it is acceptable to provide a directivity pattern controlling conductor 17 in addition to the structure of the open-ended waveguide antenna apparatus of FIG. 1, as shown in the open-ended waveguide antenna apparatus according to the fourth modified preferred embodiment of the present preferred embodiment of FIG. 11.

Referring to FIG. 11, the directivity pattern controlling conductor 17 made of a linear conductor is provided in a position on the X-axis on the top surface of the grounding conductor 11 while being directed in the +X-direction from the antenna element 13. One end of the directivity pattern controlling conductor 17 is connected with the grounding conductor 11 at a connection point 17*a*. The directivity pattern controlling conductor 17 is extended upwardly from the one end and has a length equal to or slightly smaller than that of the rectangular waveguide. As a consequence of the operation of the directivity pattern controlling conductor 17 as a wave director, there is obtained such a unique advantageous effect that the directivity of the electromagnetic wave radiated from the open-ended waveguide antenna apparatus becomes sharper in the +X-direction than when the directivity pattern controlling conductor 17 is not provided.

In the fourth modified preferred embodiment of FIG. 11, the directivity pattern controlling conductor 17 is made of a linear conductor. [5 However, this may be made of a conductor of the other shape. For example, the directivity pattern controlling conductor 17 may be constituted by a helical type matching conductor made of a spiral conductor wire or a conductor wire bent in an L-figured shape. With this arrangement, it is possible to make the waveguide antenna apparatus have a low-profile configuration without impairing such an advantageous effect as the above-mentioned sharp directivity.

Figure 12:
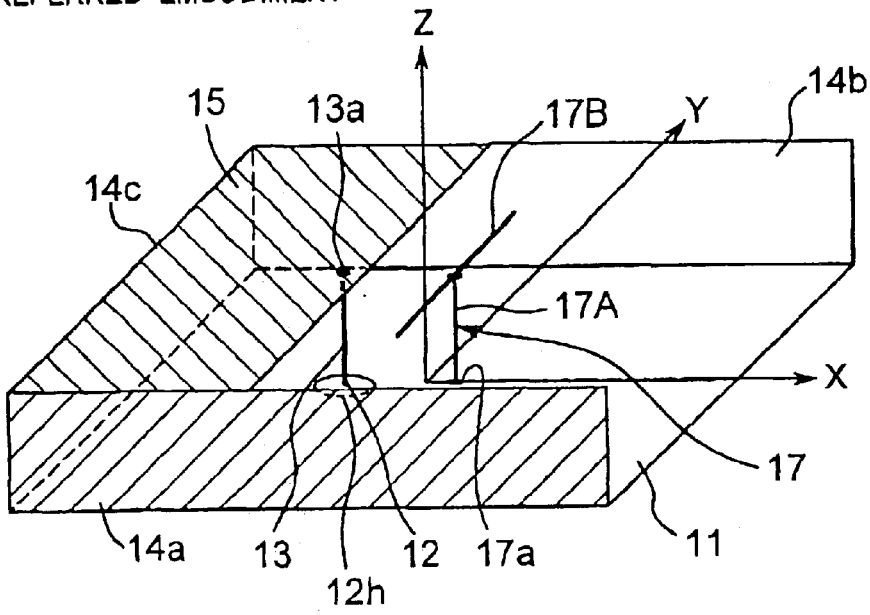
FIG. 12 is a perspective view showing a configuration of an open-ended waveguide antenna apparatus according to a fifth modified preferred embodiment of the first preferred embodiment of the present invention.

FIG. 12 is a perspective view showing a configuration of an open-ended waveguide antenna apparatus according to the fifth modified preferred embodiment of the first preferred embodiment of the present invention.

Referring to FIG. 12, based on the structure of the open-ended waveguide antenna apparatus of FIG. 1, the open-ended waveguide antenna apparatus of FIG. 12 is characterized in that a directivity pattern controlling conductor 17 is provided at a connection point 17*a* in a position, which is located on the X-axis on the grounding conductor 11 while being displaced in the +X-direction from the antenna element 13. In this case, the directivity pattern controlling conductor 17 is made of a linear conductor 17A parallel to the Z-direction and a linear conductor 17B parallel to the Y-direction. One end of the linear conductor 17A is electrically connected with the grounding conductor 11. The linear conductor 17A is further extended upwardly to have a length equal to or slightly smaller than that of the rectangular waveguide, and another end of the linear conductor 17A is connected with an intermediate portion of the linear conductor 17B. In this case, the linear conductor 17A parallel to the Z-direction is preferably connected with an approximate center portion of the linear conductor 17B parallel to the Y-direction, so that the sum of the length of the conductor 17A parallel to the Z-direction and one half the length of the linear conductor 17B parallel to the Y-direction is set to about a quarter wavelength or a length of an odd multiple thereof. By setting the lengths of the linear conductors 17A and 178 as described above, resonance is caused in the directivity pattern controlling conductor 17 when the open-ended waveguide antenna apparatus is fed with electric power, and such a remarkable advantageous effect is obtained as a directivity sharper than when the other length is set. The structure of the open-ended waveguide antenna apparatus of FIG. 11 utilizes a technique for principally improving the directivity pattern on the X-Z plane of the open-ended waveguide antenna apparatus. However, by adopting the structure of FIG. 12, the directivity pattern on the X-Y plane of the open-ended waveguide antenna apparatus can be also changed, and in particular, the radiation in the +X-direction can be increased.

Figure 13:
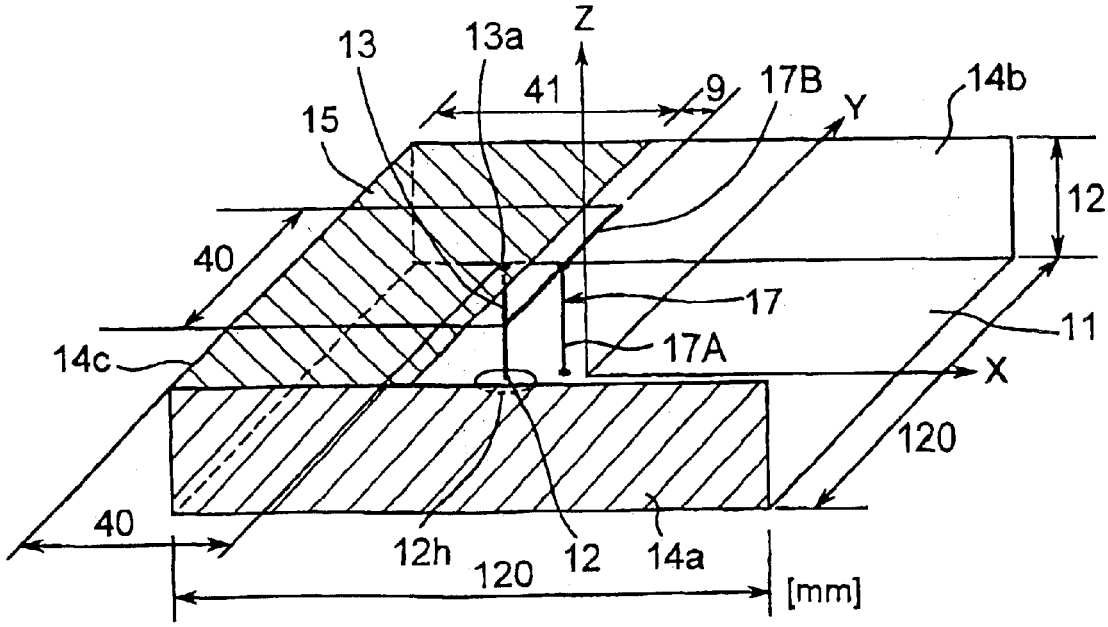
FIG. 13 is a perspective view showing a configuration of an open-ended waveguide antenna apparatus according to an implemental example of the fifth modified preferred embodiment of the first preferred embodiment of the present invention.
Figure 14A:
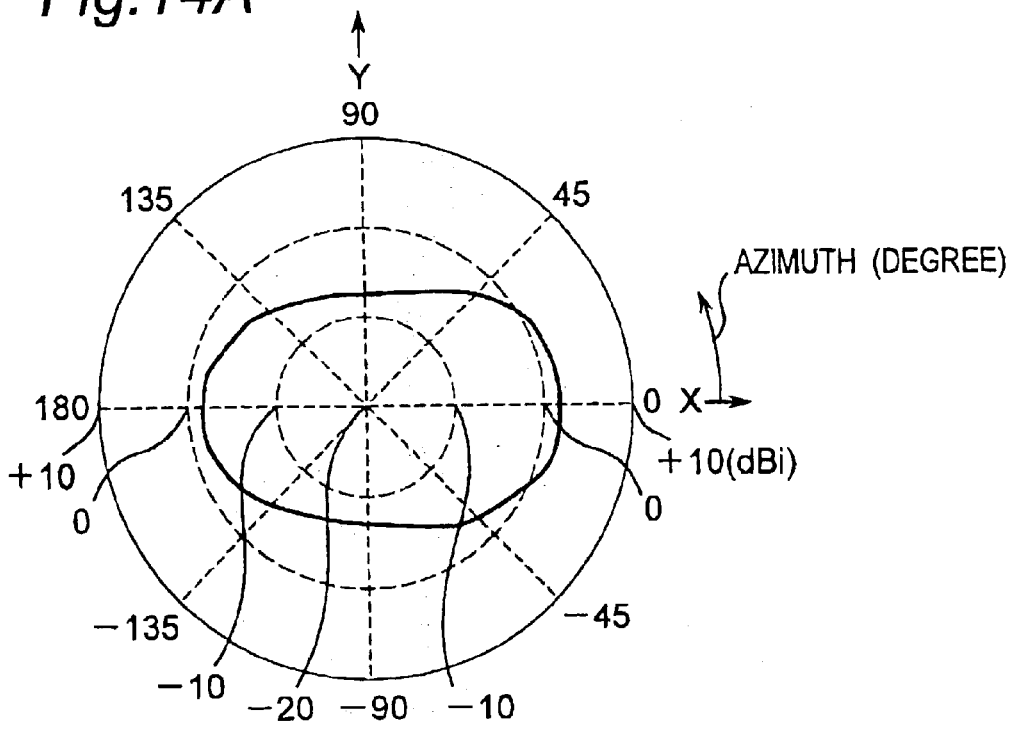
FIG. 14A is a graph showing a radiation directivity pattern in the X-Y plane of the open-ended waveguide antenna apparatus of FIG. 13.
Figure 14B:
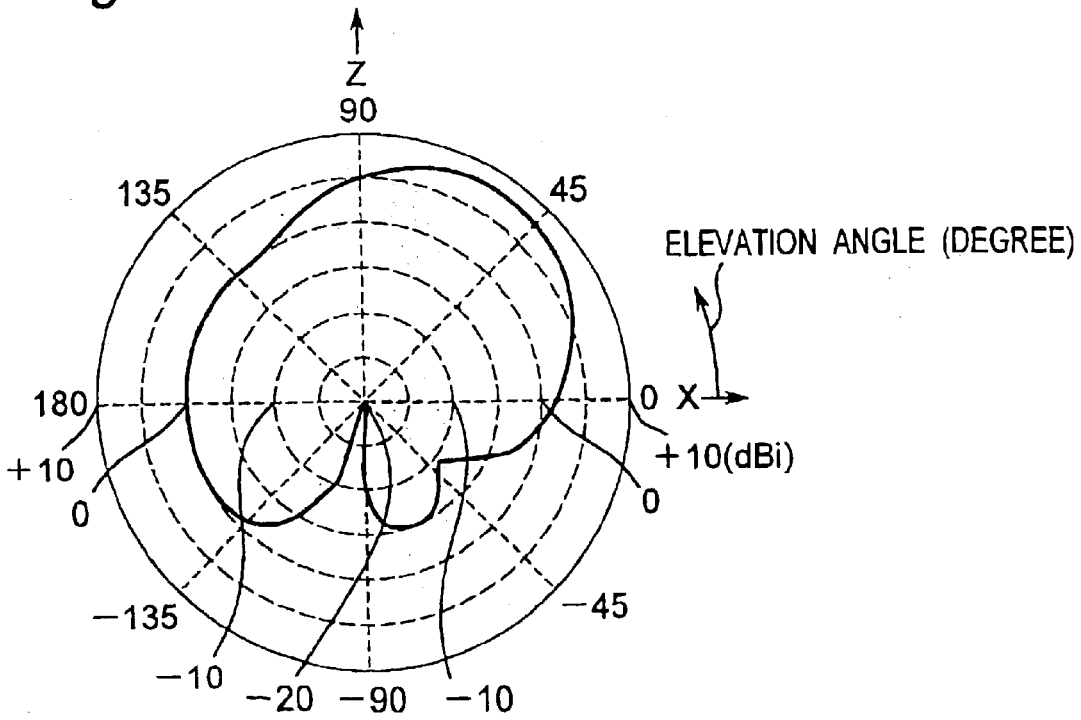
FIG. 14B is a graph showing a radiation directivity pattern in the X-Z plane of the open-ended waveguide antenna apparatus of FIG. 13.

FIG. 13 is a perspective view showing a configuration of an open-ended waveguide antenna apparatus according to an implemental example of the fifth modified preferred embodiment of the first preferred embodiment of the present invention. FIGS. 14A and 14B are graphs showing radiation directivity patterns of the open-ended waveguide antenna apparatus of FIG. 13. FIG. 14A is a graph showing a radiation directivity pattern on the X-Y plane, and FIG. 14B is a graph showing a radiation directivity pattern on the X-Z plane. That is, FIG. 13 shows the case where the open-ended waveguide antenna apparatus having such the structure of FIG. 5 is provided with the directivity pattern controlling conductor 17 and the operation frequency is set to 2 GHz. As is apparent from FIG. 14A, it can be understood that the radiation in the +X-direction on the X-Z plane is further strengthened by virtue of provision of the directivity pattern controlling conductor 17 in comparison with the directivity pattern of FIG. 7. Moreover, as is apparent from FIG. 14B, a high gain of 7.5 dBi was obtained at an angle of 35 degrees from the +Z-direction toward the +X-direction on the X-Y plane in the maximum radiation direction (i.e., beam direction), and a gain of 2 dBi was obtained in the +X-direction on the X-axis also on the X-Y plane of FIG. 14B. Moreover, it can be understood that the radiation in the Y-direction is increased on the X-Y plane. With this arrangement, it is possible to remarkably largely change the directivity pattern also on the horizontal plane (X-Y plane). When the present waveguide antenna apparatus is arranged in a place near an indoor wall or window, it is required to radiate an electromagnetic wave also in the Y-direction toward the place near the wall. Therefore, the directivity pattern of the present waveguide antenna apparatus has radiation in the Y-direction, and this is a preferable directivity pattern when the waveguide antenna apparatus is arranged in a place near the indoor wall.

The above-mentioned preferred embodiment and modified preferred embodiments have been described on the basis of the case where one directivity pattern controlling conductor 17 is provided. However, the present invention is not limited to this, and two or more directivity pattern controlling conductors 17 may be provided. With this arrangement, the degree of freedom in the structure of the waveguide antenna apparatus is increased, making it possible to more largely control the radiation directivity pattern. It is also acceptable to provide the directivity pattern controlling conductor 17 together with the matching conductor 16 shown in FIGS. 8 to 10.

The above-mentioned preferred embodiment and modified preferred embodiments have been described taking as an example the waveguide antenna apparatus having such a structure that the grounding conductor 11 has a square shape. However, the present invention is not limited to this, and in order to obtain, for example, a desired radiation directivity pattern or input impedance characteristic, the grounding conductor 11 may have a rectangle, the other polygons, a semicircle or a combination of these shapes or the other shape.

When the present waveguide antenna apparatus is installed on the ceiling or the like, there is a demand for conforming the antenna apparatus configuration to the ceiling panel frame arrangement or the room configuration so that the antenna apparatus is not conspicuous. However, when the configuration of the waveguide antenna apparatus is a rectangle or the other polygons, there is a restriction on the direction in which the waveguide antenna apparatus is installed since the ceiling panel frame arrangement or the room configuration is fixed. In order to solve this problem, there is proposed an open-ended waveguide antenna apparatus according to the following implemental example.

Figure 15:
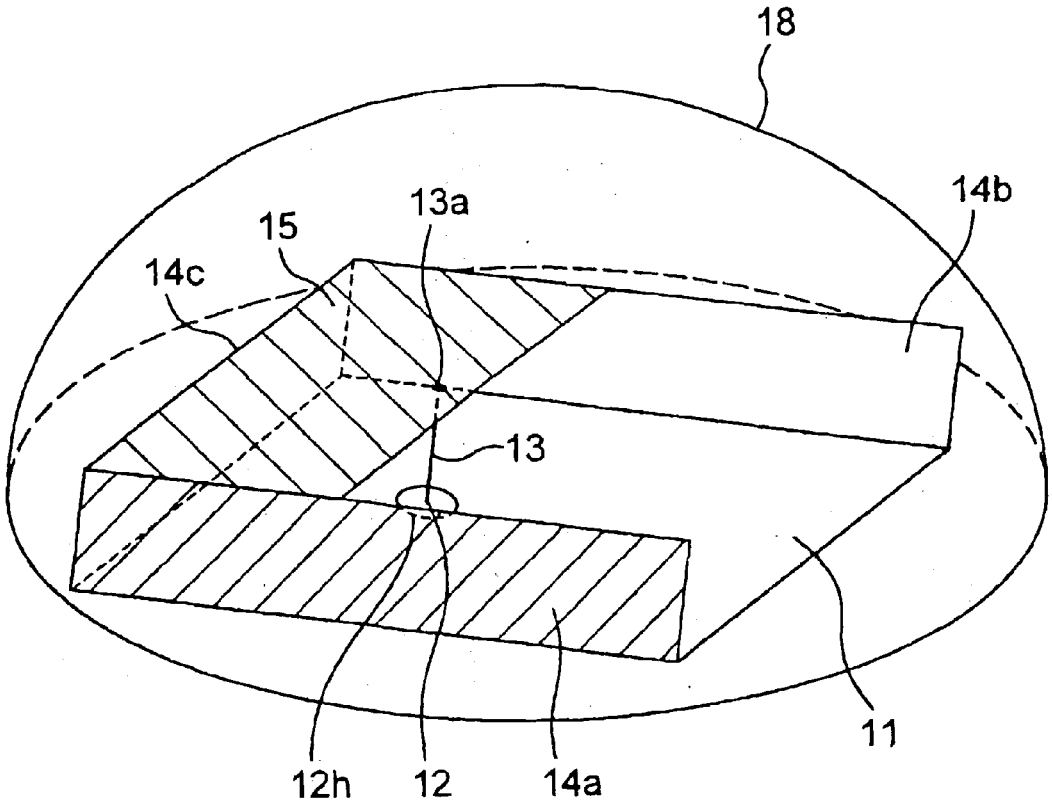
FIG. 15 is a perspective view showing a configuration of an open-ended waveguide antenna apparatus according to a third implemental example of the first preferred embodiment of the present invention.

FIG. 15 is a perspective view showing a configuration of an open-ended waveguide antenna apparatus according to the third implemental example of the first preferred embodiment of the present invention. As shown in FIG. 15, the present open-ended waveguide antenna apparatus according to the third implemental example of the first preferred embodiment is characterized in that the open-ended waveguide antenna apparatus of FIG. 1 is covered with a radome 18. By using the radome 18 whose bottom surface in contact with the grounding conductor 11 is circular, there are such unique advantages that the characteristics of the waveguide antenna apparatus are stabilized by preventing the entry of moisture, dust and so on which deteriorate the antenna characteristics and that the waveguide antenna apparatus can be installed without caring for the ceiling panel frame arrangement or the room configuration upon installing the waveguide antenna apparatus on the ceiling. Furthermore, when the bottom surface of the waveguide antenna apparatus is circular, it is possible to change the direction in which the waveguide antenna apparatus is set by rotating the waveguide antenna apparatus. With this arrangement, the electromagnetic wave radiation direction can be adjusted, and there can be obtained a radiation directivity pattern suitable for the installation position of the waveguide antenna apparatus.

In the above-mentioned preferred embodiment and modified preferred embodiments, one open-ended waveguide antenna apparatus has been described. However, the present invention is not limited to this, and it is also acceptable to arrange a plurality of open-ended waveguide antenna apparatuses in an array form for the structure of a phased array antenna and an adaptive antenna array. This makes it possible to further control the directivity pattern of the electromagnetic wave that is radiated from the waveguide antenna apparatus.

Second Preferred Embodiment

Figure 16:
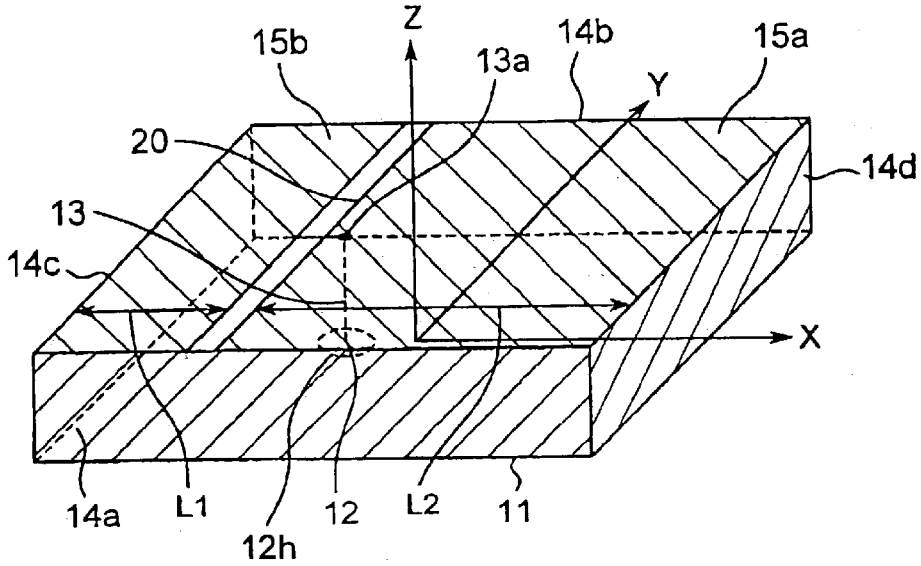
FIG. 16 is a perspective view showing a configuration of a slit radiation type waveguide antenna apparatus according to a second preferred embodiment of the present invention.

FIG. 16 is a perspective view showing a configuration of a slit radiation type waveguide antenna apparatus according to the second preferred embodiment of the present invention.

Referring to FIG. 16, the slit radiation type waveguide antenna apparatus of the present preferred embodiment includes a rectangular waveguide formed by including the following:

(a) a square grounding conductor 11 located on the bottom surface on the X-Y plane;

(b) rectangular ceiling conductors 15*a* and 15*b* arranged so as to oppose the grounding conductor 11 on the top surface of the slit radiation type waveguide antenna apparatus (hereinafter referred to as an antenna ceiling portion); and (c) rectangular side surface conductors 14*a* and 14*b* that join the grounding conductor 11 with the ceiling conductors 15*a* and 15*b*.

Two terminal portions in the longitudinal direction of the rectangular waveguide are terminated and short-circuited by rectangular terminating conductors 14*c* and 14*d*, respectively. The grounding conductor 11, the side surface conductors 14*a* and 14*b*, the ceiling conductors 15*a* and 15*b* and the terminating conductors 14*c* and 14*d* are mechanically and electrically connected with each other, constituting a hollow rectangular parallelepiped housing portion symmetrical with respect to the X-Z plane.

In the antenna ceiling portion, one slit 20 is formed over the entire width of the rectangular waveguide parallel to the Y-direction between the ceiling conductors 15*a* and 15*b*. The ceiling conductor 15*a* is positioned on the side of the terminating conductor 14*c*, and the ceiling conductor 15*b* is positioned on the side of the terminating conductor 14*d* with interposition of the slit 20. The slit 20 is formed in a position where the length L1 of the ceiling conductor 15*a* and the length L2 of the ceiling conductor 15*b* are different from each other in the longitudinal direction (X-direction) of the rectangular waveguide as described in detail later. In this case, the width of the slit 20 is sufficiently smaller than each of the lengths L1 and L2. Moreover, one end of an antenna element 13 made of a conductor wire is mechanically and electrically connected with a connection point 13*a* by soldering or the like with the connection point 13*a* at the center portion in the Y-direction on the bottom surface of the ceiling conductor 15*a*, while the antenna element 13 is extended vertically downward from the connection point 13*a* so as to be perpendicular to the ceiling conductor 15*a*. Further, another end of the antenna element 13 is electrically connected with a feeding point 12 that is electrically insulated from the grounding conductor 11 in a circular hole 12*h* formed on the X-axis on the grounding conductor 11. The feeding point 12 is electrically connected with, for example, the central conductor of a coaxial cable, while the grounding conductor of the coaxial cable is electrically connected with the grounding conductor 11. With this arrangement, a radio signal fed from a radio transceiver is fed to the feeding point 12.

In this case, a space, which is surrounded by the ceiling conductors 15*a* and 15*b*, the side surface conductors 14*a* and 14*b*, the terminating conductors 14*c* and 14*d* and the grounding conductor 11, is referred to as an antenna interior, and a space on the outside of the antenna interior is referred to as an antenna exterior.

Figure 17:
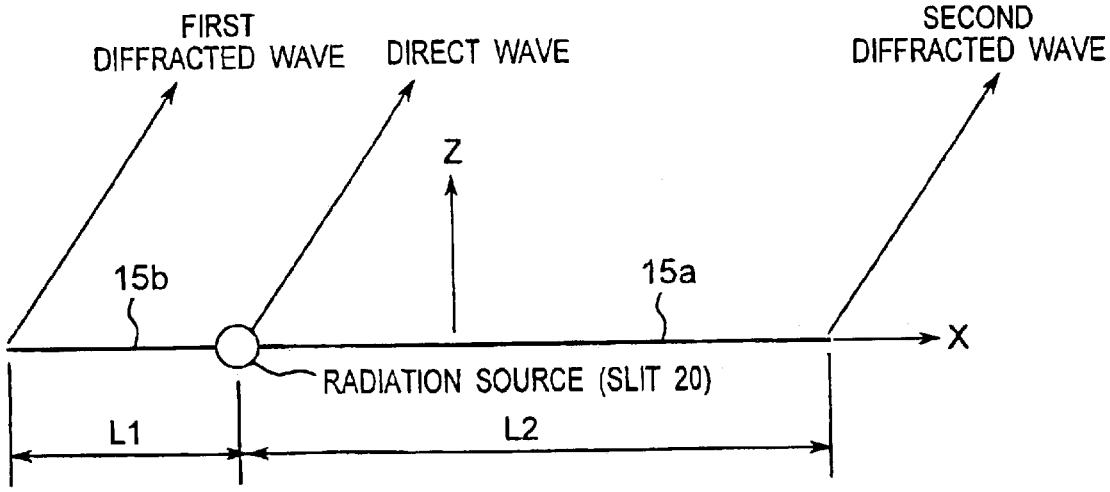
FIG. 17 is a sectional view of a ceiling conductor 15 taken along the X-Z plane of FIG. 16, showing a principle of operation when the slit radiation type waveguide antenna apparatus of FIG. 16 radiates an electromagnetic wave.

The operation of the slit radiation type waveguide antenna apparatus of the present preferred embodiment will be described with reference to FIGS. 16 and 17. FIG. 17 is a sectional view of the ceiling conductor 15 taken along the X-Z plane of FIG. 16, showing a principle of operation when the slit radiation type waveguide antenna apparatus of FIG. 16 radiates an electromagnetic wave.

An electromagnetic wave is radiated by the excitation of the antenna element 13, and the electromagnetic wave is radiated by the electric field generated in the slit 20. Explaining the electric field by replacing the same electric field with a magnetic current, the electric field can be replaced by a linear magnetic current source parallel to the Y-axis. That is, the radiation of electromagnetic wave can be also regarded as radiation by the magnetic current source. Therefore, the amplitude of the above magnetic current source changes according to a sinusoidal function so as to become zero at both ends thereof and is maximized in a center portion thereof. That is, the present slit radiation type waveguide antenna apparatus exhibits a dipole directivity pattern of the linear magnetic current parallel to the Y-axis. With the present dipole, a bi-directional pattern of vertical polarization is obtained on the X-Y plane and the Y-Z plane, and an omni-directional pattern is obtained on the X-Z plane. However, there are the ceiling conductors 15*a* and 15*b* around the slit 20, and diffraction of an electromagnetic wave occurs at the end portions of the ceiling conductors 15*a* and 15*b* connected with the terminating conductors 14*c* and 14*d*, respectively. Therefore, as shown in FIG. 17, the radiation directivity pattern from the slit 20 is obtained as the sum of the direct wave from the slit 20 and the first and second diffracted waves from the two end portions of the ceiling conductors 15*b* and 15*a*. That is, if there is a difference between the distance L1 from the radiation source to the diffraction end in the −X-direction and the distance L2 to the diffraction end in the +X-direction, then the directivity has a strong main beam in one direction and inclines from the vertical direction, or the +Z-direction on the Z-axis.

If the length L1 is smaller than the length L2 as shown in FIG. 17, then the phase of the first diffracted wave goes ahead of the second diffracted wave, and the directivity inclines from the +Z-direction of the direction perpendicular to the +X-direction. That is, a directivity having a strong main beam is obtained in the +X-direction of the X-Y-Z coordinate system. On the other hand, for example, if the length L1 is larger than the length L2, the phase of the first diffracted wave delays behind the second diffracted wave, and the directivity inclines from the +Z-direction of the direction perpendicular to the −X-direction. That is, a directivity having a strong main beam is obtained in the −X-direction of the X-Y-Z coordinate system.

Figure 18:
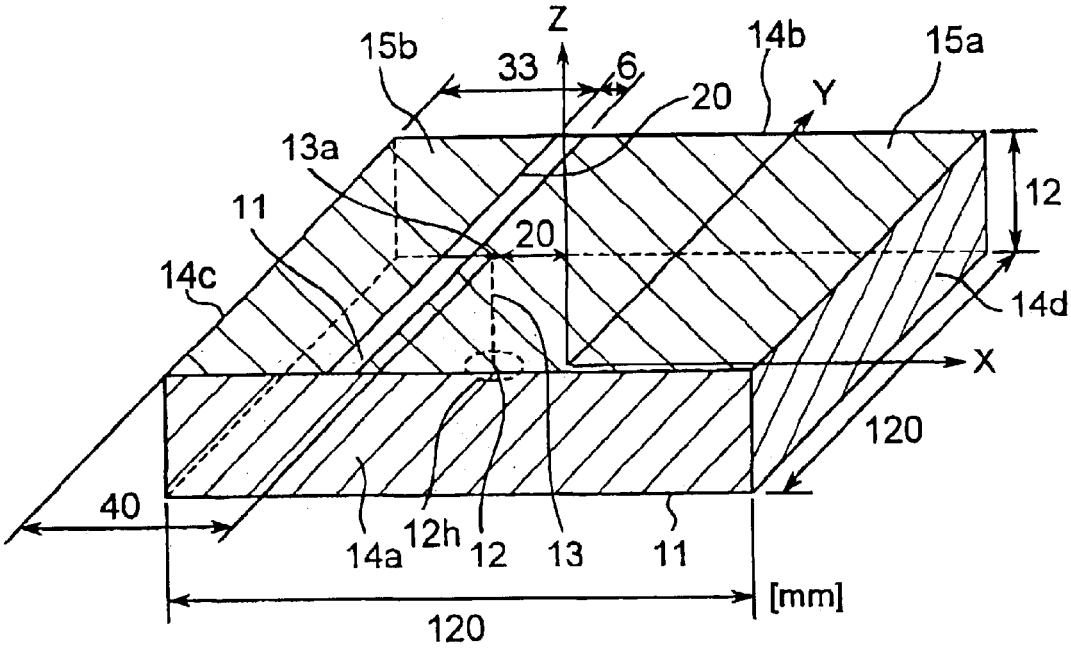
FIG. 18 is a perspective view showing a configuration of a slit radiation type waveguide antenna apparatus according to a first implemental example of the second preferred embodiment of the present invention.

FIG. 18 is a perspective view showing a configuration of a slit radiation type waveguide antenna apparatus according to the first implemental example of the second preferred embodiment of the present invention, showing a prototype waveguide antenna apparatus actually manufactured by the present inventors.

Referring to FIG. 18, the grounding conductor 11 has a square shape of a side of a length of 120 mm, and the height of the side surface conductors 14*a* and 14*b* and 14*d* is set to 12 mm. The length in the Y-direction of the ceiling conductors 15*a* and 15*b* is set to 120 mm, the width of the slit 20 is set to 6 mm, and the slit 20 has its center located apart by a length of 36 mm from the terminating conductor 14*c*. The feeding point 12 is arranged in a position located apart in the −X-direction by a length of 20 mm from the center of the grounding conductor 11.

Figure 19:
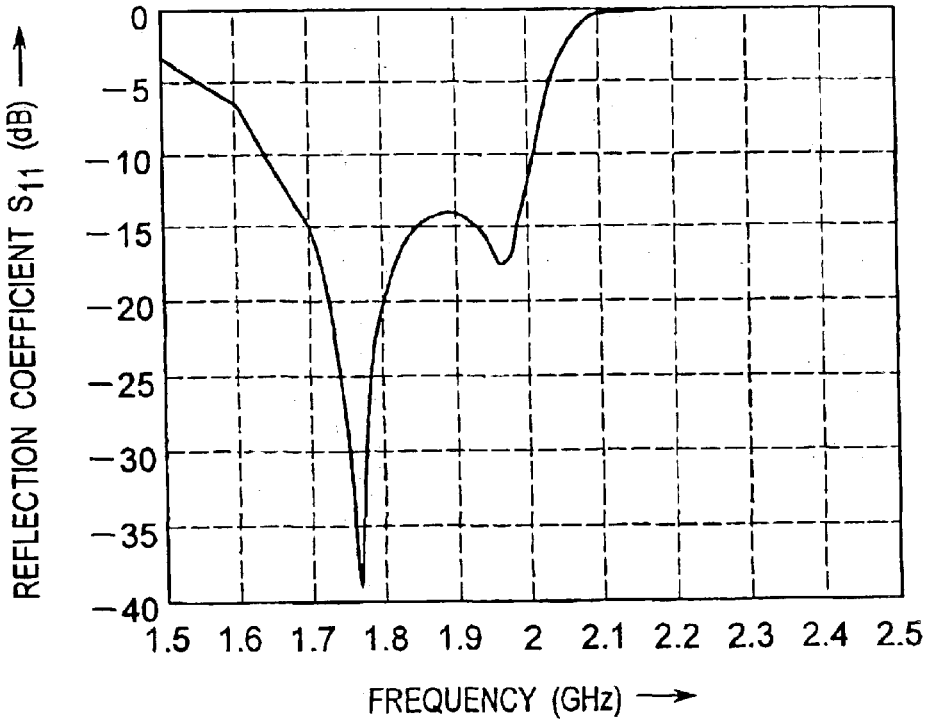
FIG. 19 is a graph showing a frequency characteristic of the reflection coefficient $S_{11}$ of the slit radiation type waveguide antenna apparatus of FIG. 18.

FIG. 19 is a graph showing a frequency characteristic of the reflection coefficient $S_{11}$ of the slit radiation type waveguide antenna apparatus of FIG. 18. As is apparent from FIG. 19, it can be understood that the waveguide antenna apparatus of the present preferred embodiment resonates at a frequency of 1.76 GHz and a satisfactory reflection characteristic is exhibited. Assuming that a range in which the reflection coefficient $S_{11}$ becomes equal to or smaller than −10 dB is the operation frequency, then the operation band ranges from 1.64 GHz to 2.02 GHz, and the operation bandwidth is 0.38 GHz. A wide-band characteristic was obtained.

Figure 20A:
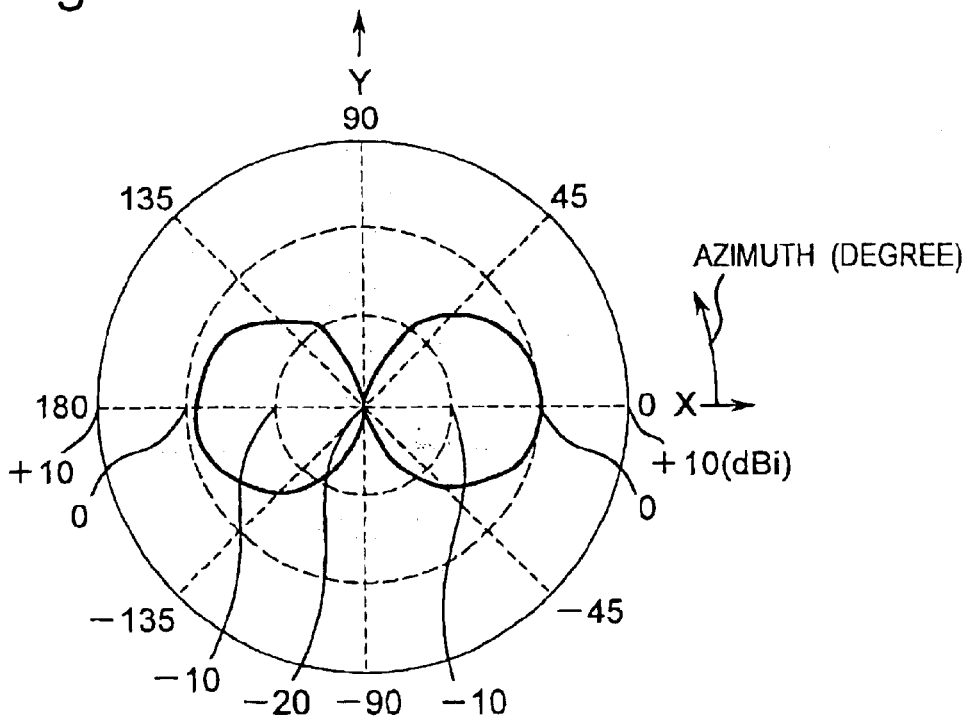
FIG. 20A is a graph showing a radiation directivity pattern on the X-Y plane of the slit radiation type waveguide antenna apparatus of FIG. 18 at a frequency of 2 GHz.
Figure 20B:
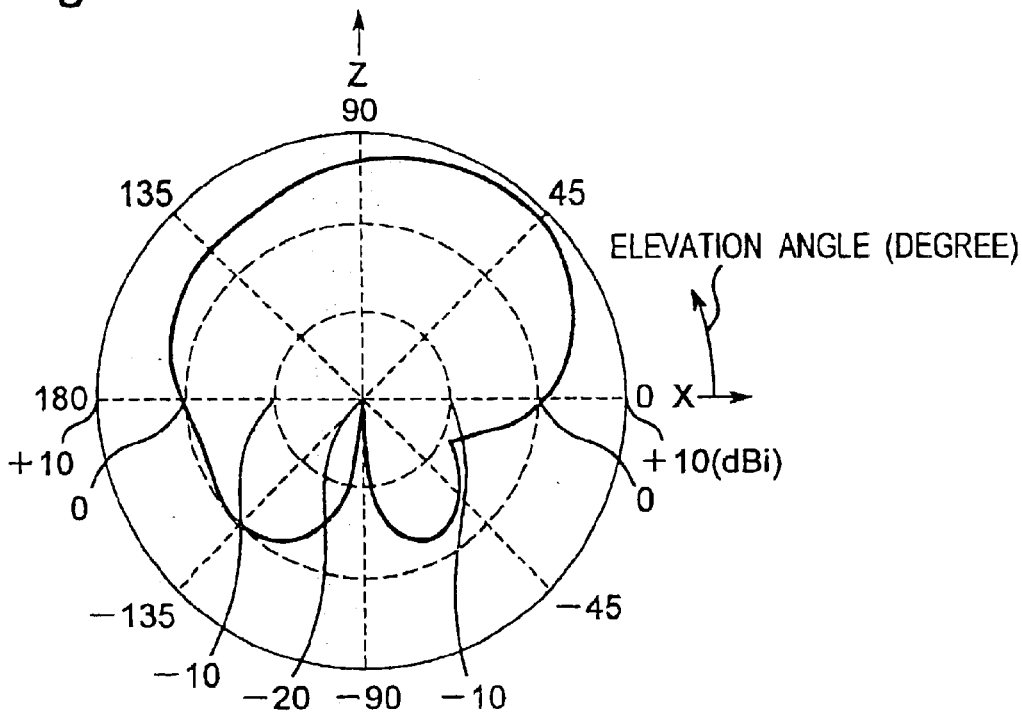
FIG. 20B is a graph showing a radiation directivity pattern on the X-Z plane of the slit radiation type waveguide antenna apparatus of FIG. 18 at a frequency of 2 GHz.

FIGS. 20A and 20B are graphs showing radiation directivity patterns of the slit radiation type waveguide antenna apparatus of FIG. 18 at a frequency of 2 GHz. FIG. 20A is a graph showing a radiation directivity pattern on the X-Y plane, and FIG. 20B is a graph showing a radiation directivity pattern on the X-Z plane.

Referring to FIGS. 20A and 20B, one interval of the scale in the radial direction representing the gain of the waveguide antenna apparatus is 10 dB, and the unit is dBi representing the relative gain with reference to the radiation power of an ideal point wave source.

As is apparent from FIG. 20B, it can be understood that the radiation of an electromagnetic wave has a directivity having a strong main beam in the +Z-direction and the +X-direction of the X-Y-Z coordinate system, and the present slit radiation type waveguide antenna apparatus achieves a directivity having a strong main beam in one direction with a simple structure. In the maximum radiation direction (i.e., beam direction) on the X-Z plane, a high gain of 7.8 dBi was obtained at an angle of about 30 degrees rotated toward the +X-direction from the Z-axis. This represents that the slit radiation type waveguide antenna apparatus is an antenna apparatus effective when installed in an end portion of a coverage area like a place near an indoor wall or window. Furthermore, the present slit radiation type waveguide antenna apparatus, which achieves a height of 0.08 wavelengths at an operation frequency of 2 GHz, is a very low-profile antenna apparatus.

In the above-mentioned preferred embodiment and the prototype, there has been described the slit radiation type waveguide antenna apparatus that has a structure symmetrical with respect to the X-Z plane. In this case, there is such an advantageous effect that the directivity pattern of the radiated electromagnetic wave from the slit radiation type waveguide antenna apparatus becomes symmetrical with respect to the −Z plane.

Figure 21A:
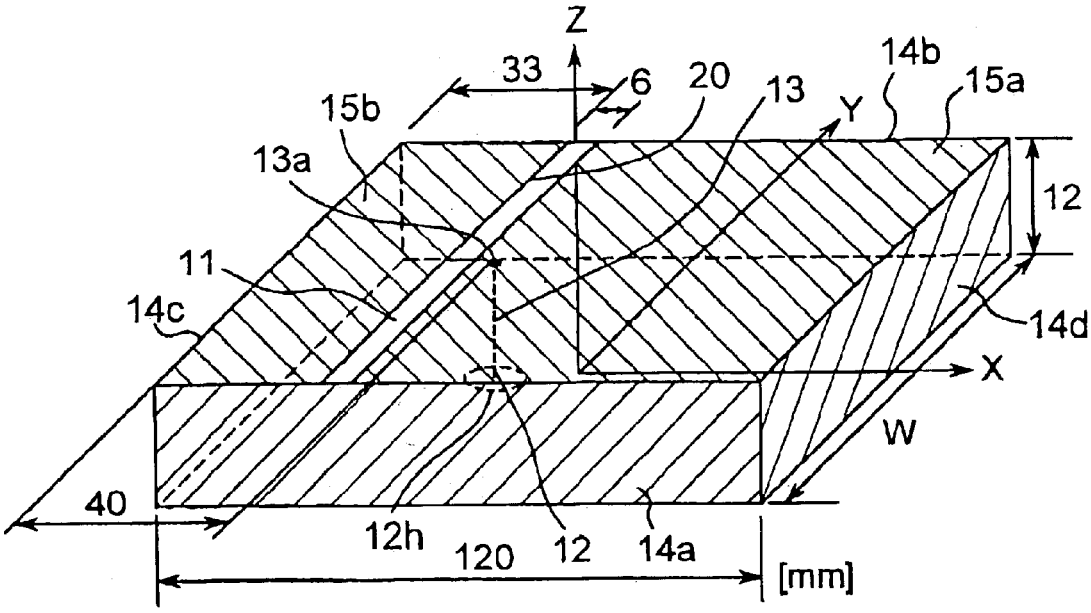
FIG. 21A is a perspective view showing a configuration of a slit radiation type waveguide antenna apparatus according to a second implemental example of the second preferred embodiment of the present invention.
Figure 21B:
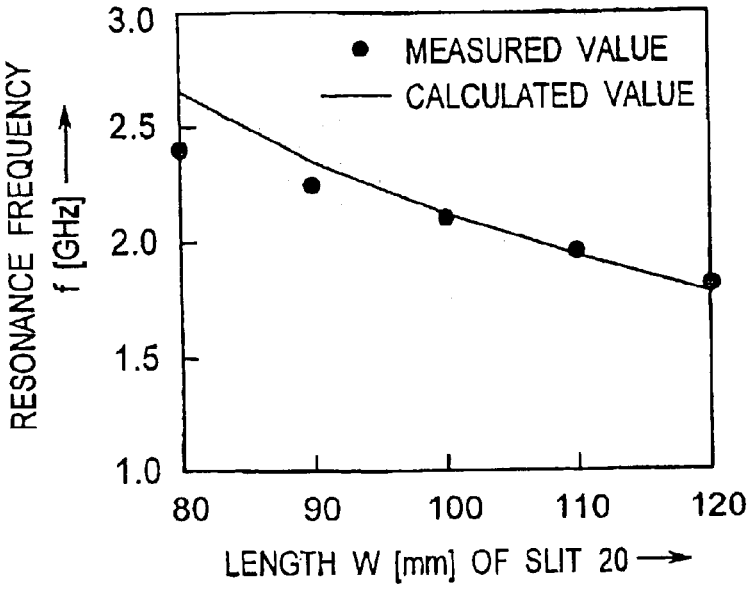
FIG. 21B is a graph showing a resonance frequency "f" of the slit radiation type waveguide antenna apparatus with respect to the length W in the Y-direction of the slit 20 of FIG. 21A.

FIG. 21A is a perspective view showing a configuration of a slit radiation type waveguide antenna apparatus according to the second implemental example of the second preferred embodiment of the present invention. FIG. 21B is a graph showing a resonance frequency "f" of the slit radiation type waveguide antenna apparatus with respect to the length W in the Y-direction of the slit 20 of FIG. 21A. The resonance frequency "f" of the slit radiation type waveguide antenna apparatus will be described below with reference to FIGS. 21A and 21B.

In the slit radiation type waveguide antenna apparatus of FIG. 21A, an electric field is distributed in the slit 20. The electric field distribution has values of zero at both ends of the slit 20 and the maximum value in the center portion on the X-axis. Therefore, the present slit radiation type waveguide antenna apparatus resonates at a frequency such that the length W of the slit 20 (i.e., the length in the Y-direction of the slit radiation type waveguide antenna apparatus, equal to the length in the Y-direction of the ceiling conductors 15*a* and 15*b*) becomes a half wavelength of the guide wavelength. The guide wavelength $\lambda g$ in the rectangular waveguide formed by including the grounding conductor 11, the side surface conductors 14*a* and 14*b*, the terminating conductors 14*c* and 14*d* and the ceiling conductors 15*a* and 15*b* is calculated by the above-mentioned Equation (1), and the resonance frequency "f" is calculated by the following equation:

$$f = \frac{c}{\sqrt{2} \cdot W}. \tag{3}$$

As is apparent from FIG. 21B, there can be obtained a calculated value very close to the measured value, and therefore, it can be understood that the resonance frequency "f" is calculated on the basis of the approximate length W of the slit 20 by using the above-mentioned Equation (3).

As described above, according to the slit radiation type waveguide antenna apparatus of the present preferred embodiment, there can be provided an antenna apparatus that keeps a compact low-profile configuration and has a directivity having a strong main beam in one direction with a simple structure.

The above-mentioned preferred embodiment has been described taking as an example the slit radiation type waveguide antenna apparatus having the structure symmetrical with respect to the X-Z plane. However, the present invention is not limited to this, and the waveguide antenna apparatus may be formed by using a structure asymmetrical with respect to the X-Z plane in order to obtain, for example, a desired radiation directivity pattern or input impedance characteristic. By adopting such a structure, it is possible to provide an antenna apparatus that has a radiation directivity pattern suitable for the objective space of radiation.

The above-mentioned preferred embodiment has been described taking as an example the slit radiation type waveguide antenna apparatus in which the antenna element 13 is made of a conductor wire. However, the present invention is not limited to this, and the antenna element 13 may be made of, for example, a plate-shaped conductor. With this arrangement, there is such a unique advantageous effect that there can be provided a high-efficiency antenna apparatus, which is able to obtain a desired input impedance characteristic and has a little reflection loss.

Figure 22:
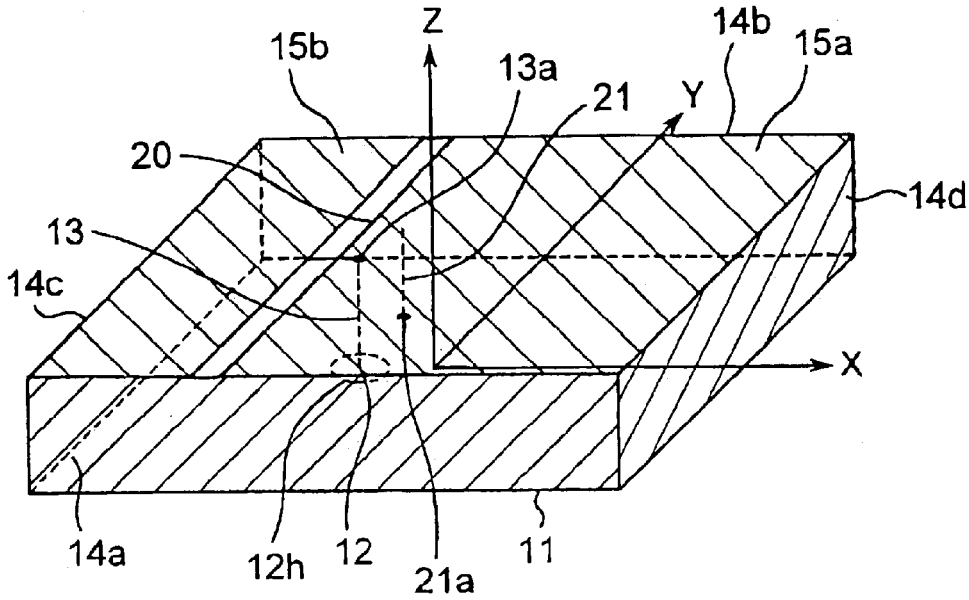
FIG. 22 is a perspective view showing a configuration of a slit radiation type waveguide antenna apparatus according to a first modified preferred embodiment of the second preferred embodiment of the present invention.

FIG. 22 is a perspective view showing a configuration of a slit radiation type waveguide antenna apparatus according to the first modified preferred embodiment of the second preferred embodiment of the present invention. The waveguide antenna apparatus of FIG. 22 is characterized in that a matching conductor 21 is provided in FIG. 22 in addition to the structure of FIG. 16 in order to obtain a desired input impedance characteristic. In this case, the matching conductor 21 made of a linear conductor is provided so as to be parallel to the antenna element 13 and to be directed in the +Y-direction from the antenna element 13. One end of the matching conductor 21 is connected with the grounding conductor 11 at a connection point 21*a* on the grounding conductor 11, and the matching conductor 21 is extended upwardly from the one end and has a length smaller than the height of the rectangular waveguide. By virtue of provision of the matching conductor 21, the impedance of the antenna can be changed so that, for example; the input impedance of the waveguide antenna apparatus substantially coincides with the characteristic impedance of the coaxial cable by changing the electric field in the vicinity of the antenna element 13 and changing the current flowing through the antenna element 13. With this arrangement, there is such a unique advantageous effect that there can be provided a high-efficiency antenna apparatus, which is able to obtain a desired input impedance characteristic and has a little reflection loss.

Figure 23:
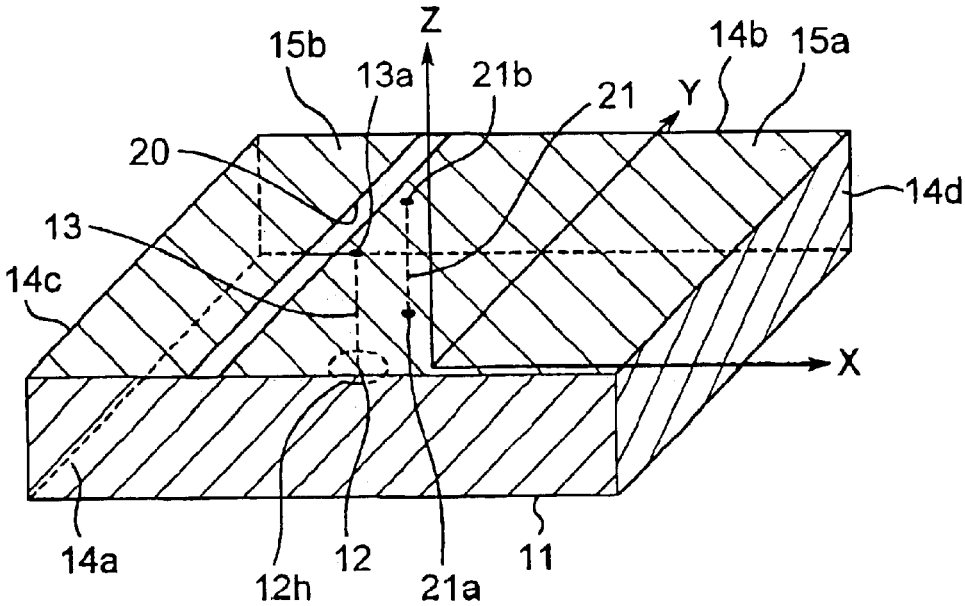
FIG. 23 is a perspective view showing a configuration of a slit radiation type waveguide antenna apparatus according to a second modified preferred embodiment of the second preferred embodiment of the present invention.

FIG. 23 is a perspective view showing a configuration of a slit radiation type waveguide antenna apparatus according to the second modified preferred embodiment of the second preferred embodiment of the present invention. As shown in FIG. 23, the waveguide antenna apparatus of FIG. 23 is characterized in that a matching conductor 21 having the same length as that of the antenna element 13 is provided so as to be parallel to the antenna element 13 on the inside of the antenna in addition to the structure of the slit radiation type waveguide antenna apparatus of FIG. 16 in order to obtain a desired impedance characteristic. One end of the matching conductor 21 is connected with the grounding conductor 11 at a connection point 21*a*, while another end of the matching conductor 21 is connected with the ceiling conductor 15 at a connection point 21*b*. It is to be noted that the connection point 21*a* of the matching conductor 21 is provided in a position similar to that of FIG. 22.

Figure 24:
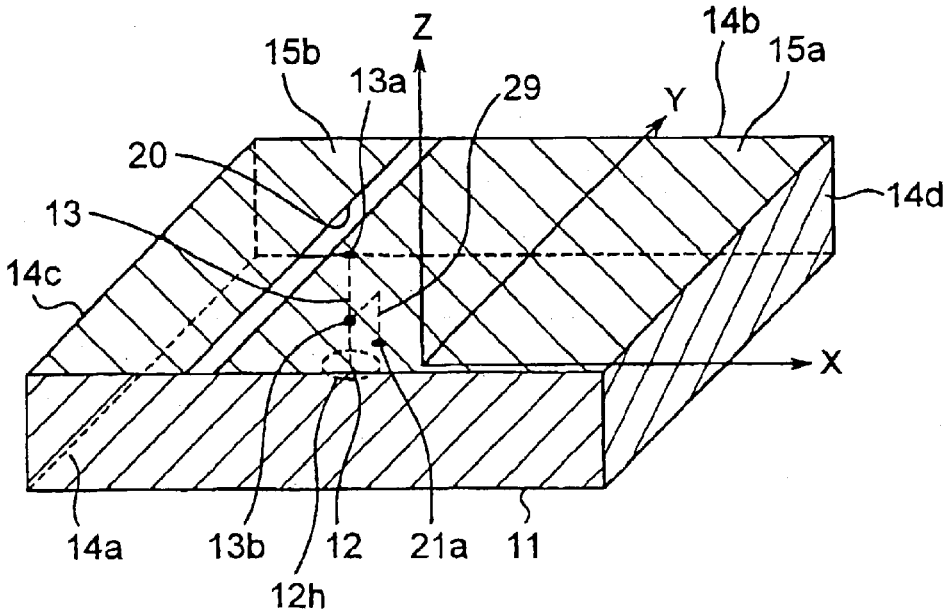
FIG. 24 is a perspective view showing a configuration of a slit radiation type waveguide antenna apparatus according to a third modified preferred embodiment of the second preferred embodiment of the present invention.

FIG. 24 is a perspective view showing a configuration of a slit radiation type waveguide antenna apparatus according to the third modified preferred embodiment of the second preferred embodiment of the present invention. As shown in FIG. 24, a matching conductor 29 may be provided on the inside of the antenna in addition to the structure of the slit radiation type waveguide antenna apparatus of FIG. 16 in order to obtain a desired impedance characteristic.

Referring to FIG. 24, the matching conductor 29 made of a linear conductor is electrically connected with the grounding conductor 11 at the connection point 21*a*, and is extended upwardly from the connection point 21*a*, then is bent substantially at a right angle and electrically connected with the approximate center portion of the antenna element 13. With this arrangement, there is such a unique advantageous effect that the impedance characteristic can be largely changed since the current flowing through the antenna element 13 can be directly changed.

Figure 25:
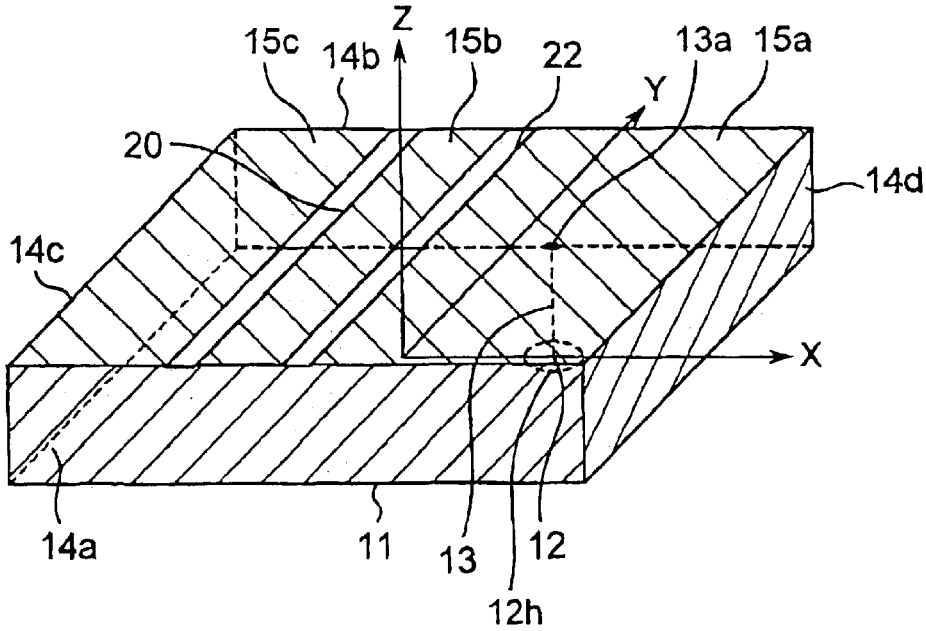
FIG. 25 is a perspective view showing a configuration of a slit radiation type waveguide antenna apparatus according to a fourth modified preferred embodiment of the second preferred embodiment of the present invention.

The above-mentioned preferred embodiment has been described taking as an example the one slit 20 provided. However, the present invention is not limited to this, and it is acceptable to provide two slits 20 and 22 in a manner similar to that of the fourth modified preferred embodiment of the second preferred embodiment shown in FIG. 25. In the present modified preferred embodiment, a slit 22 parallel to the Y-direction is provided between the ceiling conductors 15*a* and 15*b* in the antenna ceiling portion, and a slit 20 is provided between the ceiling conductors 15*b* and 15*c* so as to be parallel to the Y-direction. An antenna element 13 is located between the ceiling conductor 15*a* and the grounding conductor 11 so as to be extended parallel to the Z-direction. With this arrangement, in particular when the plurality of slits 20 and 22 exist only in one antenna ceiling portion (e.g., on the side of the −X-direction from the connection point 13*a* of the antenna element 13), by making be in phase for the phases of the electromagnetic waves radiated respectively from the slits 20 and 22 by adjustment of the interval between the slits 20 and 22, there can be provided a waveguide antenna apparatus, which has a directivity having a main beam stronger than that of the waveguide antenna apparatus provided with one slit 20. It is to be noted that the number of the slits 20 and 22 is not limited to two, and is allowed to be more than two.

The above-mentioned preferred embodiment has been described taking as an example the waveguide antenna apparatus having such a structure that the grounding conductor 11 has a shape of a square. However, the present invention is not limited to this, and in order to obtain, for example, a desired radiation directivity pattern or input impedance characteristic, the grounding conductor 11 may have a shape of rectangle, the other polygons, a semicircle or a combination of these shapes or the other shapes.

When the waveguide antenna apparatus is installed on the ceiling or the like, there is a demand for conforming the antenna apparatus configuration to the ceiling panel frame arrangement or the room configuration so that the antenna apparatus is not conspicuous. However, when the shape of the waveguide antenna apparatus is a rectangle or the other polygons, there is a restriction on the direction in which the waveguide antenna apparatus is installed since the ceiling panel frame arrangement or the room configuration is fixed. Accordingly, it is acceptable to cover the waveguide antenna apparatus with a radome 18 whose bottom surface brought in contact with the grounding conductor 11 has a shape of circle in a manner similar to that of the third implemental example of the first preferred embodiment shown in FIG. 15. With this arrangement, there are such unique advantageous effects that the characteristics of the waveguide antenna apparatus can be stabilized by preventing the entry of moisture, dust and so on which deteriorate the antenna characteristics and that the waveguide antenna apparatus can be installed without caring for the ceiling panel frame arrangement or the room configuration upon installing the waveguide antenna apparatus on the ceiling. Furthermore, when the bottom surface of the waveguide antenna apparatus has a shape of circle, it is possible to change the direction in which the waveguide antenna apparatus is set by rotating the waveguide antenna apparatus. With this arrangement, the electromagnetic wave radiation direction can be adjusted, and a radiation directivity pattern suitable for the installation position of the waveguide antenna apparatus can be obtained.

Moreover, it is acceptable to arrange a plurality of slit radiation type waveguide antenna apparatuses in an array form for the structure of a phased array antenna and an adaptive antenna array. This makes it possible to further control the directivity pattern of an electromagnetic wave that is radiated from the waveguide antenna apparatus.

Figure 26:
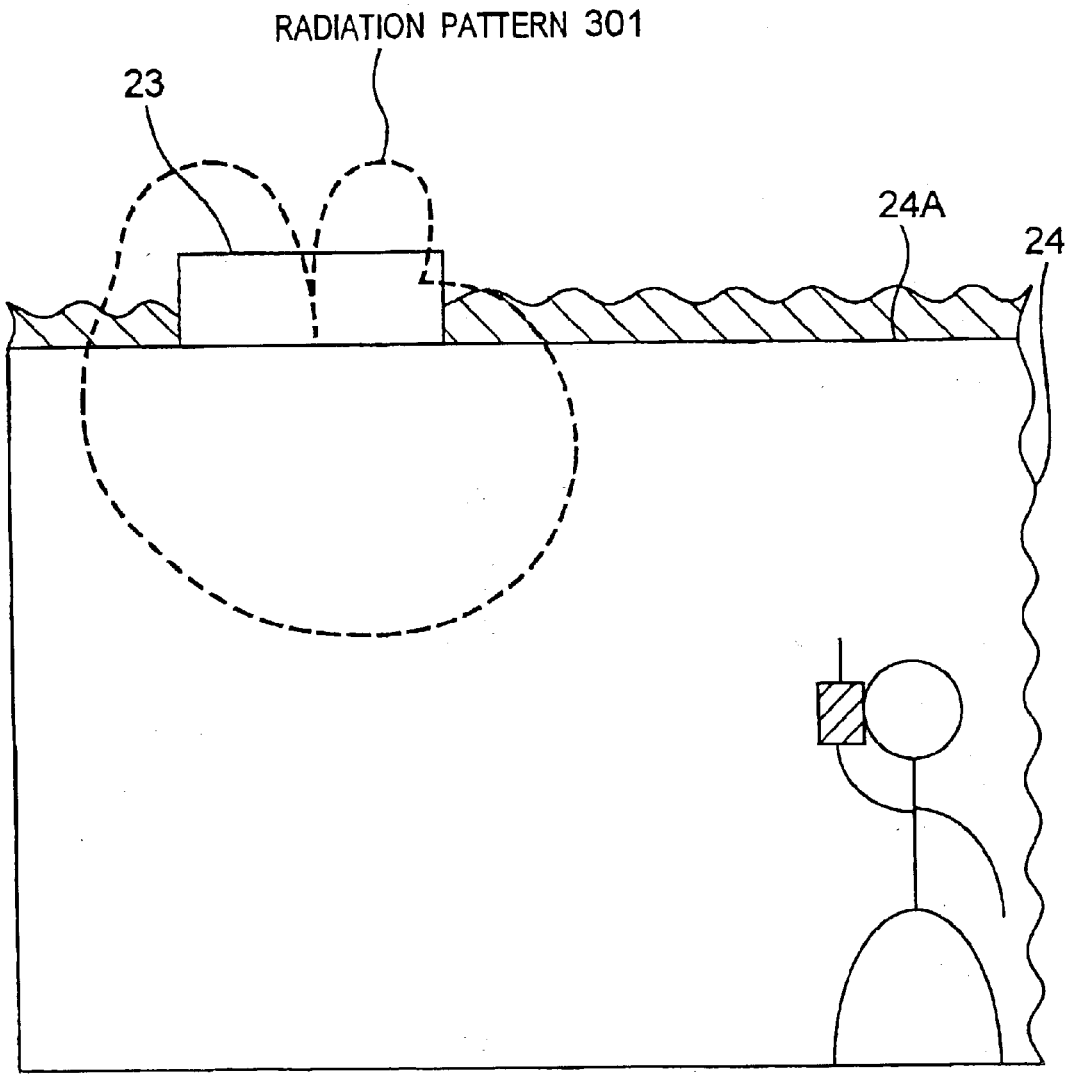
FIG. 26 is a view showing a state of arrangement of a slit radiation type waveguide antenna apparatus according to a third implemental example of the second preferred embodiment of the present invention.
Figure 27:
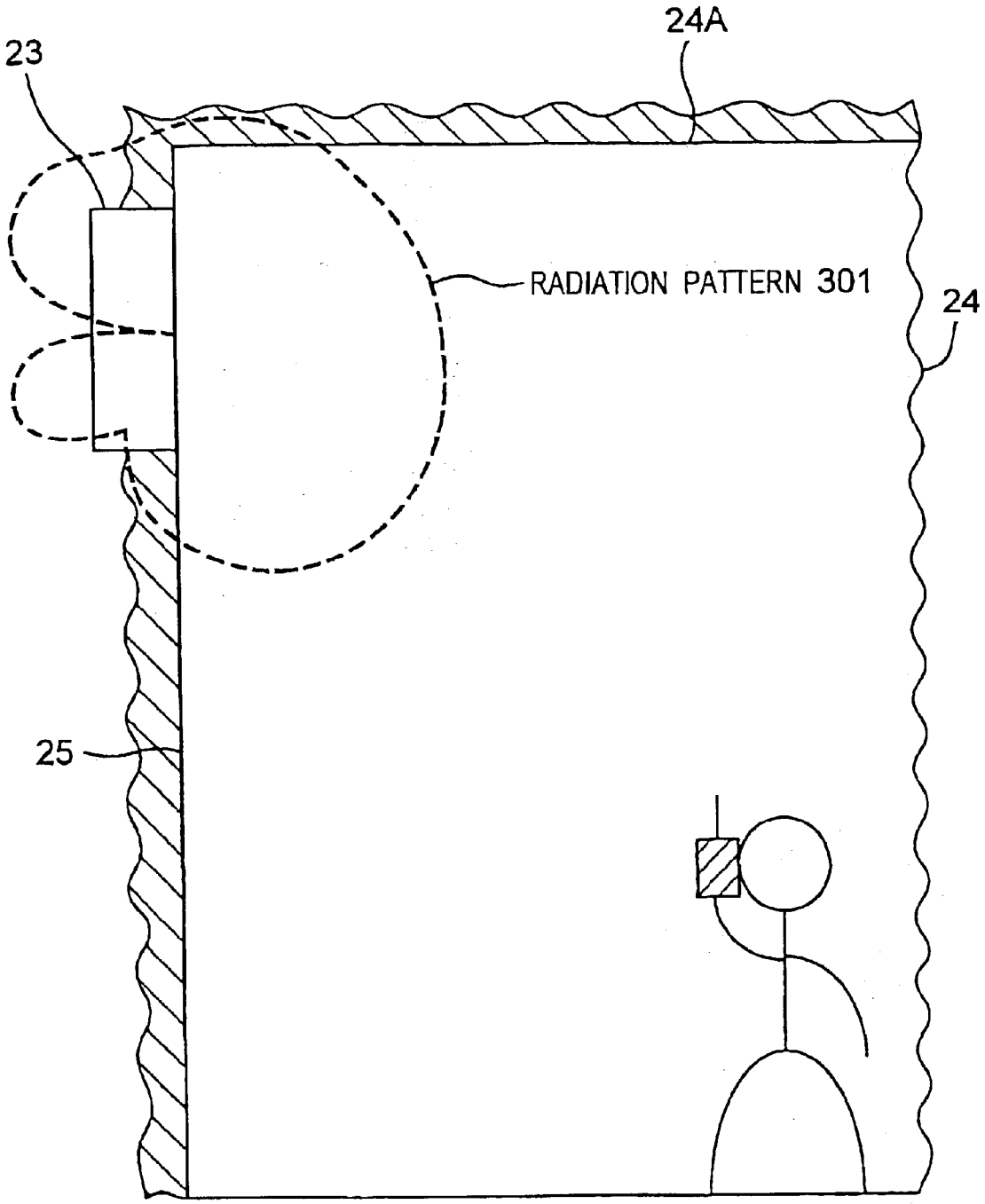
FIG. 27 is a view showing a state of arrangement of a slit radiation type waveguide antenna apparatus according to a fourth implemental example of the second preferred embodiment of the present invention.

Moreover, since the slit radiation type waveguide antenna apparatus is entirely covered with a conductor, the waveguide antenna apparatus receives less influence from the environment around the waveguide antenna apparatus. Therefore, when the present slit radiation type waveguide antenna apparatus 23 is used in a room 24, it is acceptable to embed the apparatus in a ceiling 24A in a manner similar to that of the third implemental example shown in FIG. 26 of the second preferred embodiment or to embed the apparatus in a wall 25 near the ceiling 24A in a manner similar to that of the fourth implemental example shown in FIG. 27 of the second preferred embodiment. Even if the waveguide antenna apparatus 23 is installed in this manner, a directivity having a strong main beam is maintained in one direction. Therefore, by arranging the slit radiation type waveguide antenna apparatus 23 as shown in FIGS. 26 and 27, a radiation characteristic 301 of a coverage area wider than that of the other arrangement can be obtained. By arranging the waveguide antenna apparatus of the other preferred embodiment as shown in FIG. 26 or 27, a coverage area wider than that of the other arrangement can be obtained. Furthermore, by embedding the waveguide antenna apparatus in the ceiling 24A or the wall 25, there is such a unique advantageous effect that the apparatus attracts less human attention and does not become obstructive.

Third Preferred Embodiment

Figure 28:
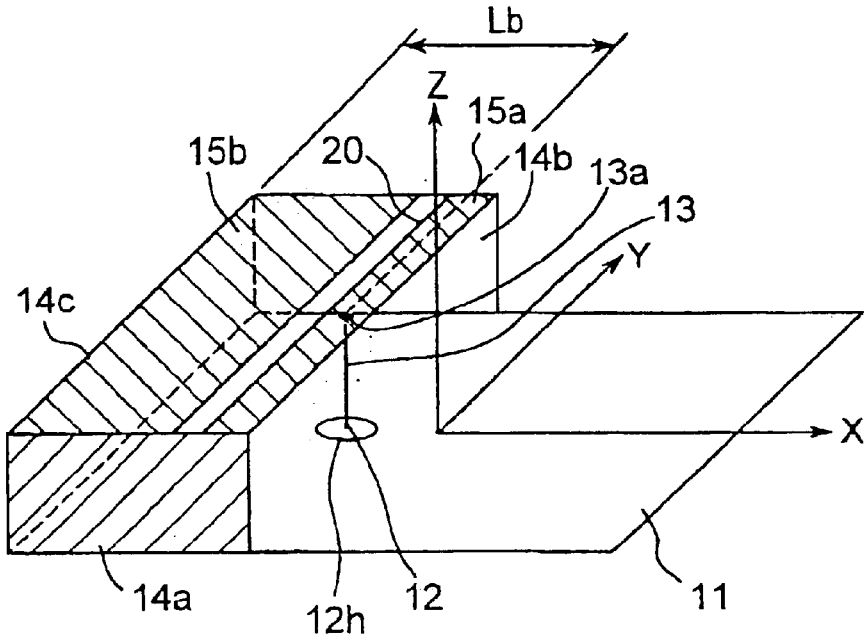
FIG. 28 is a perspective view showing a configuration of an open-ended waveguide antenna apparatus with a slit 20 according to a third preferred embodiment of the present invention.

FIG. 28 is a perspective view showing a configuration of an open-ended waveguide antenna apparatus with a slit 20 according to the third preferred embodiment of the present invention.

Referring to FIG. 28, the open-ended waveguide antenna apparatus with the slit 20 is different from the open-ended waveguide antenna apparatus of FIG. 1 in the following points:

(1) In the antenna ceiling portion, one slit 20, which has a longitudinal direction parallel to the Y-axis and has a width sufficiently smaller than a quarter wavelength of the guide wavelength, is provided between the ceiling conductors 15*a* and 15*b*. The ceiling conductor 15*a* is located on the side of the opened end of the waveguide, and the ceiling conductor 15*b* is located on the side of the short-circuited end of the waveguide with interposition of the slit 20.

(2) The side conductor 14*a* has a length smaller than that of the side surface conductor 14*a* of FIG. 1 and has the same length as that of the ceiling conductor 15 in the X-direction, and the side surface conductor 14*a* has a length smaller than that of the side surface conductor 14*b* of FIG. 1 and has the same length as that of the ceiling conductor 15 in the X-direction.

The antenna element 13 is provided in a position located a predetermined length Lb apart from the terminating conductor 14*c* in a manner similar to that of the antenna element 13 of FIG. 1. Therefore, the grounding conductor 11 is formed so as to be extended in the +X-direction while projecting from the ceiling conductor 15*a* and the side surface conductors 14*a* and 14*b*.

Figure 29:
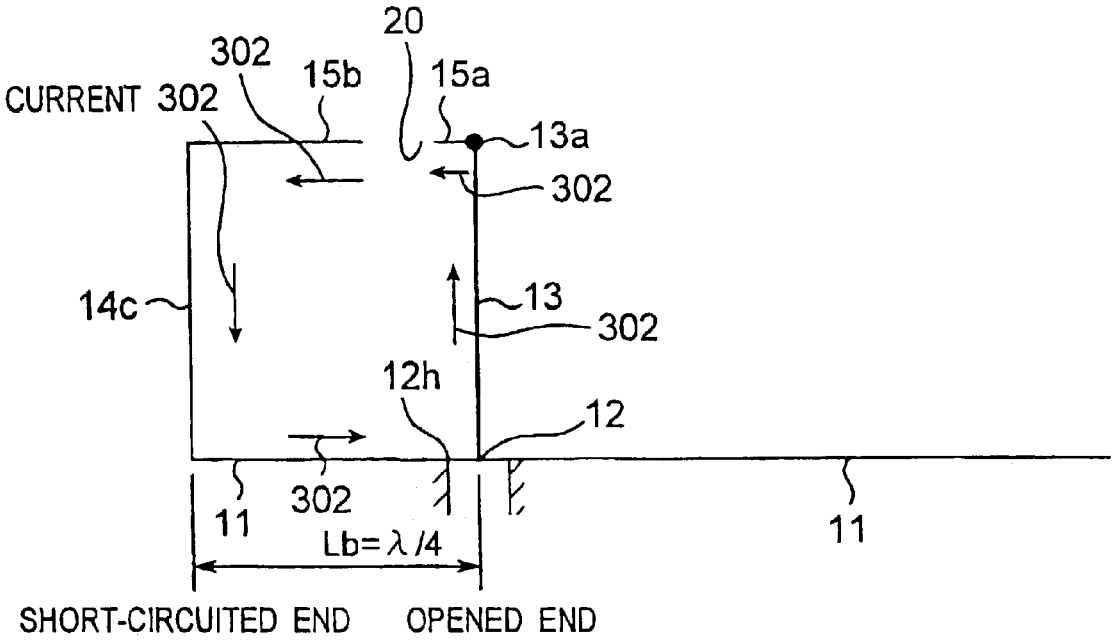
FIG. 29 is a sectional view taken along the X-Z plane of the open-ended waveguide antenna apparatus with the slit 20, showing a current distribution of the open-ended waveguide antenna apparatus with the slit 20 of FIG. 28.
Figure 30A:
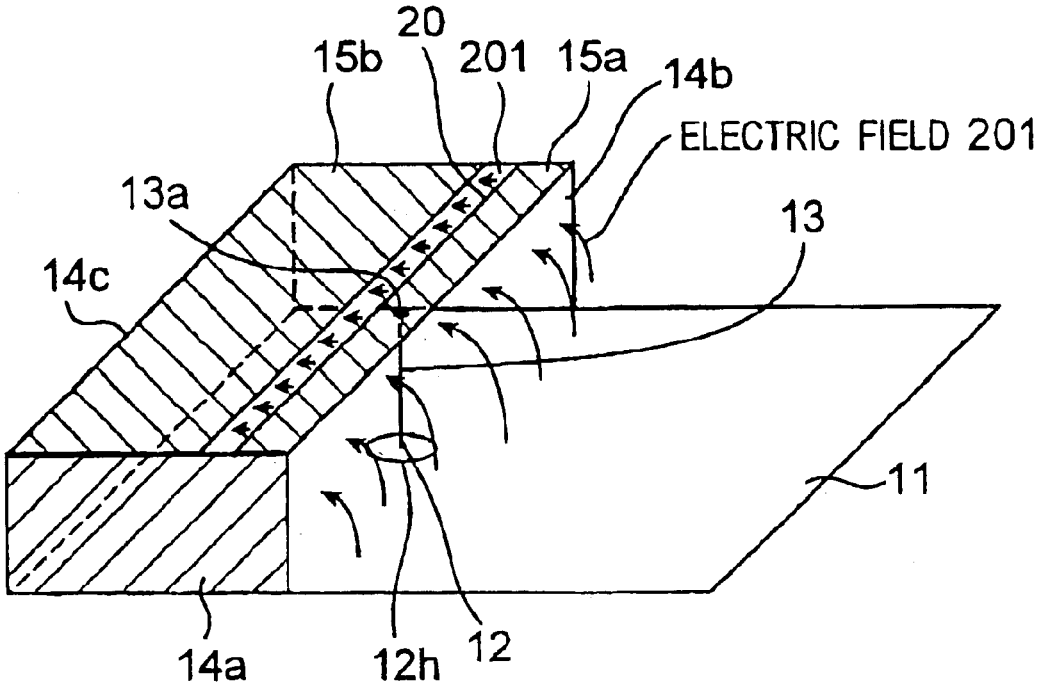
FIG. 30A is a perspective view showing an electric field distribution of the open-ended waveguide antenna apparatus with the slit 20 of FIG. 28.

The operation of the open-ended waveguide antenna apparatus with the slit 20 will be described next with reference to FIGS. 29 and 30. FIG. 29 is a sectional view taken along the X-Z plane of the open-ended waveguide antenna apparatus with the slit 20, showing a current distribution of the open-ended waveguide antenna apparatus with the slit 20 of FIG. 28. FIG. 30A is a perspective view showing an electric field distribution of the open-ended waveguide antenna apparatus with the slit 20 of FIG. 28, and FIG. 30B is a perspective view showing a magnetic current distribution of the open-ended waveguide antenna apparatus with the slit 20 of FIG. 28.

In the present preferred embodiment, an electromagnetic wave is radiated by the excitation of the antenna element 13, and the electromagnetic wave is radiated by the electric field generated between the ceiling conductors 15*a* and 15*b* and the grounding conductor 11 and the electric field generated in the slit 20. The electric field generated between the ceiling conductors 15*a* and 15*b* and the grounding conductor 11 by the antenna element 13 is shown in FIG. 30A in a manner similar to that of FIG. 2A in the case of the open-ended waveguide antenna apparatus of the first preferred embodiment. Moreover, the electric field generated in the slit 20 is shown in FIG. 30A in a manner similar to that of the slit open-ended waveguide antenna apparatus of the second preferred embodiment.

As shown in FIG. 29, a current 302 flows from the feeding point 12 along the antenna element 13, flows toward the terminating conductor 14*c* via the ceiling conductor 15*a*, the slit 20 and the ceiling conductor 15*b*, and then returns to the feeding portion 12 flowing from the terminating conductor 14*c* to the grounding conductor 11.

Referring to FIG. 29, the length Lb from the terminating conductor 14*c* to the antenna element 13 is set to a quarter wavelength of the guide wavelength or a length of an odd multiple of the length. Therefore, the electric field distribution generated in the present open-ended waveguide antenna apparatus with the slit 20 becomes as shown in FIG. 30A, where the direction of the electric field 201 generated between the ceiling conductors 15*a* and 15*b* and the grounding conductor 11 coincides with the direction of the electric field 201 generated in the slit 20. That is, the slit 20 has an advantageous effect of making be in phase for the phases of the electromagnetic waves respectively that are radiated from the waveguide antenna apparatus.

Figure 30B:
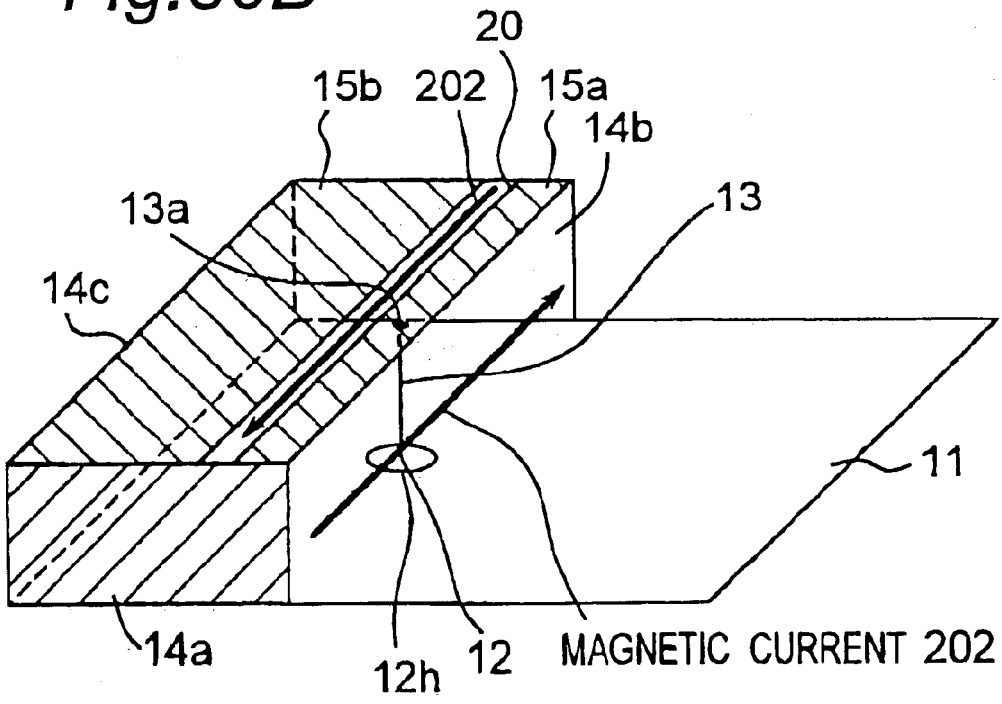
FIG. 30B is a perspective view showing a magnetic current distribution of the open-ended waveguide antenna apparatus with the slit 20 of FIG. 28.

Explaining the operation thereof by replacing the electric field 201 with a magnetic current 202, the electric field 201 can be replaced with a linear magnetic current source parallel to the Y-direction, as shown in FIG. 30B. That is, the radiation of the electromagnetic wave can be regarded as radiation due to these magnetic current sources. Therefore, the directivity pattern of the present open-ended waveguide antenna apparatus with the slit 20 is obtained as an array of in-phase excitation by these two magnetic currents 202. The directivity pattern due to the electric field 201 generated between the ceiling conductors 15*a* and 15*b* and the grounding conductor 11 is similar to that of the open-ended waveguide antenna apparatus of the first preferred embodiment, and then a directivity having a strong main beam can be obtained in the +Z-direction and the +X-direction of the X-Y-Z coordinate system. Moreover, the directivity pattern due to the electric field 201 generated in the slit 20 is similar to that of the slit open-ended waveguide antenna apparatus of the second preferred embodiment, and a directivity having a strong main beam can be obtained in the +Z-direction and the +X-direction of the X-Y-Z coordinate system. Therefore, the open-ended waveguide antenna apparatus with the slit 20 of the present preferred embodiment becomes an in-phase array of these two directivity patterns, and therefore, a diversity having an extremely strong main beam can be obtained in the +Z-direction and the +X-direction of the X-Y-Z coordinate system.

Figure 31:
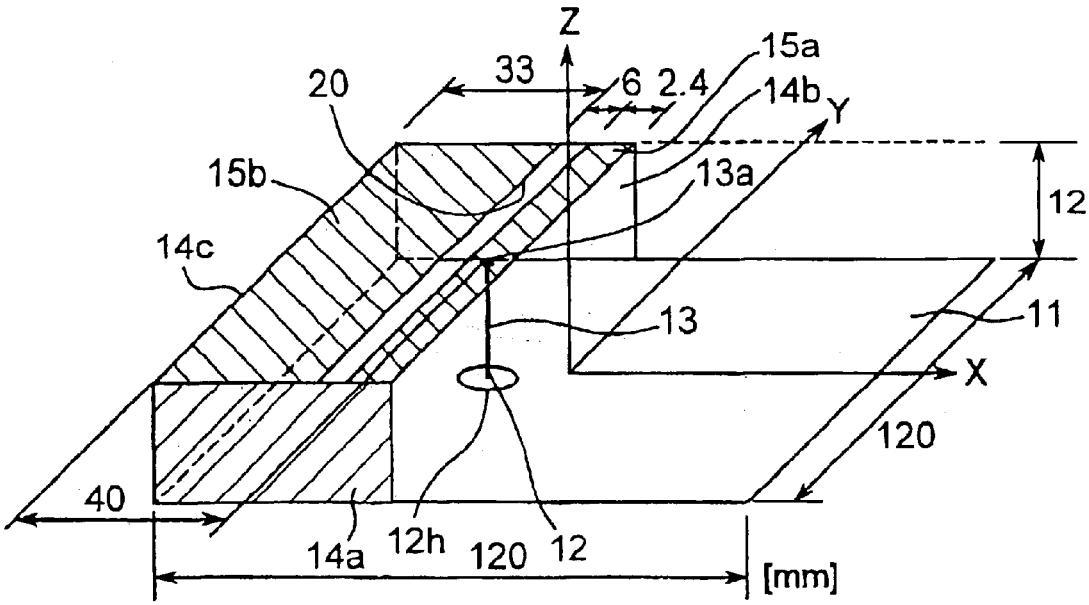
FIG. 31 is a perspective view showing a configuration of an open-ended waveguide antenna apparatus with the slit 20 according to an implemental example of the third preferred embodiment of the present invention.

FIG. 31 is a perspective view showing a configuration of an open-ended waveguide antenna apparatus with the slit 20 according to an implemental example of the third preferred embodiment of the present invention, showing a prototype open-ended waveguide antenna apparatus with the slit 20 actually manufactured by the present inventors.

Referring to FIG. 31, a grounding conductor 11 has a square shape of a side length of 120 mm, and the height of side surface conductors 14*a* and 14*b* and a terminating conductor 14*c* is set to 12 mm. The length in the X-direction of the ceiling conductors 15*a* and 15*b* is set to 41 mm, and the width of the slit 20 is set to 6 mm. The center of the slit 20 is in a position located apart by a length of 36 mm from the terminating conductor 14*c*. It is to be noted that the feeding point 12 is arranged in a position located apart by a length of 20 mm in the −X-direction on the X-axis from the center of the grounding conductor 11.

Figure 32:
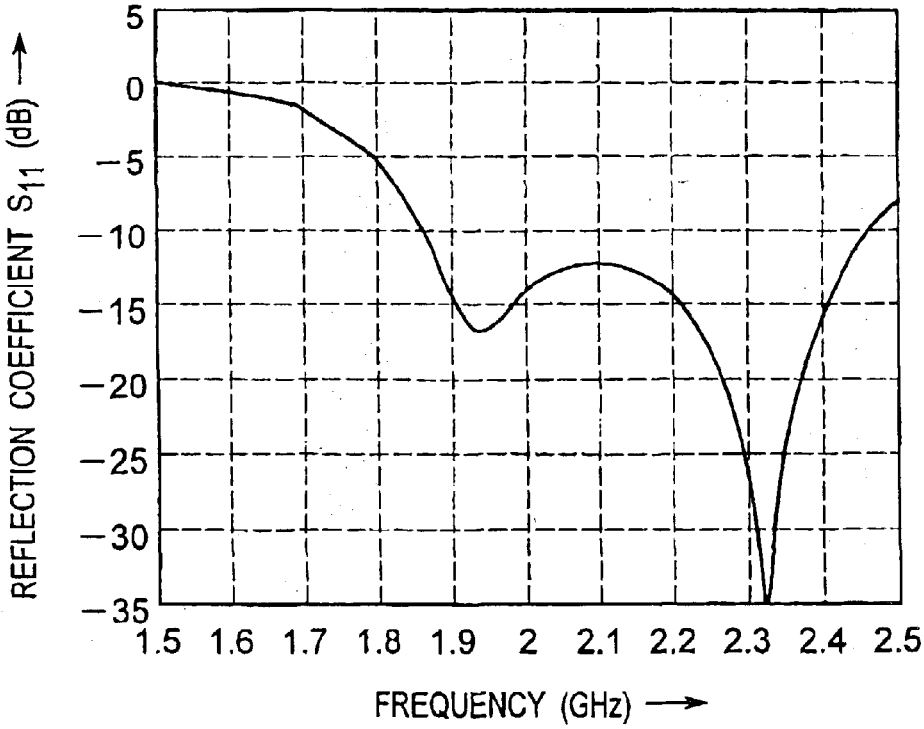
FIG. 32 is a graph showing a frequency characteristic of the reflection coefficient $S_{11}$ of the open-ended waveguide antenna apparatus with the slit 20 of FIG. 31.

FIG. 32 is a graph showing a frequency characteristic of the reflection coefficient $S_{11}$ of the open-ended waveguide antenna apparatus with the slit 20 of FIG. 31. As is apparent from FIG. 32, it can be understood that the resonance occurs at the two frequencies of 1.9 GHz and 2.3 GHz, exhibiting a satisfactory reflection characteristic over a wide band. If the operation frequency is used in a range in which the reflection coefficient $S_{11}$ becomes equal to or smaller than −10 dB, then the operation band ranges from 1.86 to 2.46 GHz, and the operation bandwidth is 0.6 GHz. A very wide band characteristic having a fractional band width of 28% was obtained.

Figure 33A:
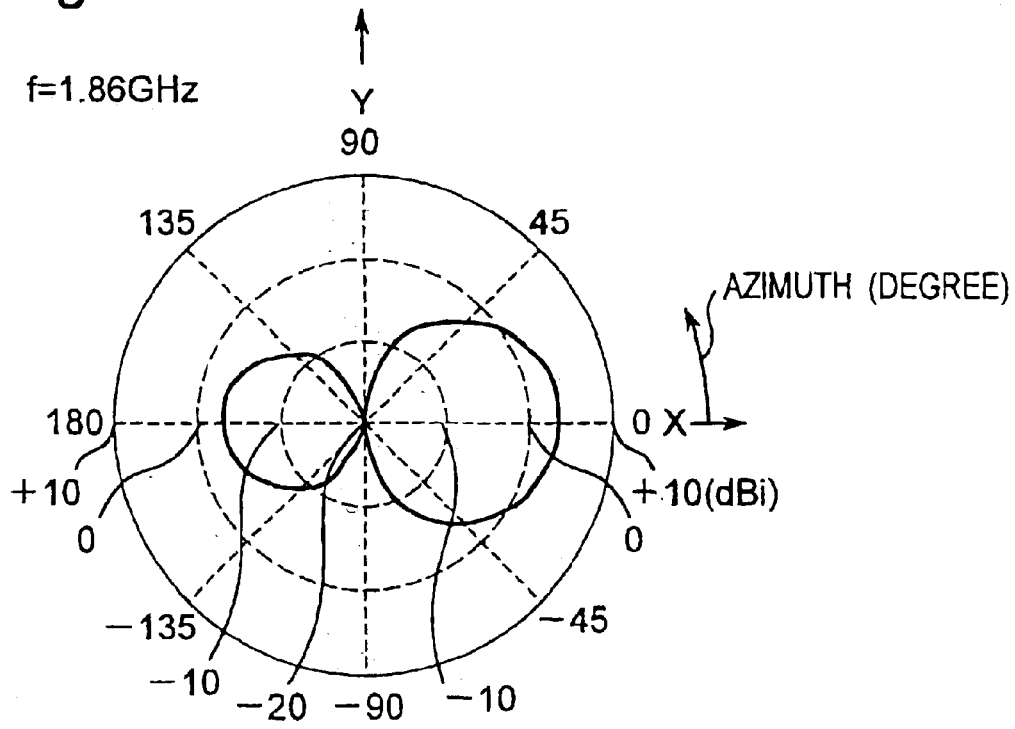
FIG. 33A is a graph showing a radiation directivity pattern on the X-Y plane of the open-ended waveguide antenna apparatus with the slit 20 of FIG. 31 at an operation frequency "f" of 1.86 GHz.
Figure 33B:
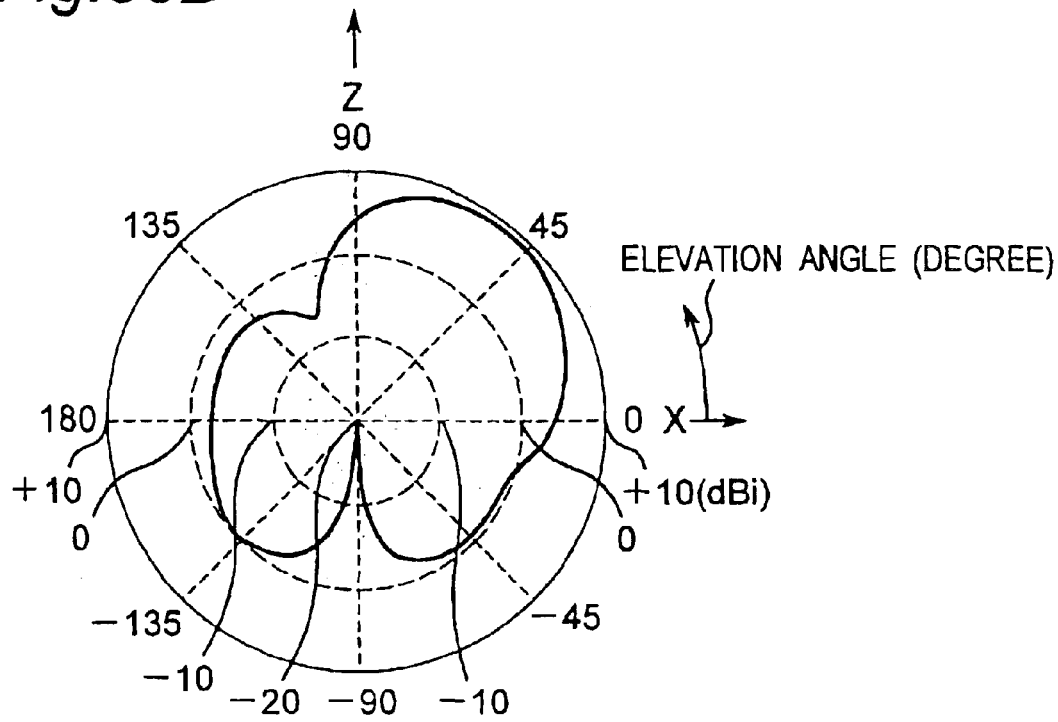
FIG. 33B is a graph showing a radiation directivity pattern on the X-Z plane of the open-ended waveguide antenna apparatus with the slit 20 of FIG. 31 at an operation frequency "f" of 1.86 GHz.

FIGS. 33A and 33B are graphs showing radiation directivity patterns when the operation frequency "f" of the open-ended waveguide antenna apparatus with the slit 20 of FIG. 31 is set to 1.86 GHz. FIG. 33A is a graph showing a radiation directivity pattern on the X-Y plane, and FIG. 33B is a graph showing a radiation directivity pattern on the X-Z plane. In this case, with regard to the scale in the radial direction representing the gain of the waveguide antenna apparatus, one interval represents 10 dB, and the unit is dBi of the relative gain with reference to the radiation power of the ideal point wave source. In a manner similar to above, FIGS. 34A and 34B are graphs showing radiation directivity patterns when the operation frequency "f" is set to 2.0 GHz, and FIGS. 35A and 35B are graphs showing radiation directivity patterns when the operation frequency "f" is set to 2.46 GHz.

Figure 34A:
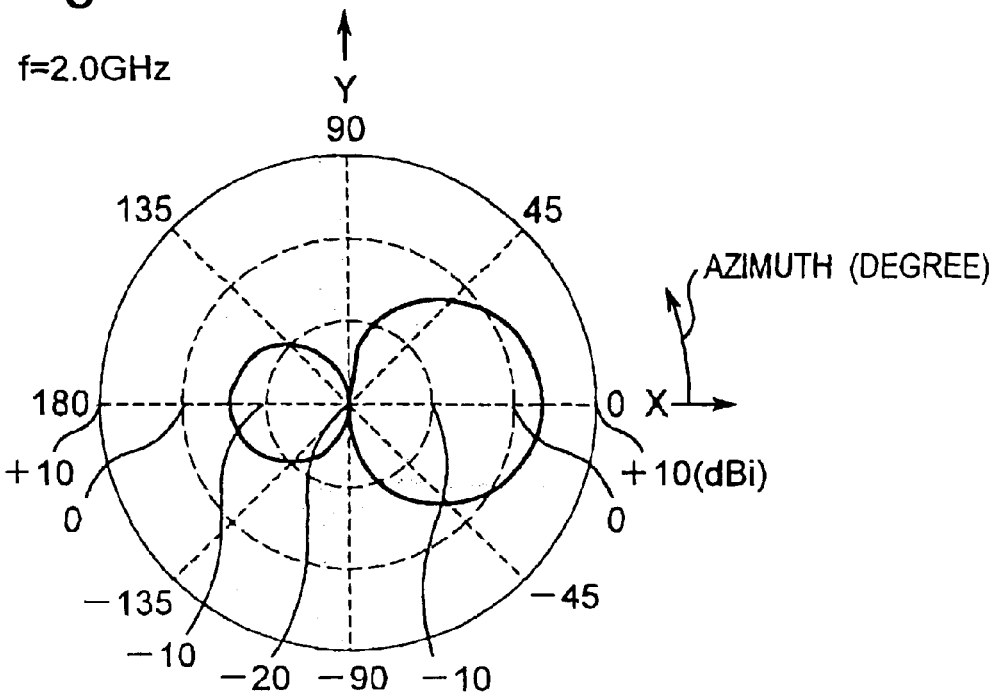
FIG. 34A is a graph showing a radiation directivity pattern on the X-Y plane of the open-ended waveguide antenna apparatus with the slit 20 of FIG. 31 at an operation frequency "f" of 2.0 GHz.
Figure 34B:
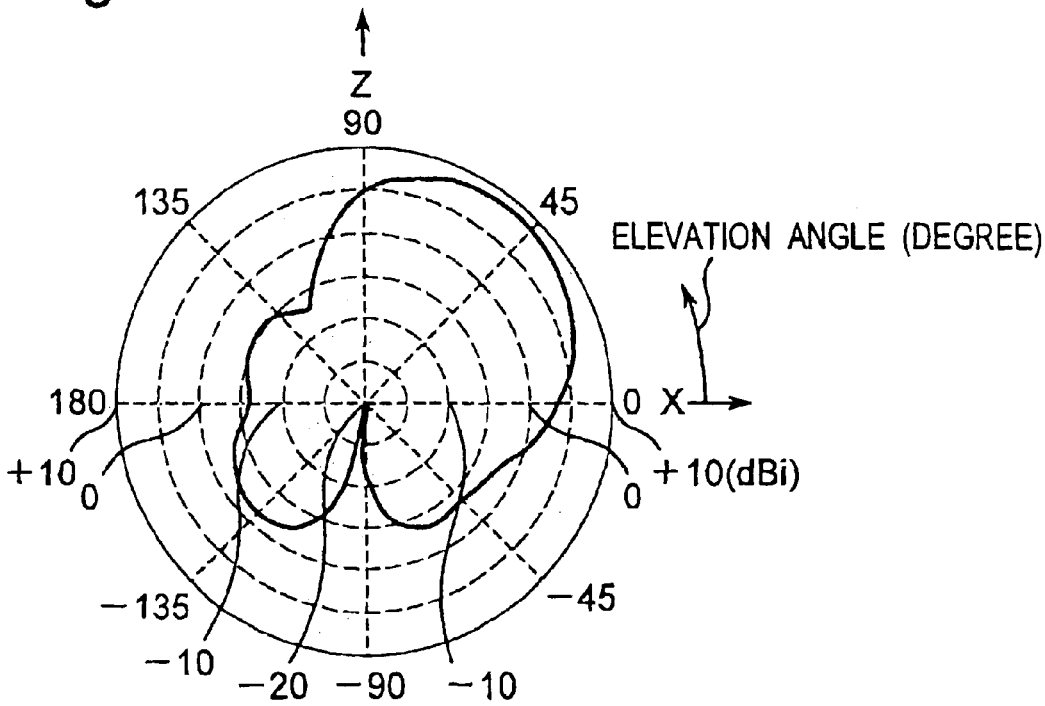
FIG. 34B is a graph showing a radiation directivity pattern on the X-Z plane of the open-ended waveguide antenna apparatus with the slit 20 of FIG. 31 at an operation frequency "f" of 2.0 GHz.
Figure 35A:
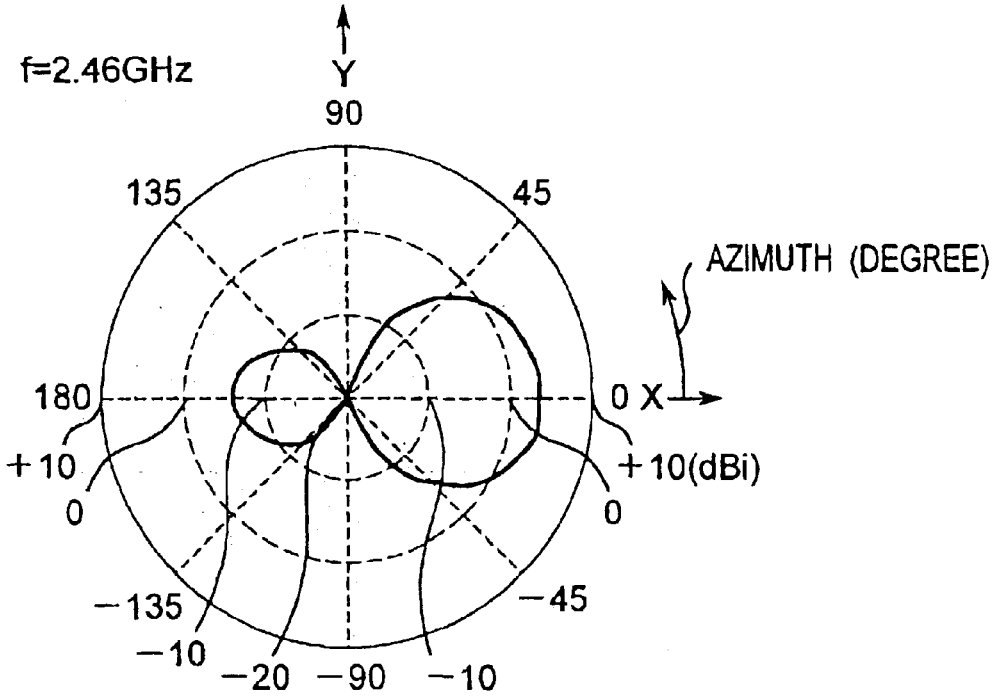
FIG. 35A is a graph showing a radiation directivity pattern on the X-Y plane of the open-ended waveguide antenna apparatus with the slit 20 of FIG. 31 at an operation frequency "f" of 2.46 GHz.
Figure 35B:
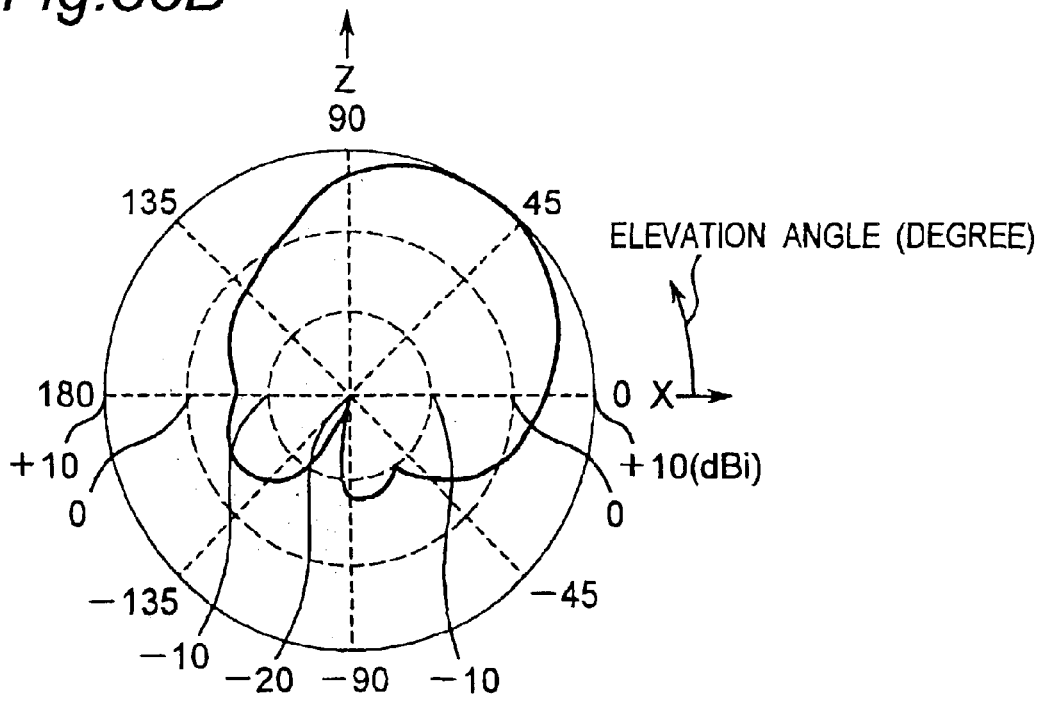
FIG. 35B is a graph showing a radiation directivity pattern on the X-Z plane of the open-ended waveguide antenna apparatus with the slit 20 of FIG. 31 at an operation frequency "f" of 2.46 GHz.

Explanation is provided taking as an example the directivity pattern when "f"=2.0 GHz shown in FIGS. 34A and 34B. As is apparent from FIG. 34B, it can be understood that the electromagnetic wave radiation has a directivity having a strong main beam in the +Z-direction and the +X-direction of the X-Y-Z coordinate system, and the present open-ended waveguide antenna apparatus with the slit 20 attains a directivity having a strong main beam in one direction with a simple structure. In the maximum radiation direction (i.e., beam direction) on the X-Z plane, a high gain of 9.0 dBi can be obtained at an angle of about 35 degrees rotated from the Z-axis toward the +X-direction. Moreover, as apparent from FIG. 34A, it could be understood that a particularly high gain of 4.2 dBi was obtained in the +X-direction on the X-axis also on the X-Y plane. With this arrangement, it can be said that the open-ended waveguide antenna apparatus with the slit 20 can be used effectively when being installed at an end of a coverage area such as a place near an indoor wall or window.

Furthermore, as apparent from FIGS. 33A, 33B, 34A, 34B, 35A and 35B, it can be understood that a directivity having a strong main beam is exhibited in the +Z-direction and the +X-direction of the X-Y-Z coordinate system in the operation frequency band of specified impedance, and a directivity having a strong main beam in one direction is attained over a wide band. Furthermore, the present open-ended waveguide antenna apparatus with the slit 20 attains a height of 0.08 wavelengths at an operation frequency of 2.1 GHz, and it is a very low-profile antenna apparatus.

In the above-mentioned preferred embodiment and prototype, there has been described the open-ended waveguide antenna apparatus with the slit 20 having a structure symmetrical with respect to the X-Z plane. In this case, there is such a unique advantageous effect that the directivity pattern of the radiated electromagnetic wave from the waveguide antenna apparatus becomes symmetrical with respect to the X-Z plane.

As described above, according to the open-ended waveguide antenna apparatus with the slit 20 of the present preferred embodiment, there can be provided an antenna apparatus, which keeps a compact low-profile configuration and has a directivity having a strong main beam in one direction and a wide band characteristic with a simple structure.

The above-mentioned preferred embodiment has been described taking as an example the open-ended waveguide antenna apparatus with the slit 20 symmetrical with respect to the X-Z plane. However, the present invention is not limited to this, and it is acceptable to form a structure asymmetrical with respect to the X-Z plane in order to obtain a desired radiation directivity pattern or input impedance characteristic. By adopting such a structure, it is possible to provide an antenna apparatus that has a radiation directivity pattern suitable for the objective space of radiation.

The above-mentioned preferred embodiment has been described taking the case of one slit 20 provided as an example. However, the present invention is not limited to this, and two or more slits may be provided. By making be in phase for the phases of the electromagnetic waves radiated respectively from these slits, there can be attained a directivity having a main beam stronger than that when one slit is provided.

The above-mentioned preferred embodiment has the structure in which the length in the X-direction of the side surface conductors 14*a* and 14*b* is made to be equal to the length in the X-direction of the antenna ceiling portion (including the ceiling conductors 15*a* and 15*b* and the slit 20). However, the length in the X-direction of the side surface conductors 14*a* and 14*b* may be equal to the length in the X-direction of the grounding conductor 11 in a manner to similar to that of the first preferred embodiment. On the other hand, it is acceptable to make the length in the X-direction of the side surface conductors 14*a* and 14*b* equal to the length in the X-direction of the ceiling conductor 15 in the first preferred embodiment.

The above-mentioned preferred embodiment has been described taking as an example the open-ended waveguide antenna apparatus with the slit 20 of which the antenna element 13 is made of a conductor wire. However, the present invention is not limited to this, and the antenna element 13 may be made of, for example, a plate-shaped conductor. With this arrangement, there is such a unique advantageous effect that there can be provided a high-efficiency antenna apparatus, which is able to obtain a desired input impedance characteristic and has a little reflection loss.

Figure 36:
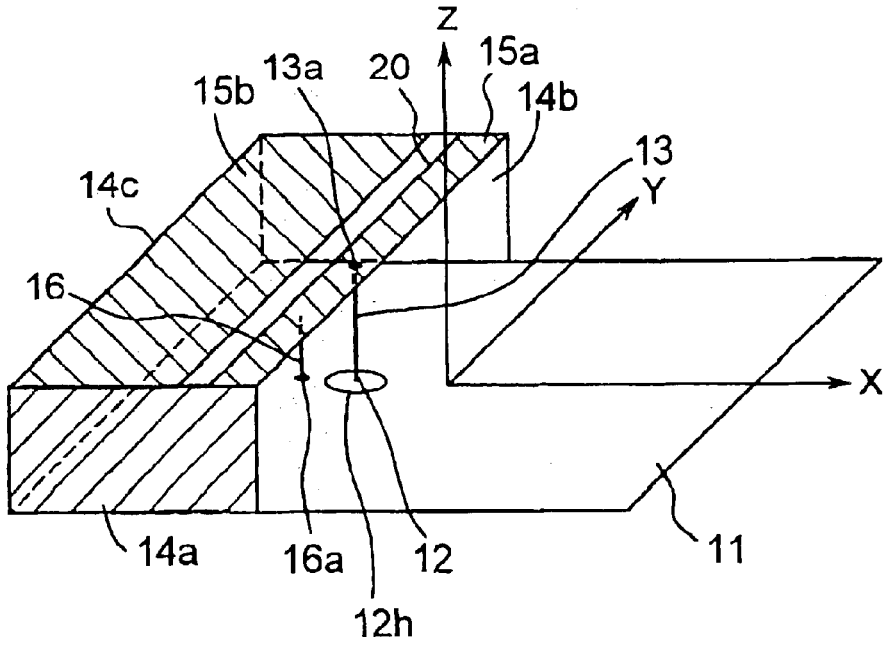
FIG. 36 is a perspective view showing a configuration of an open-ended waveguide antenna apparatus with the slit 20 according to a first modified preferred embodiment of the third preferred embodiment of the present invention.

FIG. 36 is a perspective view showing a configuration of an open-ended waveguide antenna apparatus with the slit 20 according to the first modified preferred embodiment of the third preferred embodiment of the present invention. As shown in FIG. 36, it is acceptable to provide a matching conductor 21 that has a structure similar to that of FIG. 8 in addition to the structure of FIG. 28 in order to obtain a desired input impedance characteristic. By virtue of provision of the matching conductor 21, the impedance of the waveguide antenna apparatus can be changed by changing the electric field in the vicinity of the antenna element 13 and changing the current flowing through the antenna element 13. With this arrangement, there is such a unique advantageous effect that there can be provided a high-efficiency antenna apparatus, which is able to obtain a desired input impedance characteristic and has a little reflection loss.

Figure 37:
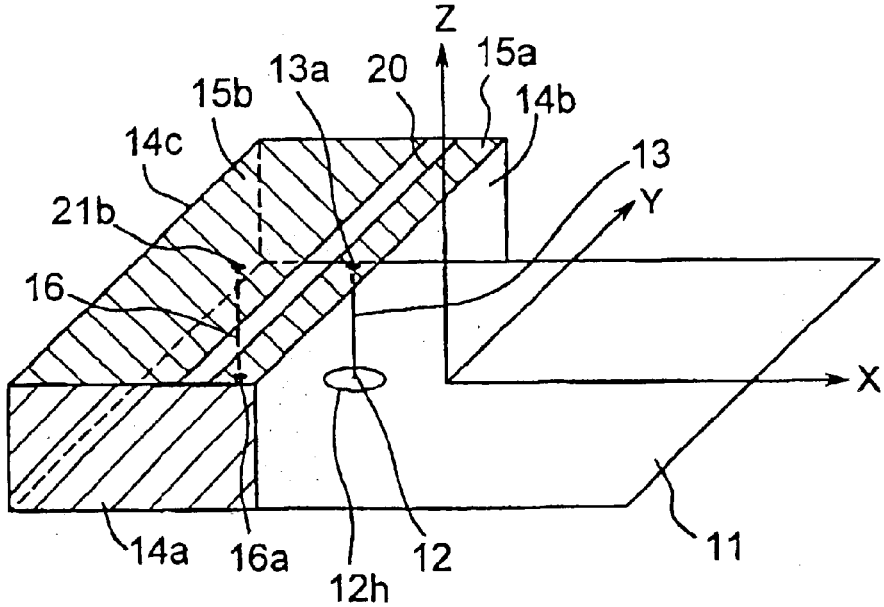
FIG. 37 is a perspective view showing a configuration of an open-ended waveguide antenna apparatus with the slit 20 according to a second modified preferred embodiment of the third preferred embodiment of the present invention.

FIG. 37 is a perspective view showing a configuration of an open-ended waveguide antenna apparatus with the slit 20 according to the second modified preferred embodiment of the third preferred embodiment of the present invention. As shown in FIG. 37, it is acceptable to provide a matching conductor 16 that has a structure similar to that of FIG. 9 in addition to the structure of FIG. 28 in order to obtain a desired impedance characteristic. With this arrangement, there is such a unique advantageous effect that there can be provided a high-efficiency antenna apparatus, which is able to obtain a desired input impedance characteristic and has a little reflection loss.

Figure 38:
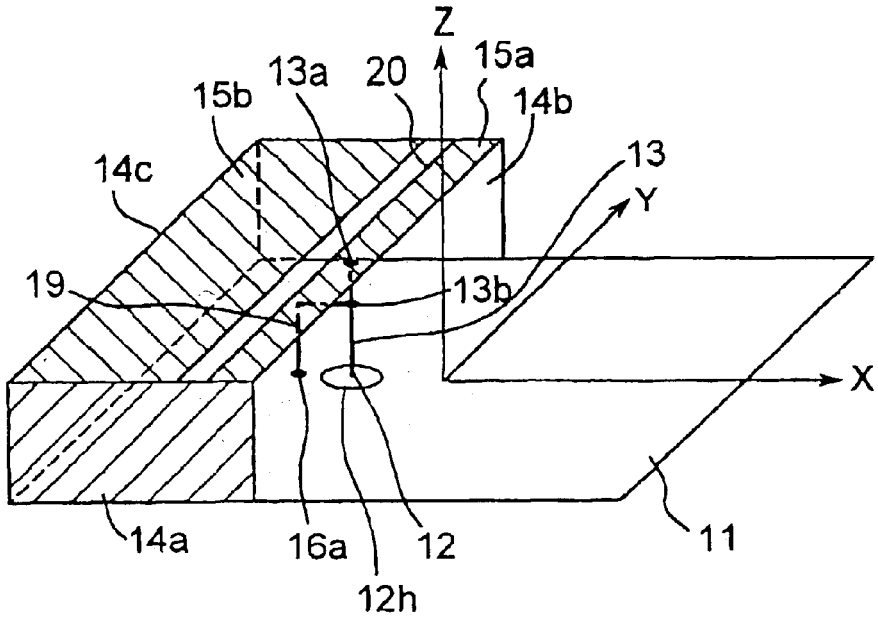
FIG. 38 is a perspective view showing a configuration of an open-ended waveguide antenna apparatus with the slit 20 according to a third modified preferred embodiment of the third preferred embodiment of the present invention.

FIG. 38 is a perspective view showing a configuration of an open-ended waveguide antenna apparatus with the slit 20 according to the third modified preferred embodiment of the third preferred embodiment of the present invention. As shown in FIG. 38, it is acceptable to provide a matching conductor 19 that has a structure similar to that of FIG. 10 in addition to the structure of FIG. 28 in order to obtain a desired impedance characteristic. With this arrangement, there is such a unique advantageous effect that the impedance characteristic can be remarkably changed since the current flowing through the antenna element 13 can be directly changed.

Figure 39:
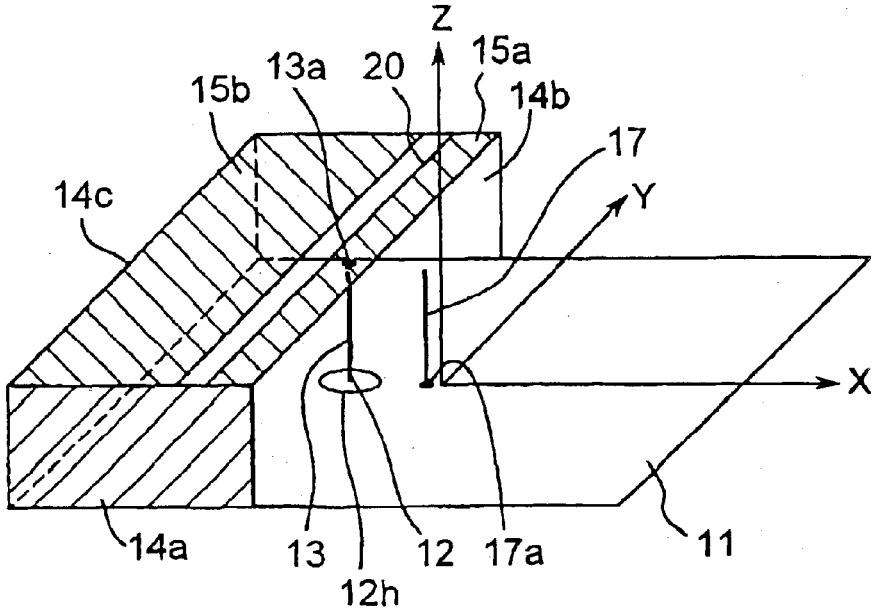
FIG. 39 is a perspective view showing a configuration of an open-ended waveguide antenna apparatus with the slit 20 according to a fourth modified preferred embodiment of the third preferred embodiment of the present invention.

FIG. 39 is a perspective view showing a configuration of an open-ended waveguide antenna apparatus with the slit 20 according to the fourth modified preferred embodiment of the third preferred embodiment of the present invention. As shown in FIG. 39, it is acceptable to provide a directivity pattern controlling conductor 17 that has a structure similar to that of FIG. 11 in order to change the radiation directivity pattern. In the open-ended waveguide antenna apparatus with the slit 20 of FIG. 39, as a consequence of the operation of the directivity pattern controlling conductor 17 as a wave director, there is obtained such an advantageous effect that the radiated electromagnetic wave has a sharper directivity in the +X-direction than when the directivity pattern controlling conductor 17 is not provided. The directivity pattern controlling conductor 17 made of a linear conductor in FIG. 39 may be made of a conductor of the other shape. For example, the directivity pattern controlling conductor 17 may be a helical type matching conductor made of a spiral conductor wire or formed of a conductor wire bent in an L-figured shape. With this arrangement, the waveguide antenna apparatus is allowed to have a low profile without impairing any advantageous effect of the present modified preferred embodiment.

Figure 40:
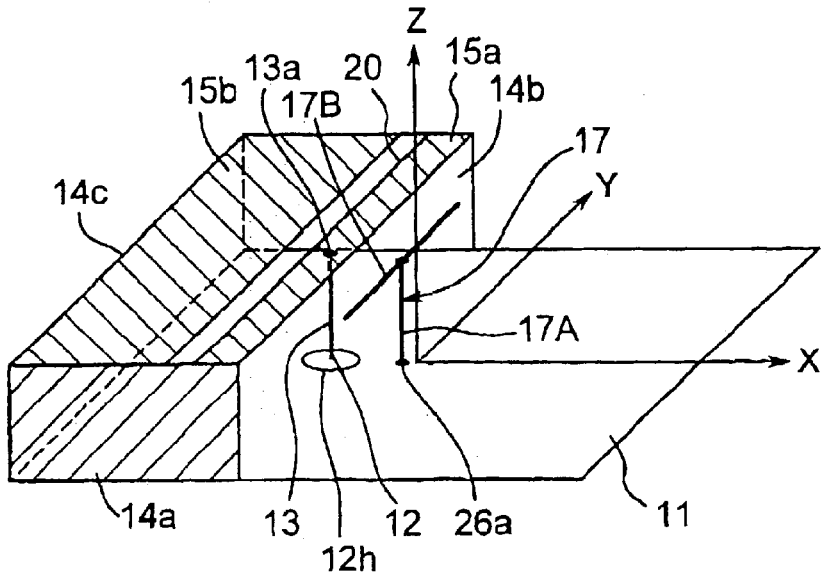
FIG. 40 is a perspective view showing a configuration of an open-ended waveguide antenna apparatus with the slit 20 according to a fifth modified preferred embodiment of the third preferred embodiment of the present invention.

FIG. 40 is a perspective view showing a configuration of an open-ended waveguide antenna apparatus with the slit 20 according to the fifth modified preferred embodiment of the third preferred embodiment of the present invention.

Referring to FIG. 40, it is acceptable to provide a structure similar to that of FIG. 12 with a directivity pattern controlling conductor 17 constituted by including two linear conductors 17A and 17B. Although the structure of FIG. 39 is based on a technique for mainly improving the directivity pattern on the X-Z plane, the directivity pattern on the X-Y plane can be also changed by adopting the structure of FIG. 40.

Figure 41:
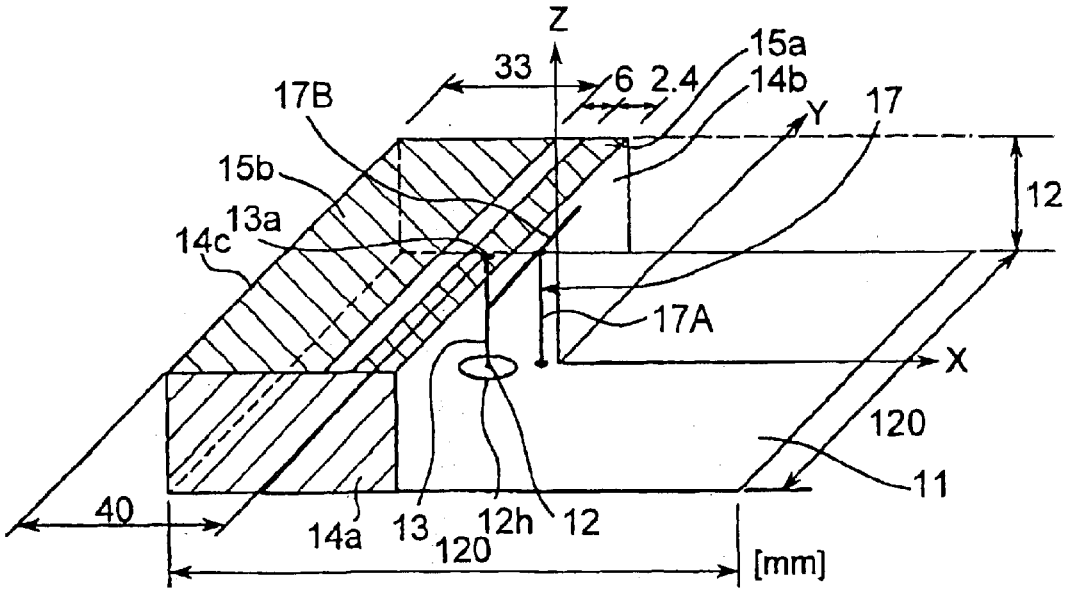
FIG. 41 is a perspective view showing a configuration of an open-ended waveguide antenna apparatus with the slit 20 according to an implemental example of a fifth modified preferred embodiment of the third preferred embodiment of the present invention.
Figure 42A:
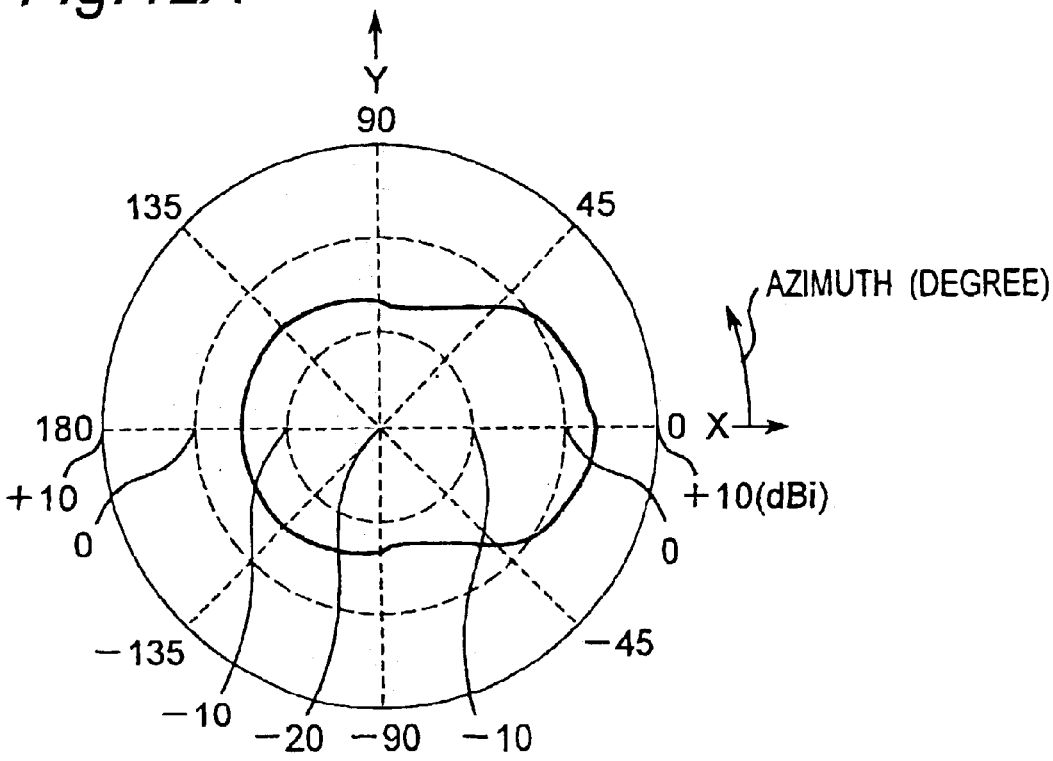
FIG. 42A is a graph showing a radiation directivity pattern on the X-Y plane of the open-ended waveguide antenna apparatus with the slit 20 of FIG. 41.
Figure 42B:
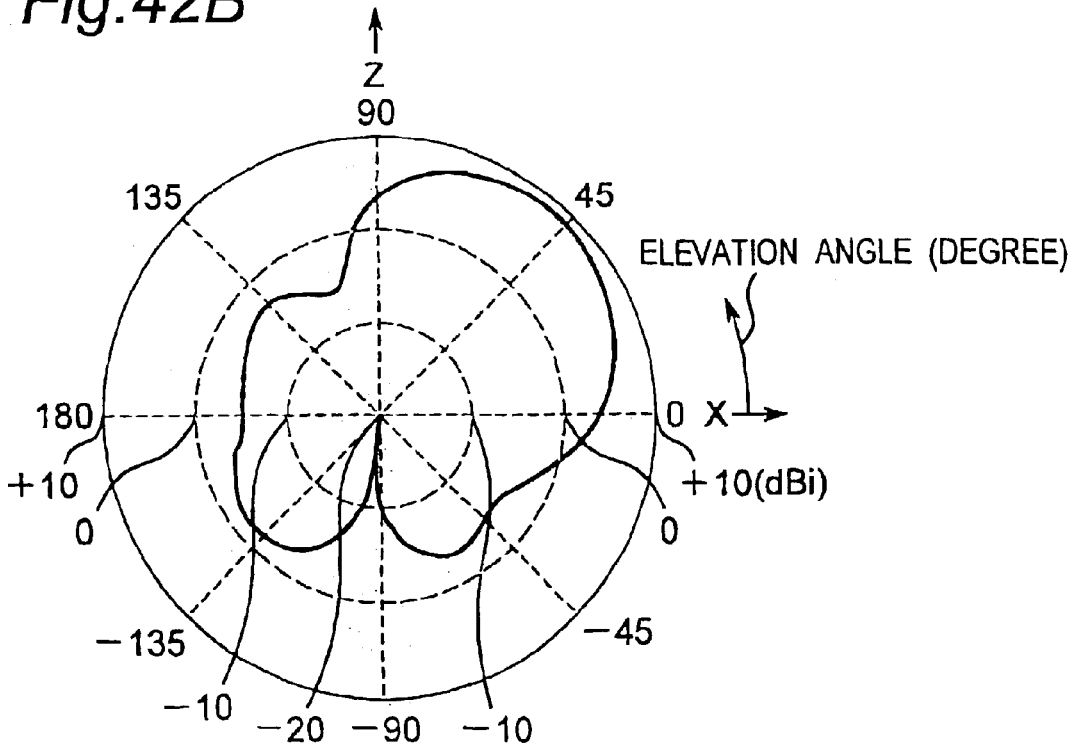
FIG. 42B is a graph showing a radiation directivity pattern on the X-Z plane of the open-ended waveguide antenna apparatus with the slit 20 of FIG. 41.

FIG. 41 is a perspective view showing a configuration of an open-ended waveguide antenna apparatus with the slit 20 according to an implemental example of the fifth modified preferred embodiment of the third preferred embodiment of the present invention. FIG. 41 shows the case where the waveguide antenna apparatus having the structure of FIG. 31 is provided with the directivity pattern controlling conductor 17 at an operation frequency of 2 GHz. FIGS. 42A and 42B are graphs showing radiation directivity patterns of the open-ended waveguide antenna apparatus with the slit 20 of FIG. 41. FIG. 42A is a graph showing a radiation directivity pattern on the X-Y plane, and FIG. 42B is a graph showing a radiation directivity pattern on the X-Z plane.

As is apparent from FIG. 42B, it can be understood that the radiation in the +X-direction is further strengthened on the X-Z plane by virtue of provision of the directivity pattern controlling conductor 17 in comparison with the directivity pattern of FIG. 34. Concretely speaking, in the maximum radiation direction (i.e., beam direction) on the X-Z plane, a high gain of 8.5 dBi was obtained at an angle of about 40 degrees rotated from the +Z-direction of the Z-axis toward the +X-direction, and a gain of 2.6 dBi was obtained in the +X-direction of the X-axis also on the X-Y plane. Moreover, as is apparent from FIG. 42A, it can be understood that the radiation in the +Y-direction is increased on the X-Y plane. With this arrangement, it is possible to remarkably change the directivity pattern also on the horizontal plane (on the X-Y plane). In the case where the waveguide antenna apparatus is arranged in a place near an indoor wall or window, it is required to radiate an electromagnetic wave also in the Y-direction toward the wall side. Therefore, the directivity pattern of the present waveguide antenna apparatus has a radiation in the Y-direction, and this is a preferable directivity pattern in the case where the present waveguide antenna apparatus is arranged in a place near an indoor wall.

The above-mentioned preferred embodiment and the modified preferred embodiments have been described on the basis of one directivity pattern controlling conductor 17 provided. However, the present invention is not limited to this, and a plurality of directivity pattern controlling conductors 17 may be provided. With this arrangement, the degree of freedom of the structure of the open-ended waveguide antenna apparatus with the slit 20 is increased, and the radiation directivity pattern can be more largely controlled. It is also possible to employ the directivity pattern controlling conductor 17 together with the matching conductor 21 shown in FIGS. 36 to 38.

The above-mentioned preferred embodiment and the modified preferred embodiments have been described taking as an example the open-ended waveguide antenna apparatus with the slit 20 having the structure in which the grounding conductor 11 has a shape of a square. However, the present invention is not limited to this, and it is acceptable to form the grounding conductor 11 of a rectangle, the other polygons, a semicircle, or a combination of these shapes or the other shapes in order to obtain, for example, a desired radiation directivity pattern or input impedance characteristic. Moreover, when the waveguide antenna apparatus is installed on the ceiling or the like, there is a demand for conforming the antenna apparatus configuration to the ceiling panel frame arrangement or the room configuration so that the antenna apparatus is not conspicuous. However, when the configuration of the waveguide antenna apparatus is a rectangle or the other polygons, there is a restriction on the direction in which the waveguide antenna apparatus is installed since the ceiling panel frame arrangement or the room configuration is fixed. Accordingly, by employing a radome 18 whose bottom surface brought in contact with the grounding conductor 11 has a shape of circle in a manner similar to that of the third implemental example of the first preferred embodiment shown in FIG. 15, it is possible to stabilize the characteristics of the waveguide antenna apparatus by preventing the entry of moisture, dust and so on which deteriorate the antenna characteristics and to install the waveguide antenna apparatus without caring for the ceiling panel frame arrangement or the room configuration upon installing the waveguide antenna apparatus on the ceiling. Furthermore, when the bottom surface of the waveguide antenna apparatus has a shape of circle, it is possible to change the direction in which the waveguide antenna apparatus is installed by rotating the waveguide antenna apparatus. With this arrangement, the electromagnetic wave radiation direction can be adjusted, and a radiation directivity pattern suitable for the installation position of the waveguide antenna apparatus can be obtained.

Moreover, it is acceptable to arrange a plurality of open-ended waveguide antenna apparatuses with the slit 20 of the third preferred embodiment and the respective modified preferred embodiment in an array form for the structure of a phased array antenna and an adaptive antenna array. This makes it possible to further control the directivity pattern of the electromagnetic wave that is radiated from the waveguide antenna apparatus.

Fourth Preferred Embodiment

Figure 43:
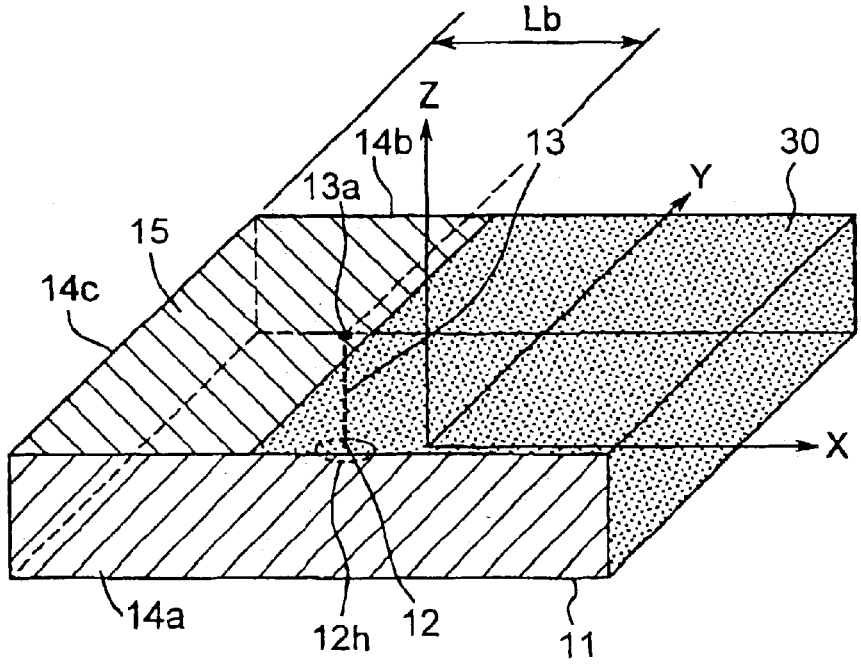
FIG. 43 is a perspective view showing a configuration of an open-ended waveguide antenna apparatus in which the antenna of the first preferred embodiment is internally filled with a dielectric material, according to a fourth preferred embodiment of the present invention.

FIG. 43 is a perspective view showing a configuration of an open-ended waveguide antenna apparatus in which the antenna of the first preferred embodiment is internally filled with a dielectric material, according to the fourth preferred embodiment of the present invention.

Referring to FIG. 43, the waveguide antenna apparatus of the present preferred embodiment is characterized in that the antenna of the open-ended waveguide antenna apparatus of the first preferred embodiment shown in FIG. 1 is internally filled with a dielectric material. With this structure, it is possible to form the present waveguide antenna apparatus with reductions in size and weight in addition to the action and advantageous effects of the first preferred embodiment and to manufacture the present waveguide antenna apparatus with a higher precision with a metal conductor provided on a dielectric substrate by using the well-known conductor pattern formation method. Moreover, since the antenna is internally filled with the dielectric material 30, there is an advantage that dust does not enter, obviating the need for cleaning.

Figure 44:
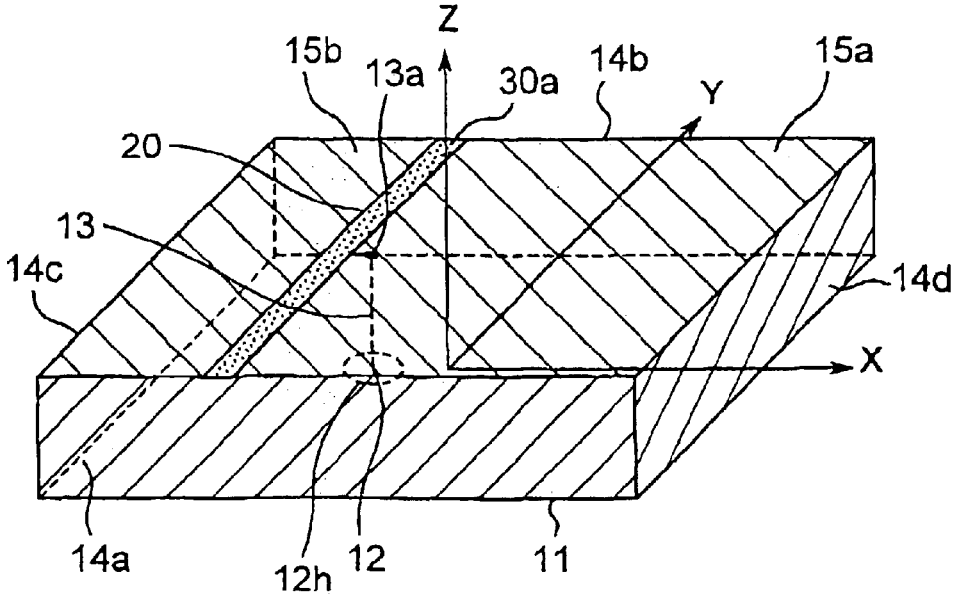
FIG. 44 is a perspective view showing a configuration of a slit radiation type waveguide antenna apparatus in which the antenna of the second preferred embodiment is internally filled with a dielectric material, according to a first modified preferred embodiment of the fourth preferred embodiment of the present invention.

FIG. 44 is a perspective view showing a configuration of a slit radiation type waveguide antenna apparatus in which the antenna of the second preferred embodiment is internally filled with a dielectric material, according to the first modified preferred embodiment of the fourth preferred embodiment of the present invention.

Referring to FIG. 44, the waveguide antenna apparatus of the present preferred embodiment is characterized in that the antenna of the slit radiation type waveguide antenna apparatus of the second preferred embodiment shown in FIG. 16 is internally filled with a dielectric material 30*a*. With this structure, it is possible to form the present waveguide antenna apparatus with reductions in size and weight in addition to the action and advantageous effects of the second preferred embodiment and to manufacture the present waveguide antenna apparatus with a higher precision with a metal conductor provided on a dielectric substrate by using the well-known conductor pattern formation method. Moreover, since the antenna is internally filled with the dielectric material 30, there is an advantage that dust does not enter, obviating the need for cleaning.

Figure 45:
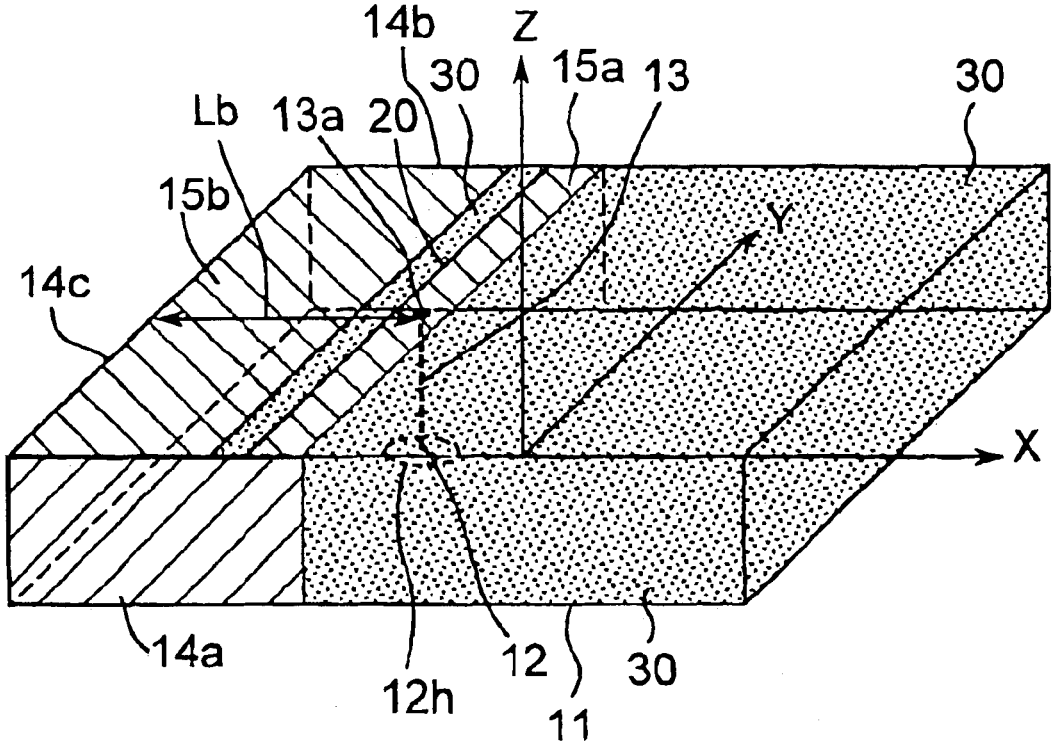
FIG. 45 is a perspective view showing a configuration of an open-ended waveguide antenna apparatus with the slit 20 in which the antenna of the third preferred embodiment is internally filled with a dielectric material, according to a second modified preferred embodiment of the fourth preferred embodiment of the present invention.

FIG. 45 is a perspective view showing a configuration of an open-ended waveguide antenna apparatus with the slit 20 in which the antenna of the third preferred embodiment is internally filled with a dielectric material, according to the second modified preferred embodiment of the fourth preferred embodiment of the present invention.

Referring to FIG. 45, the waveguide antenna apparatus of the present preferred embodiment is characterized in that the antenna of the open-ended waveguide antenna apparatus with the slit 20 of the third preferred embodiment shown in FIG. 28 is internally filled with a dielectric material. With this structure, it is possible to form the present waveguide antenna apparatus with reductions in size and weight in addition to the action and advantageous effects of the third preferred embodiment and to manufacture the present waveguide antenna apparatus with a higher precision with a metal conductor provided on a dielectric substrate by using the well-known conductor pattern formation method. Moreover, since the antenna is internally filled with the dielectric material 30, there is an advantage that dust does not enter, obviating the need for cleaning.

In each of the above-mentioned fourth preferred embodiment and its first and second modified preferred embodiments, the antennas of the first, second and third preferred embodiments are each internally filled with the dielectric material 30. However, in each of the modified preferred embodiments and the implemental examples of the first, second and third preferred embodiments, the antenna may be internally filled with the dielectric material 30.

In each of the waveguide antenna apparatuses of the fourth preferred embodiment and its first and second modified preferred embodiments, the dielectric material 30 is inserted in the antenna. When a relative dielectric constant is er which is defined as a ratio of the dielectric constant of the dielectric material 30 to a dielectric constant $\epsilon_0$ in vacuum, then the wavelength in the dielectric material 30 becomes $1\sqrt{\epsilon_r}$ times as great as the wavelength in vacuum. Since the relative dielectric constant $\epsilon_r$ is not smaller than one, the wavelength becomes smaller in the dielectric material 30 than in vacuum. Therefore, by inserting the dielectric material 30 in the waveguide antenna apparatus, the waveguide antenna apparatus is allowed to have a more compact and low-profile structure than when the dielectric material 30 is not inserted.

Fifth Preferred Embodiment

Figure 46A:
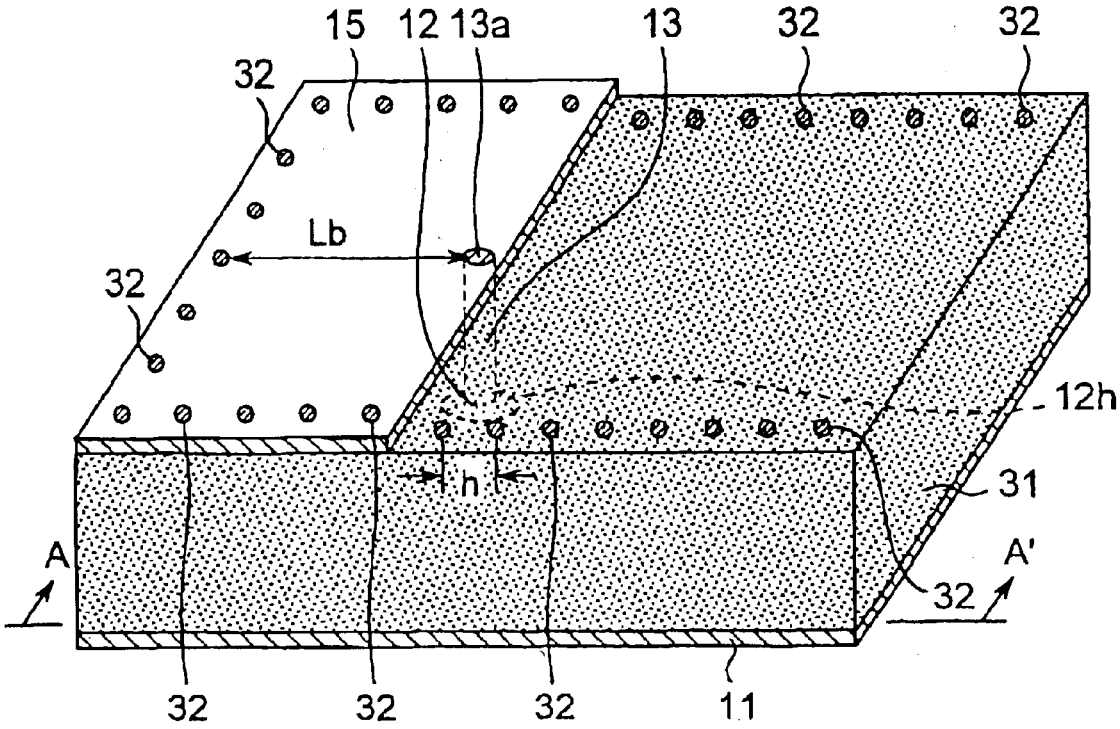
FIG. 46A is a perspective view showing a configuration of an open-ended waveguide antenna apparatus according to a fifth preferred embodiment of the present invention.
Figure 46B:
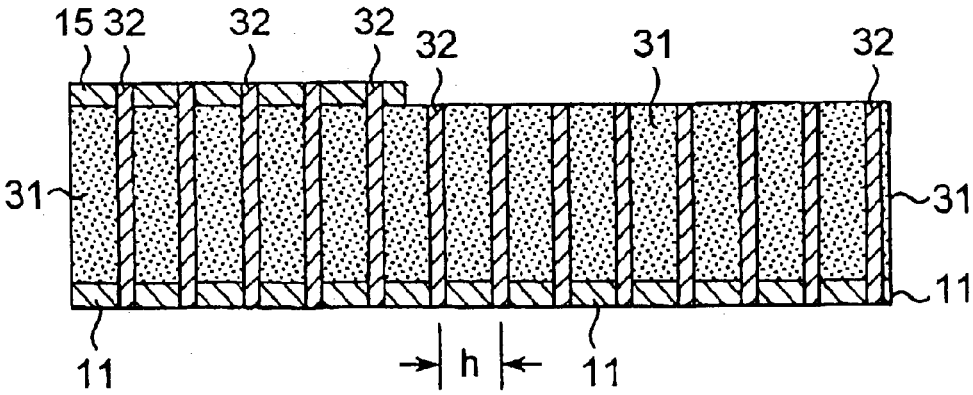
FIG. 46B is a sectional view taken along the line A–A' of FIG. 46A.

FIG. 46A is a perspective view showing a configuration of an open-ended waveguide antenna apparatus according to the fifth preferred embodiment of the present invention, and FIG. 46B is a sectional view taken along the line A–A' in FIG. 46A. The preferred embodiment of FIGS. 46A and 46B is characterized in that a plurality of through hole conductors 32 arranged to be parallel apart from each other at a predetermined distance "h" (in the vertical direction, i.e., in the thickness direction) are formed in place of the side surface conductors 14*a* and 14*b* and the terminating conductor 14*c* of FIG. 43, with the operation and advantageous effects similar to those of the open-ended waveguide antenna apparatus of FIG. 43. The antenna element 13 is also formed by a through hole conductor. In this case, a distance from the antenna element 13 to the through hole conductor 32 that constitutes a terminating conductor is set to the above-mentioned length Lb. In this case, the through hole conductor 32 is formed by forming a through hole that penetrates a dielectric substrate 31, on which a grounding conductor 11 and a ceiling conductor 15 are formed, in the thickness direction and filling the through hole with a metal conductor. According to the manufacturing method of the present preferred embodiment, the well-known conductor pattern formation method can be used, and therefore, the ceiling conductor 15 and the through hole conductor 32 can be manufactured with a higher precision. With this arrangement, the manufacture precision of the waveguide antenna apparatus filled with the dielectric material can be improved, and cost can be reduced through mass production.

One example of the production procedure of the waveguide antenna apparatus of FIGS. 46A and 46B will be described next. By cutting a dielectric substrate 31, on the top and bottom surfaces of which a conductor layer (conductor pattern) is formed, with the size of the grounding conductor 11 and abrading the top surface conductor layer by, for example, etching or machining, the ceiling conductor 15 of the conductor pattern is formed. Subsequently, by forming through holes so that they penetrate the dielectric substrate 31 in the thickness direction and then filling each of the through holes with a metal conductor, the side surface conductors and a terminating conductor constituted by including a plurality of through hole conductors 32 and an antenna element 13 are formed. In this case, the surface on which the ceiling conductor 15 is formed is assumed as the top surface of the dielectric substrate 31. The other conductor layer of the dielectric substrate 31 serves as the grounding conductor 11. Further, by forming an appropriate circular hole 12*h* in a position where the through hole constituting the antenna element 13 exists in the grounding conductor 11 for the formation of a feeding point 12, the waveguide antenna apparatus of the present preferred embodiment can be manufactured.

Also, in the case of the waveguide antenna apparatuses of FIGS. 44 and 45, it is acceptable to similarly form the slit 20 by abrading the conductor layer by etching or machining on the dielectric substrate on the surface of which the conductor layer is formed.

As described above, according to the waveguide antenna apparatuses of the fourth and fifth preferred embodiments, there can be provided an antenna apparatus, which has a compact low-profile configuration, a higher manufacturing precision, a little degradation of the antenna characteristics and a directivity having a strong main beam in one direction.

In the above-mentioned preferred embodiments, the modified preferred embodiments and the prototypes, there have been described the structures in which the waveguide antenna apparatuses are symmetrical with respect to the X-Z plane. In this case, there is such action and advantageous effect that the directivity pattern of the radiated electromagnetic wave from the waveguide antenna apparatus becomes symmetrical with respect to the X-Z plane.

The above-mentioned preferred embodiment has been described taking as an example the waveguide antenna apparatus that has a structure symmetrical with respect to the X-Z plane. However, the present invention is not limited to this, and it is acceptable to form a structure symmetrical with respect to only the Y-Z plane or a structure asymmetrical with respect to the Y-Z plane and the X-Z plane in order to obtain, for example, a desired radiation directivity pattern or input impedance characteristic. By adopting such a structure, there can be provided an antenna apparatus having a radiation directivity pattern suitable for the objective space of radiation.

The present preferred embodiment has been described taking as an example the waveguide antenna apparatus having such a structure that the antenna interior surrounded by the conductors is entirely filled with the dielectric material 30. However, the present invention is not limited to this, and the antenna interior may be partially filled with the dielectric material 30. For example, it is acceptable to form only the space, which is surrounded by the ceiling conductor 15 (or 15*a* and 15*b*), the side surface conductors 14*a* and 14*b*, the terminating conductor 14*c* (or 14*c* and 14*d*) and the grounding conductor 11, by using a dielectric substrate.

Further, the fifth preferred embodiment may be further provided with the matching conductor 13 or/and 16 or the directivity pattern controlling conductor 17 or/and 19 described in connection with the first preferred embodiment, the second preferred embodiment and the third preferred embodiment. In this case, the matching conductor 13 or/and, 16 or the directivity pattern controlling conductor 17 or/and 19 may be formed by a through hole conductor or a metal foil pattern provided for the dielectric substrate. Moreover, it is acceptable to apply all of the modified preferred embodiments described in connection with the first preferred embodiment, the second preferred embodiment and the third preferred embodiment to the waveguide antenna apparatus of the present preferred embodiment.

Moreover, it is also acceptable to arrange a plurality of waveguide antenna apparatuses of the fifth preferred embodiment in an array form for the structure of a phased array antenna and an adaptive antenna array. This makes it possible to further control the directivity pattern of the electromagnetic wave that is radiated from the waveguide antenna apparatus.

The above-mentioned preferred embodiments and the modified preferred embodiments thereof are each provided with one matching conductor 16, 19 or 29. However, the present invention is not limited to this, and it is acceptable to provide a plurality of matching conductors 16, 19 and 29. Moreover, the above-mentioned preferred embodiments and the modified preferred embodiments are each provided with one directivity pattern controlling conductor 17. However, the present invention is not limited to this, and it is acceptable to provide a plurality of directivity pattern controlling conductors 17.

Modified Preferred Embodiments Of First Preferred Embodiment

Figure 47:
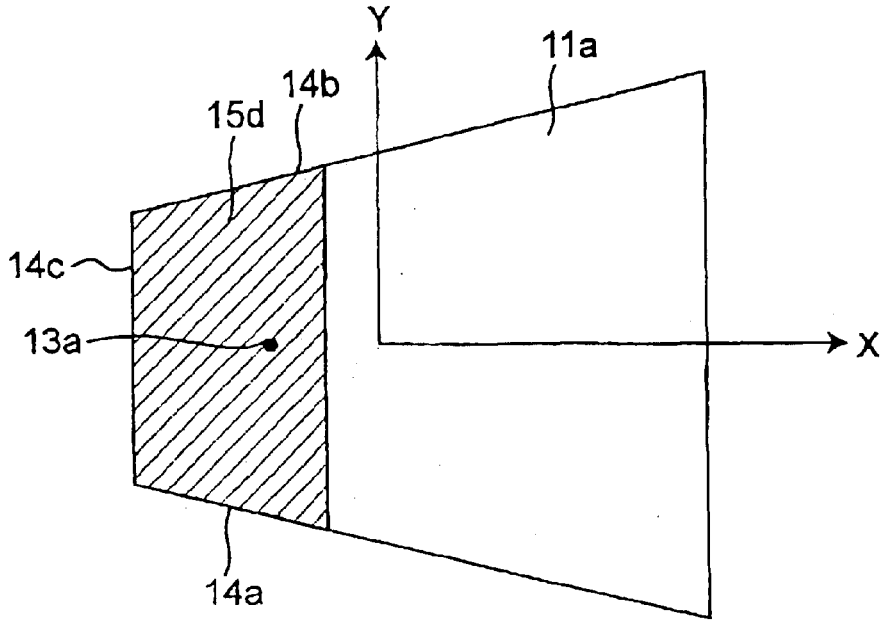
FIG. 47 is a top view showing a configuration of an open-ended waveguide antenna apparatus according to a sixth modified preferred embodiment of the first preferred embodiment of the present invention.

FIG. 47 is a top view showing a configuration of an open-ended waveguide antenna apparatus according to the sixth modified preferred embodiment of the first preferred embodiment of the present invention. In the open-ended waveguide antenna apparatus of FIG. 1, the rectangular waveguide constituted by including the grounding conductor 11, the side surface conductors 14*a* and 14*b* and the ceiling conductor 15 has a rectangular cross section. In contrast to this, the open-ended waveguide antenna apparatus of the present modified preferred embodiment is constituted by including a grounding conductor 11*a*, side surface conductors 14*a* and 14*b* and a ceiling conductor 15*d*. In this case, the waveguide antenna apparatus is characterized in that the grounding conductor 11*a* and the ceiling conductor 15*d* have each a shape of an isosceles trapezoid whose side of the short-circuit conductor 14*c* is smaller than the side at the opened end, and the rectangular waveguide is formed so that the cross section at the opened end becomes larger than the cross section at the one end short-circuited by the terminating conductor 14*c*. In this case, the two side surface conductors 14*a* and 14*b* opposed to each other are formed so as to be located further apart from each other at opened another end of the rectangular waveguide than at the one end of the rectangular waveguide short-circuited by the terminating conductor 14*c*. In the open-ended waveguide antenna apparatus of the sixth modified preferred embodiment constructed as above, the main beam width in the horizontal direction of the electromagnetic wave transmitted and received by the present antenna apparatus can be made wider than that of the waveguide antenna apparatus of FIG. 1.

Figure 48:
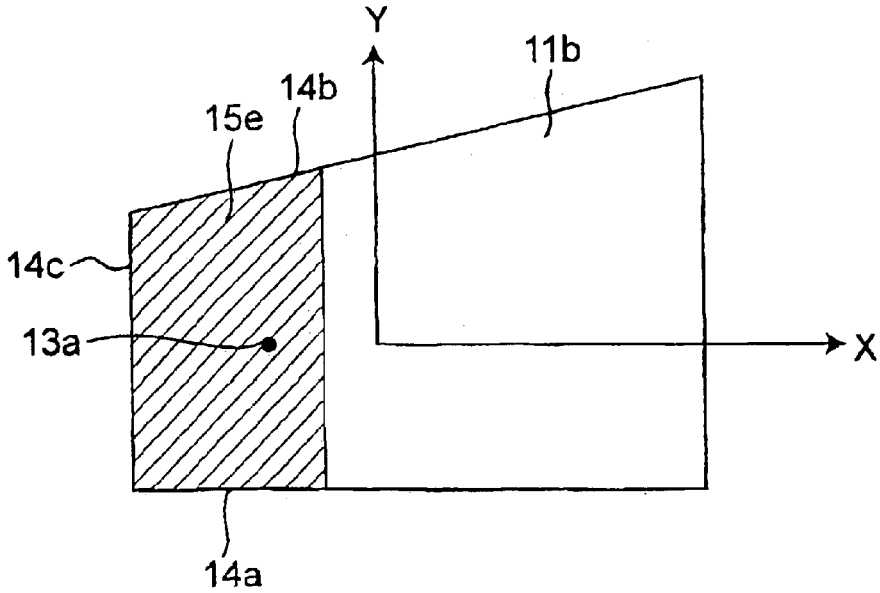
FIG. 48 is a top view showing a configuration of an open-ended waveguide antenna apparatus according to a seventh modified preferred embodiment of the first preferred embodiment of the present invention.

FIG. 48 is a top view showing a configuration of an open-ended waveguide antenna apparatus according to the seventh modified preferred embodiment of the first preferred embodiment of the present invention. The waveguide antenna apparatus of FIG. 47 is provided with the grounding conductor 11*a* and the ceiling conductor 15*d*, which have each a shape of isosceles trapezoid. The waveguide antenna apparatus of FIG. 48 is characterized in that a grounding conductor 11*b* and a ceiling conductor 15*e*, of which the leg portions have each a shape of trapezoid having different lengths (Note that the side of the short-circuit conductor 14*c* is smaller than the side at the opened end), are provided. Also, in the present waveguide antenna apparatus, the two side surface conductors 14*a* and 14*b* opposed to each other are located further apart from each other at opened another end of the rectangular waveguide than at the one end of the rectangular waveguide short-circuited by the terminating conductor 14*c*. The main beam width in the horizontal direction of the electromagnetic wave transmitted and received by the present antenna apparatus can be made wider than that of the waveguide antenna apparatus of FIG. 1.

Figure 49:
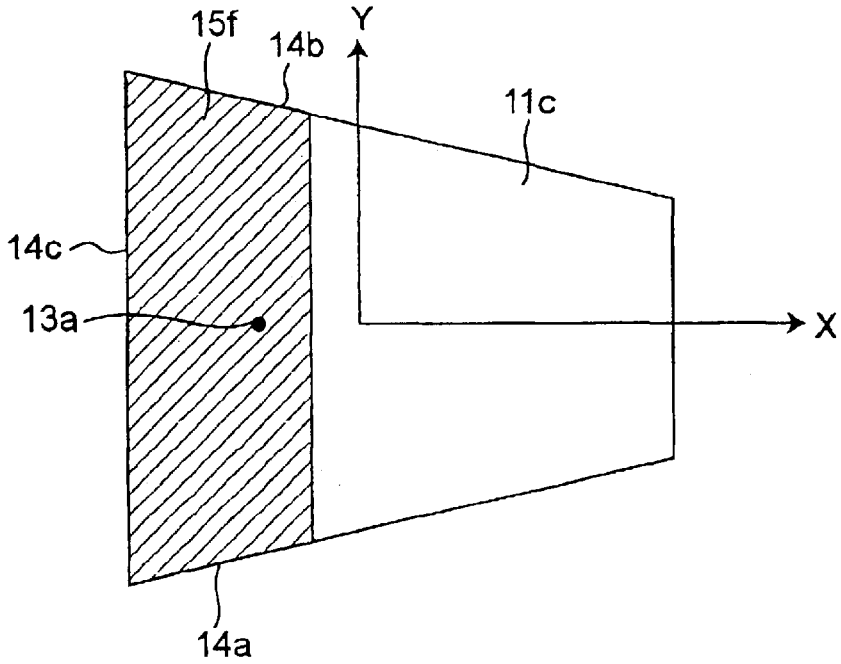
FIG. 49 is a top view showing a configuration of an open-ended waveguide antenna apparatus according to an eighth modified preferred embodiment of the first preferred embodiment of the present invention.

FIG. 49 is a top view showing a configuration of an open-ended waveguide antenna apparatus according to the eighth modified preferred embodiment of the first preferred embodiment of the present invention. In the open-ended waveguide antenna apparatus of FIG. 1, the rectangular waveguide constituted by including the grounding conductor 11, the side surface conductors 14*a* and 14*b* and the ceiling conductor 15 has a rectangular cross section. In contrast to this, the open-ended waveguide antenna apparatus of the present modified preferred embodiment is constituted by including a grounding conductor 11*c*, side surface conductors 14*a* and 14*b* and a ceiling conductor 15*f*. In this case, the waveguide antenna apparatus is characterized in that the grounding conductor 11*c* and the ceiling conductor 15*f* have each s shape of isosceles trapezoid, of which the side of the short-circuit conductor 14*c* is smaller than that the side at the opened end, and the rectangular waveguide is formed so that the cross section at the opened end becomes smaller than the cross section at the one end short-circuited by the terminating conductor 14*c*. In this case, the two side surface conductors 14*a* and 14*b* opposed to each other are formed so as to be located closer to each other at opened another end of the rectangular waveguide than at the one end of the rectangular waveguide short-circuited by the terminating conductor 14*c*. In the open-ended waveguide antenna apparatus of the eighth modified preferred embodiment constructed as above, the main beam width in the horizontal direction of the electromagnetic wave transmitted and received by the present antenna apparatus can be made narrower than that of the waveguide antenna apparatus of FIG. 1.

Figure 50:
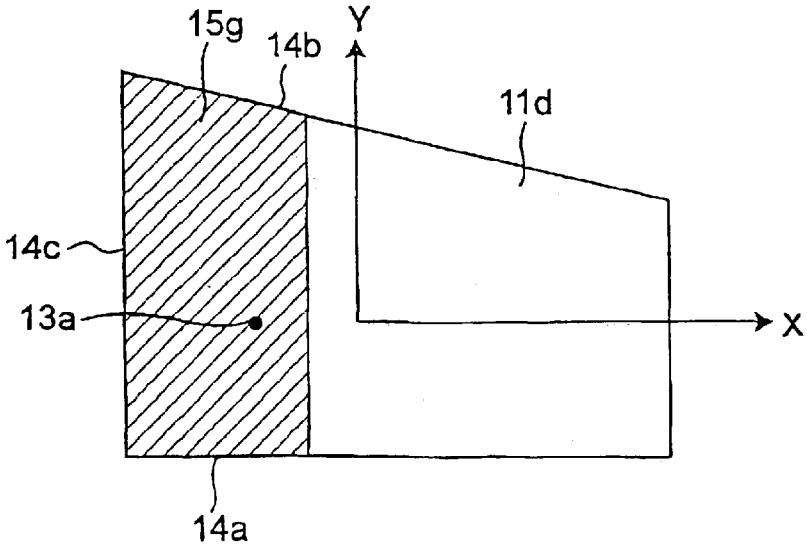
FIG. 50 is a top view showing a configuration of an open-ended waveguide antenna apparatus according to a ninth modified preferred embodiment of the first preferred embodiment of the present invention.

FIG. 50 is a top view showing a configuration of an open-ended waveguide antenna apparatus according to the ninth modified preferred embodiment of the first preferred embodiment of the present invention. The waveguide antenna apparatus of FIG. 47 is provided with the grounding conductor 11*a* and the ceiling conductor 15*d*, which have each a shape of isosceles trapezoid. The waveguide antenna apparatus of FIG. 50 is characterized in that a grounding conductor 1*d* and a ceiling conductor 15*g*, of which the leg portions have each a shape of trapezoid having different lengths (Note that the side of the short-circuit conductor 14*c* is larger than the side at the opened end). Also, in the present antenna apparatus, the two side surface conductors 14*a* and 14*b* opposed to each other are located closer to each other at the opened another end of the rectangular waveguide than at the one end of the rectangular waveguide short-circuited by the terminating conductor 14*c*. The main beam width in the horizontal direction of the electromagnetic wave transmitted and received by the present antenna apparatus can be made narrower than that of the waveguide antenna apparatus of FIG. 1.

Furthermore, the method for modifying the cross-sectional shape of the waveguide antenna apparatus is not limited to the examples shown in FIGS. 47 to 50, and it is possible to modify the same waveguide antenna apparatus into the other shape in order to obtain a desired directivity pattern.

Figure 51A:
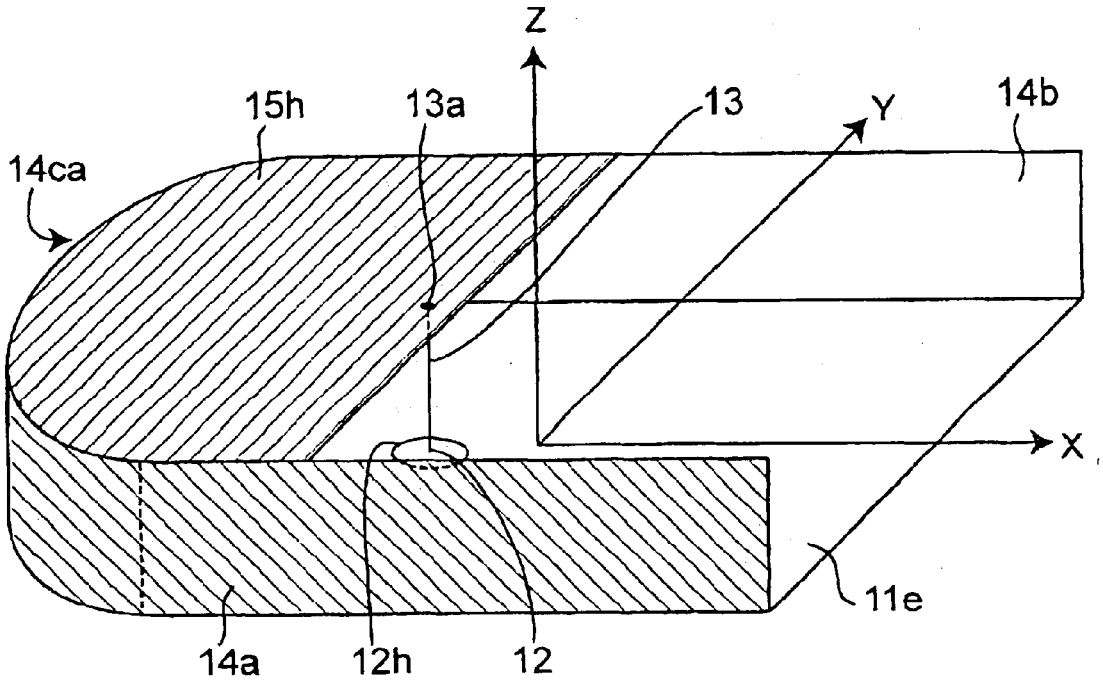
FIG. 51A is a perspective view showing a configuration of an open-ended waveguide antenna apparatus according to a tenth modified preferred embodiment of the first preferred embodiment of the present invention.
Figure 51B:
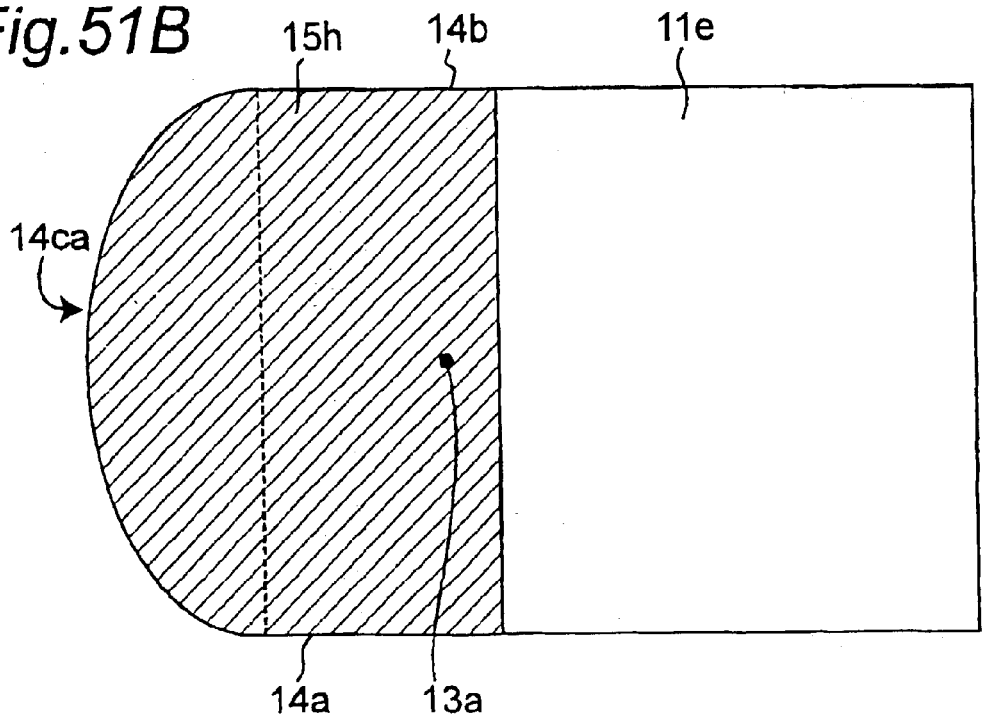
FIG. 51B is a top view of the waveguide antenna apparatus of FIG. 51A.

FIG. 51A is a perspective view showing a configuration of an open-ended waveguide antenna apparatus according to the tenth modified preferred embodiment of the first preferred embodiment of the present invention, and FIG. 51B is the top view thereof. In the open-ended waveguide antenna apparatus of FIG. 1, the side surface conductor 14*a* and the terminating conductor 14*c* are formed so as to be perpendicular to each other, and the side surface conductor 14*b* and the terminating conductor 14*c* are formed so as to be perpendicular to each other. In contrast to this, in the open-ended waveguide antenna apparatus of the present modified preferred embodiment, a terminating conductor 14*ca* is formed in a curved configuration of a semioval surface (top and bottom surfaces) smoothly connected with the side surface conductors 14*a* and 14*b*. In this case, the terminating conductor 14*ca* is formed while being curved so that the length in the electromagnetic wave propagation direction (or the longitudinal direction) of the rectangular waveguide is made so as to be larger in the center portion in the widthwise direction of the rectangular waveguide (i.e., in the center portion on the Y-axis direction), than that at the end portions connected with the side surface conductors 14*a* and 14*b* (so that the terminating conductor 14*ca* side protrudes or projects from the end sides of the side surface conductors 14*a* and 14*b*). In accordance with this, the shapes of the grounding conductor 11*e* and the ceiling conductor 15*h* are modified from the rectangular configuration of FIG. 1 into a shape of rectangular plus semioval. According to the waveguide antenna apparatus constructed as above, the main beam width in the horizontal direction of the electromagnetic wave transmitted and received by the present antenna apparatus can be made narrower than in the preferred embodiment of FIG. 1. Furthermore, in the present antenna apparatus, it is acceptable to modify the cross section at the opened end of the rectangular waveguide so that it is wider or narrower than the cross section at the short-circuit end, in a manner similar to that of the modified preferred embodiments of FIGS. 47 to 50.

Figure 52A:
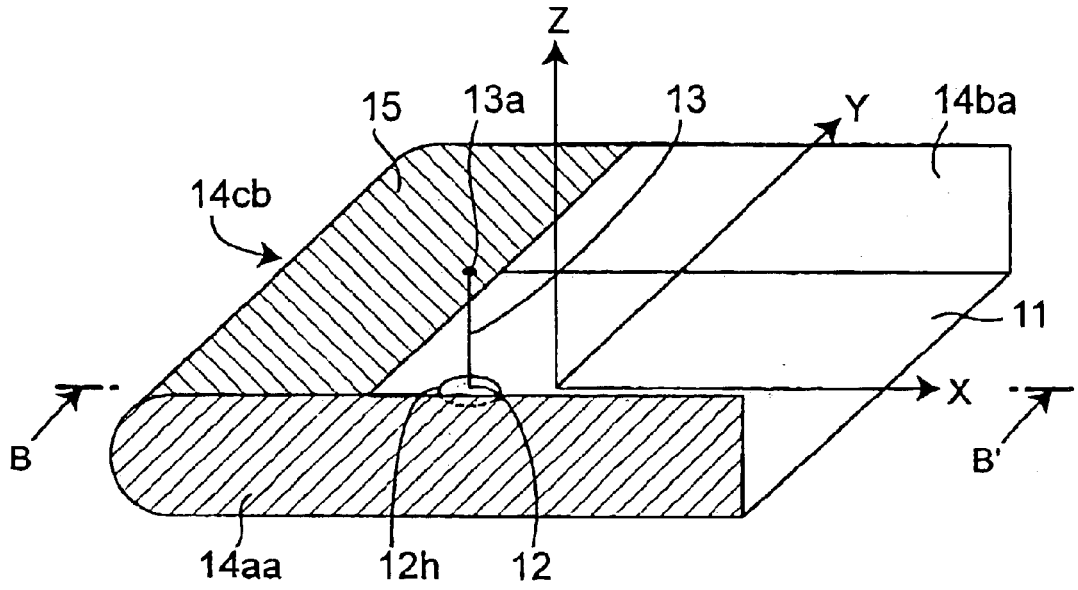
FIG. 52A is a perspective view showing a configuration of an open-ended waveguide antenna apparatus according to an eleventh modified preferred embodiment of the first preferred embodiment of the present invention.
Figure 52B:
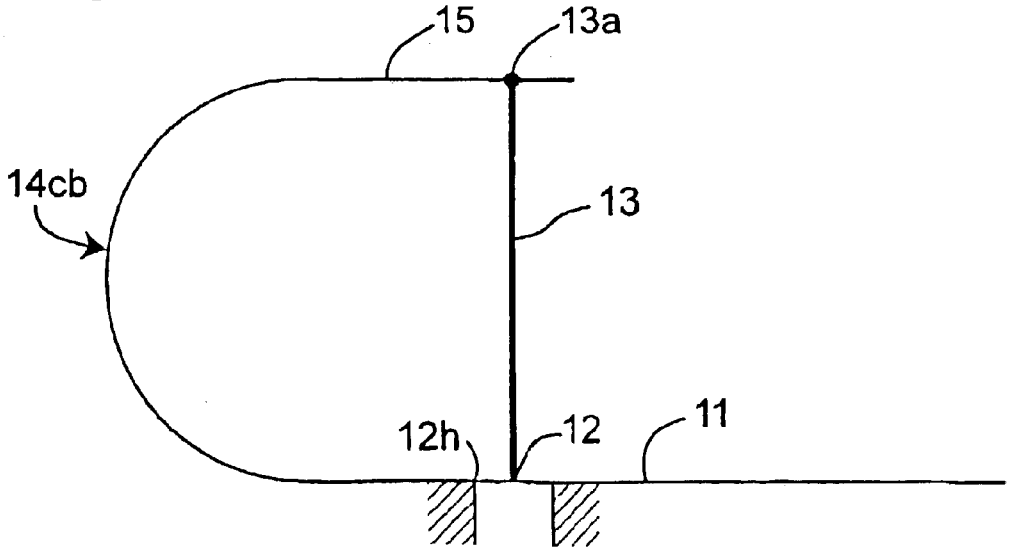
FIG. 52B is a longitudinal sectional view taken along the line B–B' of FIG. 52A.

FIG. 52A is a perspective view showing a configuration of an open-ended waveguide antenna apparatus according to the eleventh modified preferred embodiment of the first preferred embodiment of the present invention, and FIG. 52B is a longitudinal sectional view taken along the line B–B' of FIG. 52A. As shown in FIG. 52B, the open-ended waveguide antenna apparatus of the present modified preferred embodiment is characterized in that a terminating conductor 14*cb* is formed in a curved configuration smoothly connected with the ceiling conductor 15 and the grounding conductor 11. In this case, the ceiling conductor 15, the terminating conductor 14*cb* and the grounding conductor 11 are formed by curving, for example, a single conductor plate. In particular, the terminating conductor 11*cb* is formed while being curved so that the length in the electromagnetic wave propagation direction of the rectangular waveguide is made so as to be larger in the center portion in the widthwise direction of the rectangular waveguide (i.e., in the center portion on the Z-axis direction), than that at the top and bottom end portions as connected with the ceiling conductor 15 and the grounding conductor 11, respectively. In accordance with this, the shapes of the side surface conductors 14*aa* and 14*ba* are also modified from the rectangular configuration of FIG. 1 into a shape of a semicircle plus rectangle. According to the waveguide antenna apparatus constructed as above, the main beam width in the vertical direction of the electromagnetic wave transmitted and received by the present antenna apparatus can be made narrower than in the preferred embodiment of FIG. 1. Furthermore, in the present antenna apparatus, it is acceptable to modify the cross section at the opened end of the rectangular waveguide so that it is wider or narrower than the cross section at the short-circuit end, in a manner similar to that of the modified preferred embodiments of FIGS. 47 to 50.

Figure 53A:
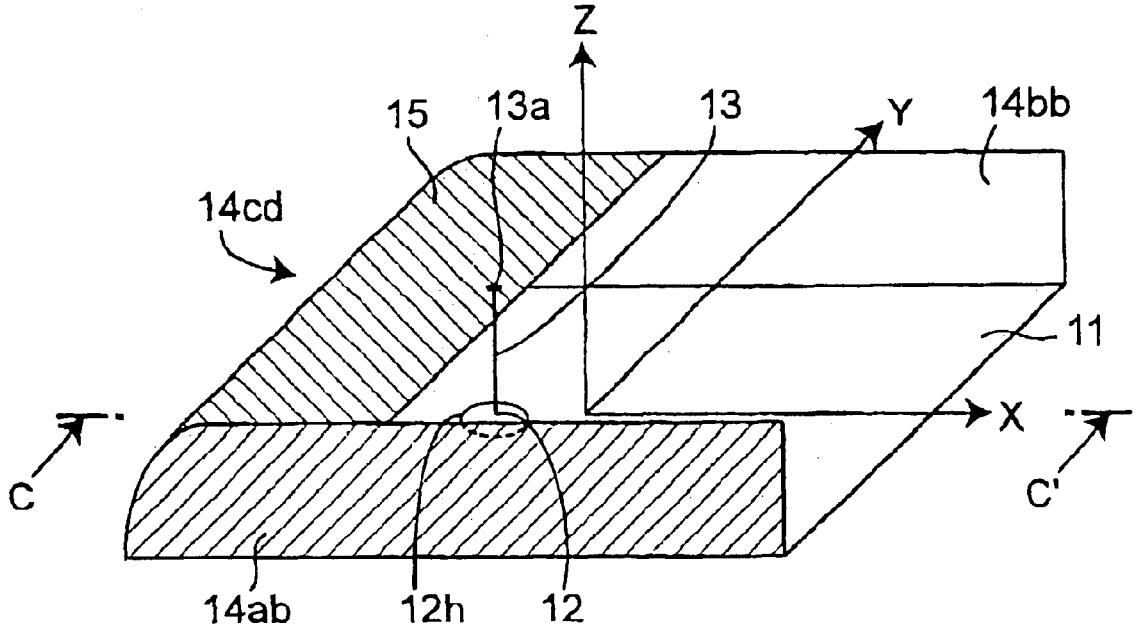
FIG. 53A is a perspective view showing a configuration of an open-ended waveguide antenna apparatus according to a twelfth modified preferred embodiment of the first preferred embodiment of the present invention.
Figure 53B:
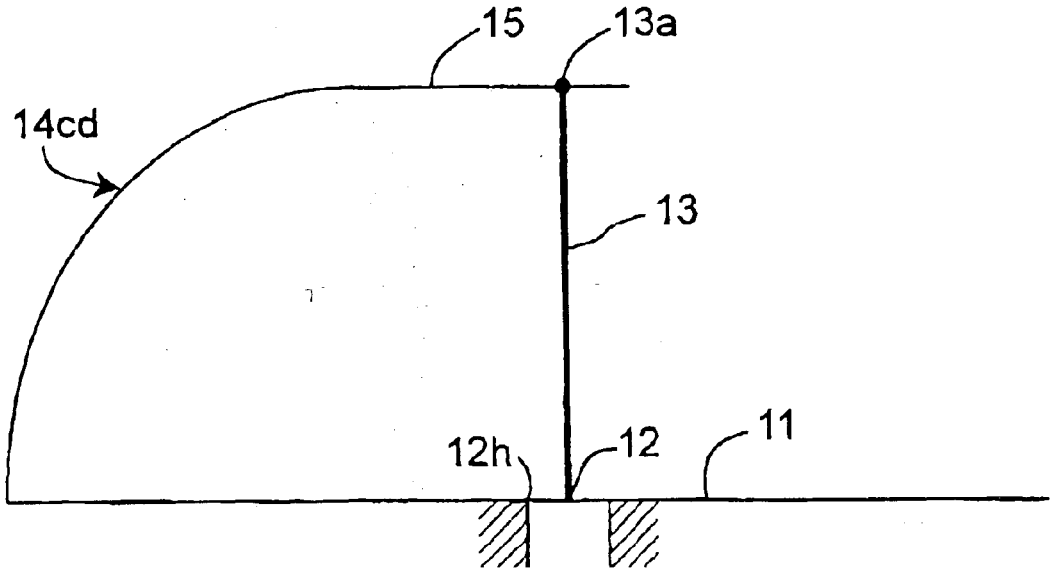
FIG. 53B is a longitudinal sectional view taken along the line C–C' of FIG. 53A.

FIG. 53A is a perspective view showing a configuration of an open-ended waveguide antenna apparatus according to the twelfth modified preferred embodiment of the first preferred embodiment of the present invention. FIG. 53B is a longitudinal sectional view taken along the line C–C' of FIG. 53A. As shown in FIG. 53B, the open-ended waveguide antenna apparatus of the present modified preferred embodiment is characterized in that a terminating conductor 14*cd* is formed in a curved configuration smoothly connected with the ceiling conductor 15. In this case, the ceiling conductor 15 and the terminating conductor 14*cd* are formed by curving, for example, a single conductor plate. In particular, the terminating conductor 14*cd* is formed while being curved so that the length in the electromagnetic wave propagation direction of the rectangular waveguide is made so as to be larger from the top end toward the bottom end in the widthwise direction of the rectangular waveguide. In accordance with this, the shapes of the side surface conductors 14*ab* and 14*bb* are also modified from the rectangular shape of FIG. 1 into a shape of a quarter circle plus rectangle. According to the waveguide antenna apparatus constructed as above, the main beam width in the vertical direction of the electromagnetic wave transmitted and received by the present antenna apparatus can be made narrower than in the preferred embodiment of FIG. 1. Furthermore, in the present antenna apparatus, it is acceptable to modify the cross section at the opened end of the rectangular waveguide so that it is wider or narrower than the cross section at its short-circuit end, in a manner similar to that of the modified preferred embodiments of FIGS. 47 to 50.

As a further modified preferred embodiment of the modified preferred embodiments of FIGS. 47 to 50, it is also acceptable to further provide a matching conductor as shown in FIGS. 8 to 10 or further provide a directivity pattern controlling conductor as shown in FIGS. 11 and 12.

Furthermore, it is acceptable to provide the waveguide antenna apparatus of these modified preferred embodiments in a radome as shown in FIG. 15. As the other modified preferred embodiment, it is acceptable to embed the waveguide antenna apparatus of these modified preferred embodiments in a dielectric material, in a manner similar to that of the fourth and fifth preferred embodiments (See FIGS. 43, 46A and 46B).

Modified Preferred Embodiments Of Third Preferred Embodiment

Figure 54:
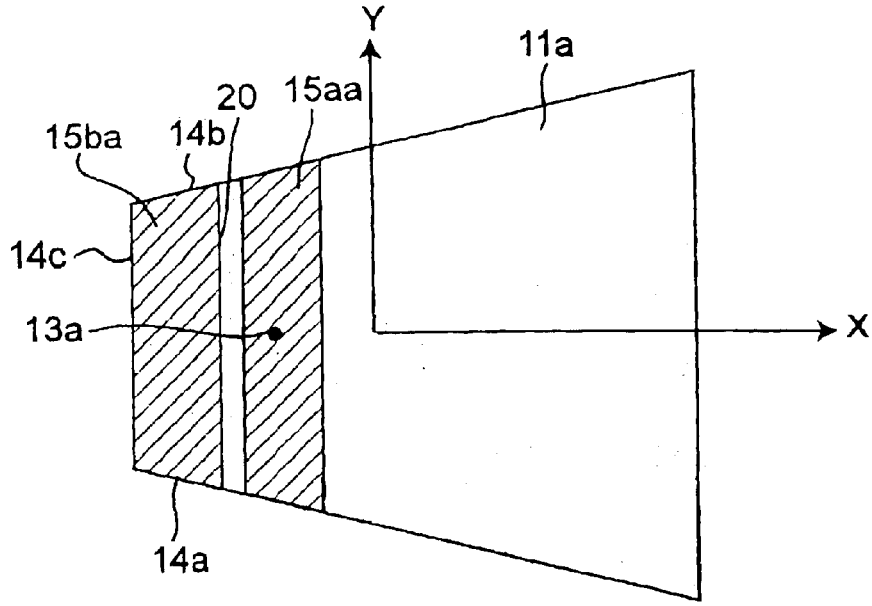
FIG. 54 is a top view showing a configuration of an open-ended waveguide antenna apparatus with the slit 20 according to a sixth modified preferred embodiment of the third preferred embodiment of the present invention.

FIG. 54 is a top view showing a configuration of an open-ended waveguide antenna apparatus with the slit 20 according to the sixth modified preferred embodiment of the third preferred embodiment of the present invention. The waveguide antenna apparatus of FIG. 54 has the action and advantageous effects of both of the waveguide antenna apparatus of FIG. 47 and the waveguide antenna apparatus of FIG. 28 by forming the slit 20 of FIG. 28 of the third preferred embodiment in the waveguide antenna apparatus of FIG. 47 and forming separate two ceiling conductors 15*aa* and 15*ba*.

Figure 55:
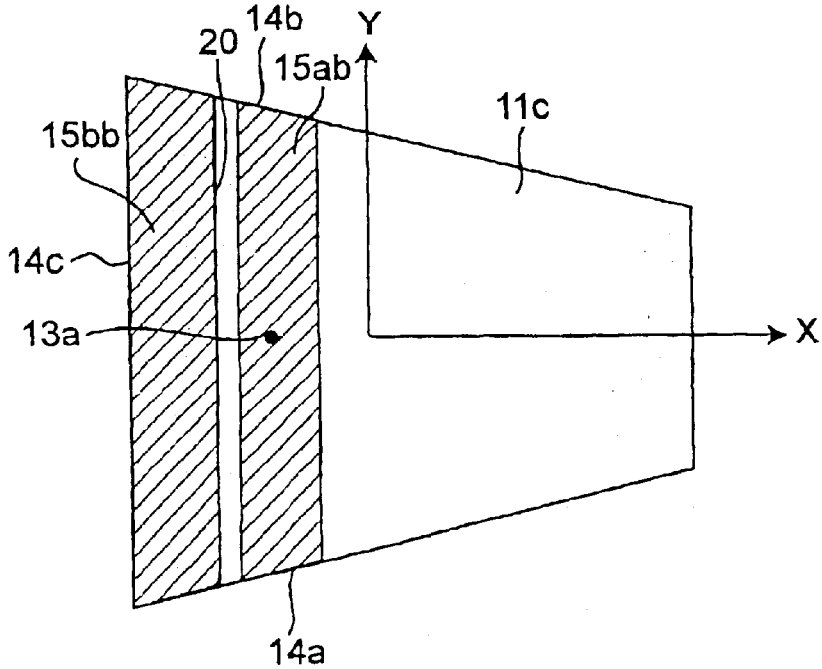
FIG. 55 is a top view showing a configuration of an open-ended waveguide antenna apparatus with the slit 20 according to a seventh modified preferred embodiment of the third preferred embodiment of the present invention.

FIG. 55 is a top view showing a configuration of an open-ended waveguide antenna apparatus with the slit 20 according to the seventh modified preferred embodiment of the third preferred embodiment of the present invention. The waveguide antenna apparatus of FIG. 55 has the action and advantageous effects of both of the waveguide antenna apparatus of FIG. 49 and the waveguide antenna apparatus of FIG. 28 by forming the slit 20 of FIG. 28 of the third preferred embodiment in the waveguide antenna apparatus of FIG. 49 and forming separate two ceiling conductors 15*ab* and 15*bb*.

Figure 56A:
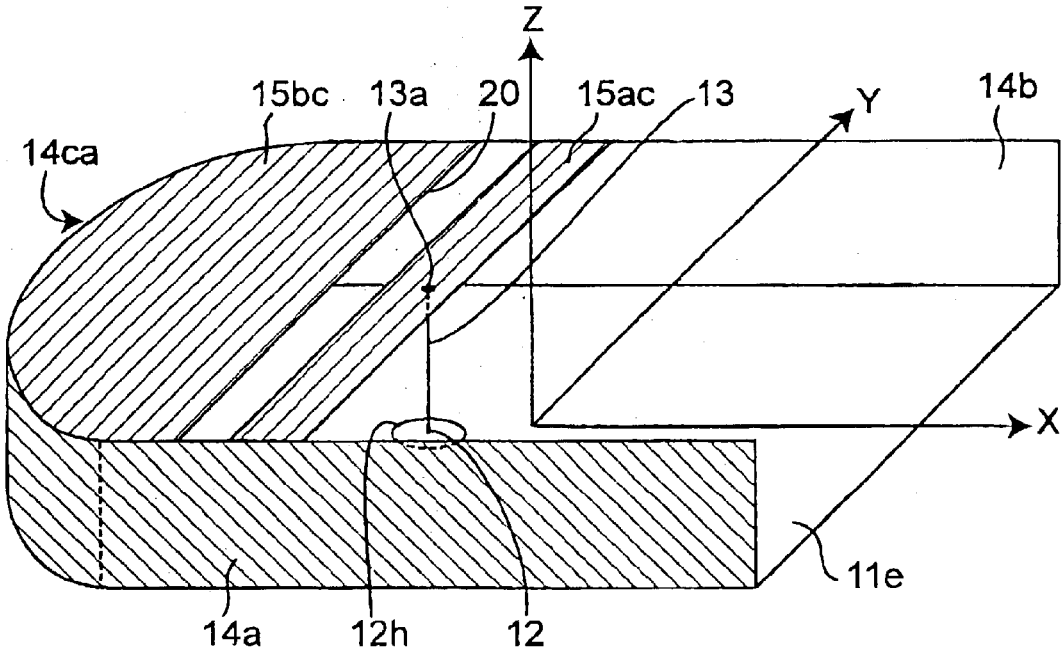
FIG. 56A is a perspective view showing a configuration of an open-ended waveguide antenna apparatus with the slit 20 according to an eighth modified preferred embodiment of the third preferred embodiment of the present invention.
Figure 56B:
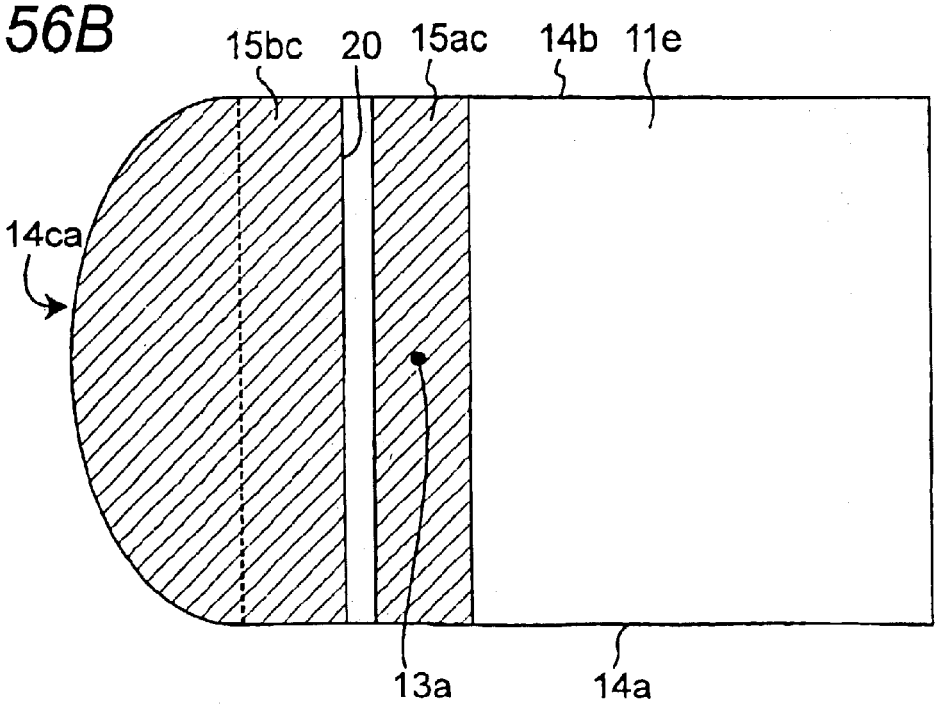
FIG. 56B is a top view of the waveguide antenna apparatus of FIG. 56A.

FIGS. 56A and 56B are top views showing a configuration of an open-ended waveguide antenna apparatus with the slit 20 according to the eighth modified preferred embodiment of the third preferred embodiment of the present invention. The waveguide antenna apparatus of FIGS. 56A and 56B have the action and advantageous effects of both of the waveguide antenna apparatus of FIGS. 51A and 51B and the waveguide antenna apparatus of FIG. 28 by forming the slit 20 of FIG. 28 of the third preferred embodiment in the waveguide antenna apparatus of FIGS. 51A and 51B and forming separate two ceiling conductors 15*ac* and 15*bc*.

Sixth Preferred Embodiment

Figure 57:
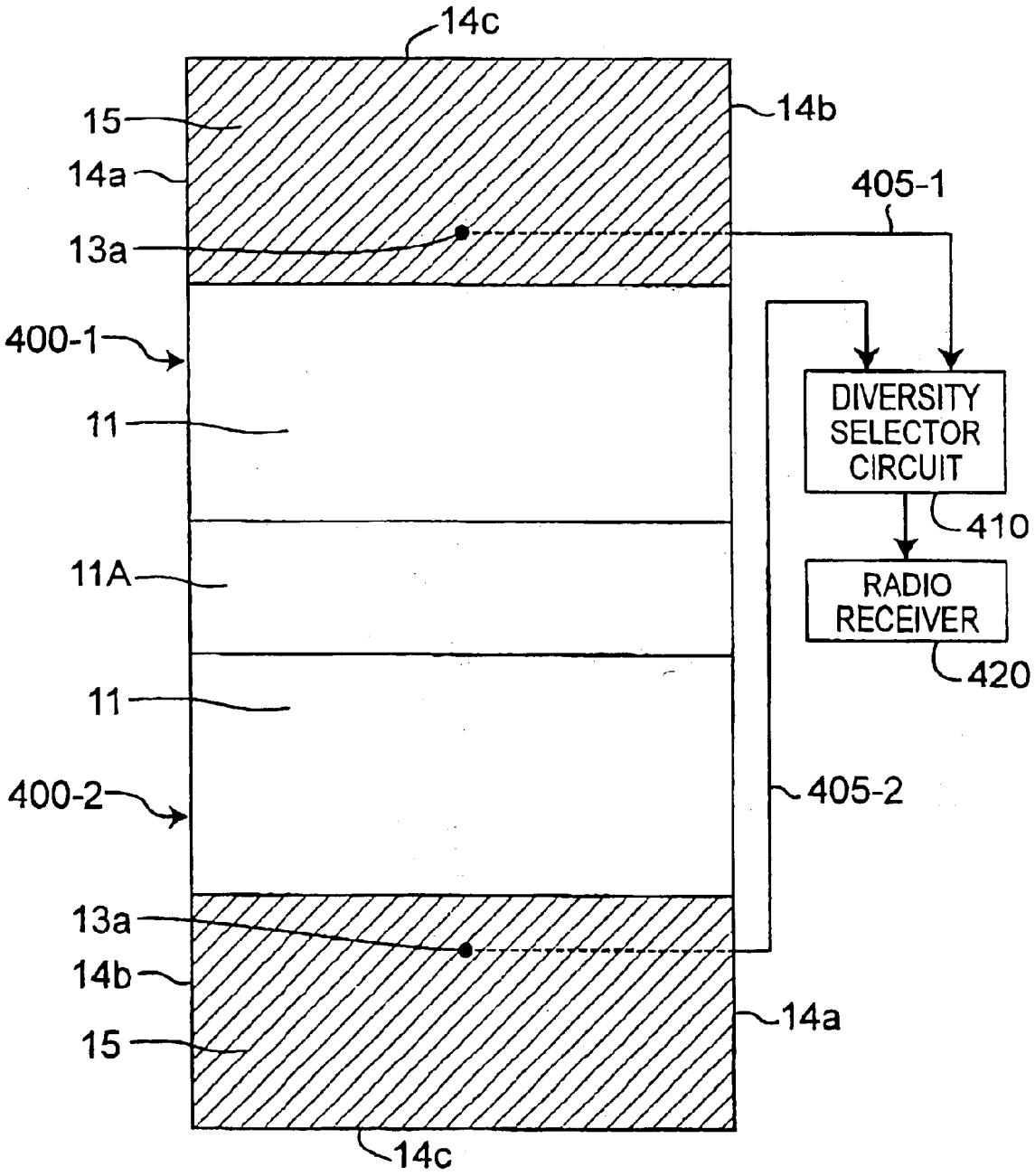
FIG. 57 is a top view of an array antenna apparatus that employs the open-ended waveguide antenna apparatus of FIG. 1, according to a sixth preferred embodiment of the present invention.

FIG. 57 is a top view of an array antenna apparatus that employs two open-ended waveguide antenna apparatuses 400-1 and 400-2 of FIG. 1 according to the sixth preferred embodiment of the present invention. In the present preferred embodiment, the two waveguide antenna apparatuses 400-1 and 400-2 are provided with their opened ends opposed to each other, and the grounding conductors 11 of the two waveguide antenna apparatuses 400-1 and 400-2 are electrically and mechanically connected with each other via a grounding conductor 11A. In this case, the feeding point of the waveguide antenna apparatus 400-1 is connected with a diversity selector circuit 410 via a coaxial cable 405-], while the feeding point of the waveguide antenna apparatus 400-2 is connected with the diversity selector circuit 410 via a coaxial cable 405-2. The radio signals received by the waveguide antenna apparatuses 400-1 and 400-2 are inputted to the diversity selector circuit 410 via the coaxial cables 405-1 and 405-2, respectively, and the diversity selector circuit 410 selects the radio signal having a larger signal intensity out of these two radio signals, and outputs the selected radio signal to a radio receiver 420. The radio receiver 420 subjects the inputted radio signal to the processing of low-noise amplification, lower-frequency conversion and demodulation, and outputs a demodulated baseband signal. The array antenna apparatus constructed as above has main beams having the directions different from each other and is able to receive the radio signal with comparatively larger signal intensity even if the arrival direction of the radio signal is changed.

In the above-mentioned sixth preferred embodiment, the grounding conductors 11 of the two waveguide antenna apparatuses 400-1 and 400-2 are electrically and mechanically connected with each other via the grounding conductor 11A. However, the grounding conductors may be formed by unconnected separate bodies not via the grounding conductor 11A.

Seventh Preferred Embodiment

Figure 58:
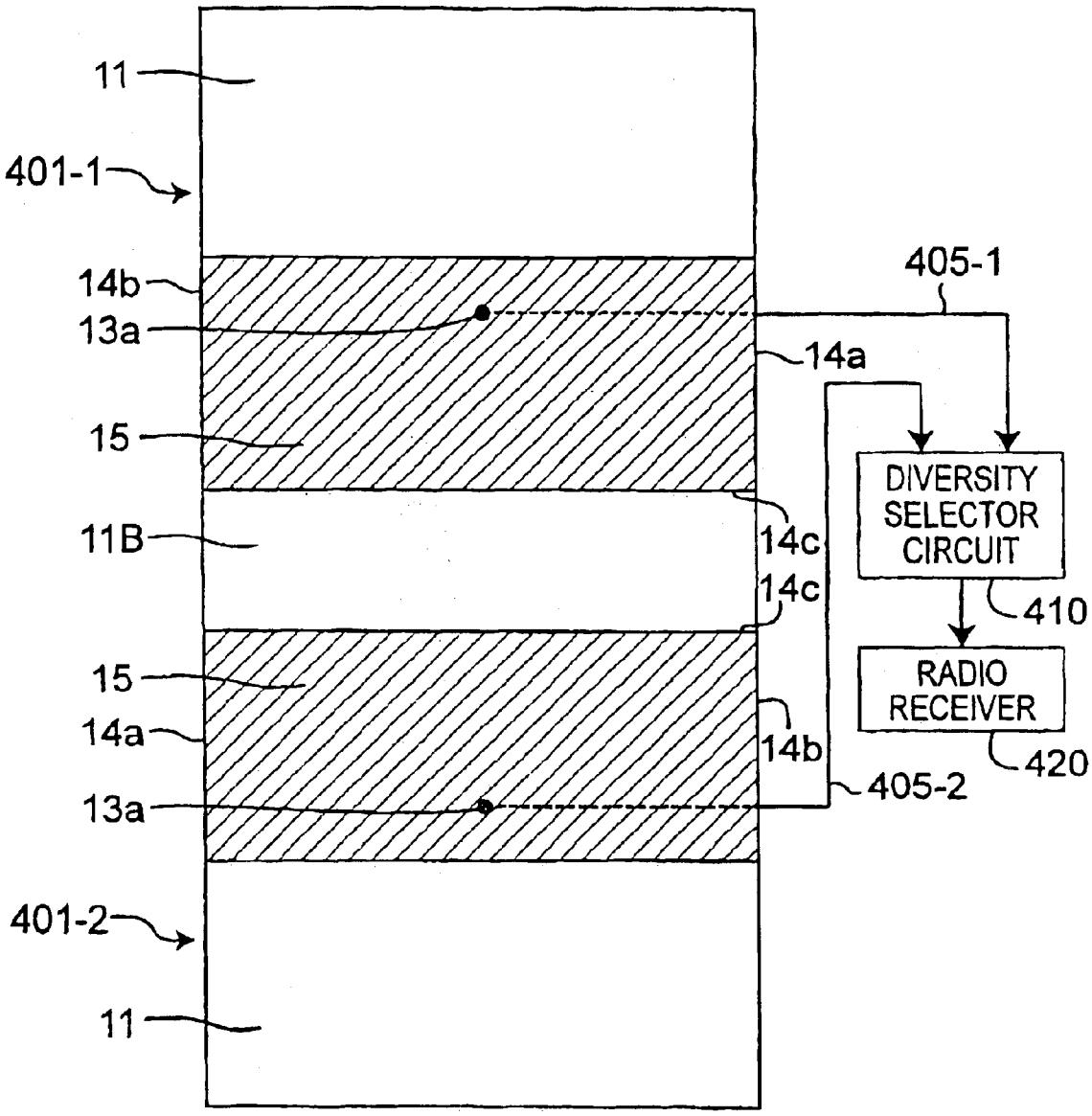
FIG. 58 is a top view of an array antenna apparatus that employs the open-ended waveguide antenna apparatus of FIG. 1, according to a seventh preferred embodiment of the present invention.
Figure 59:
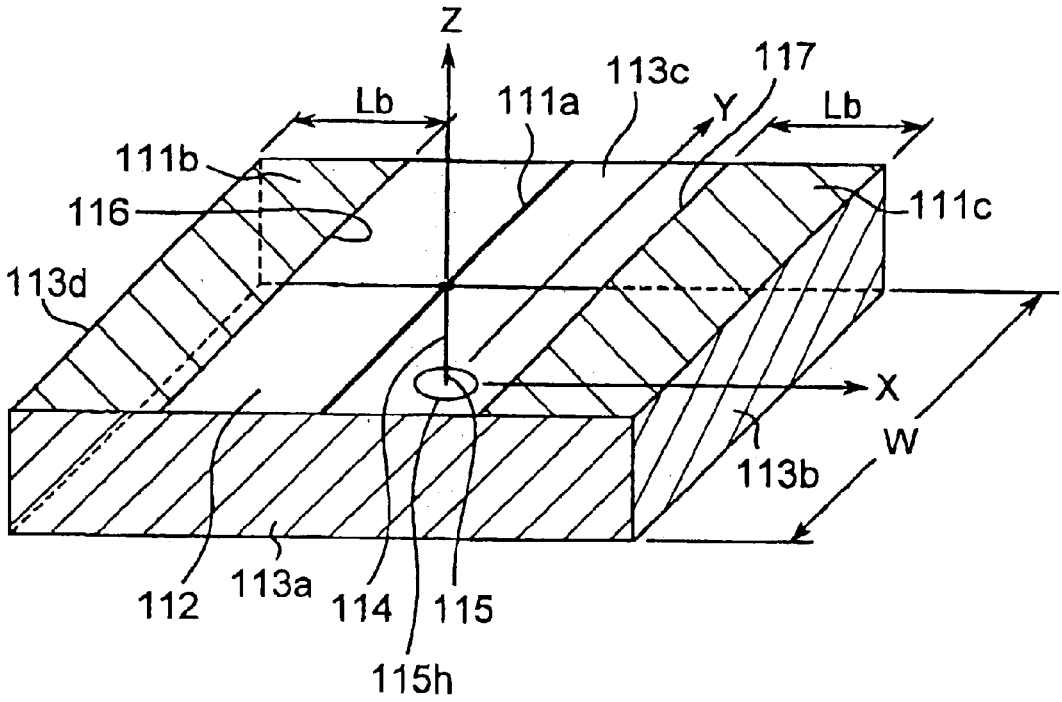
Fig.59 PRIOR ART
FIG. 59 is a perspective view showing a configuration of a prior art antenna apparatus.
Figure 60A:
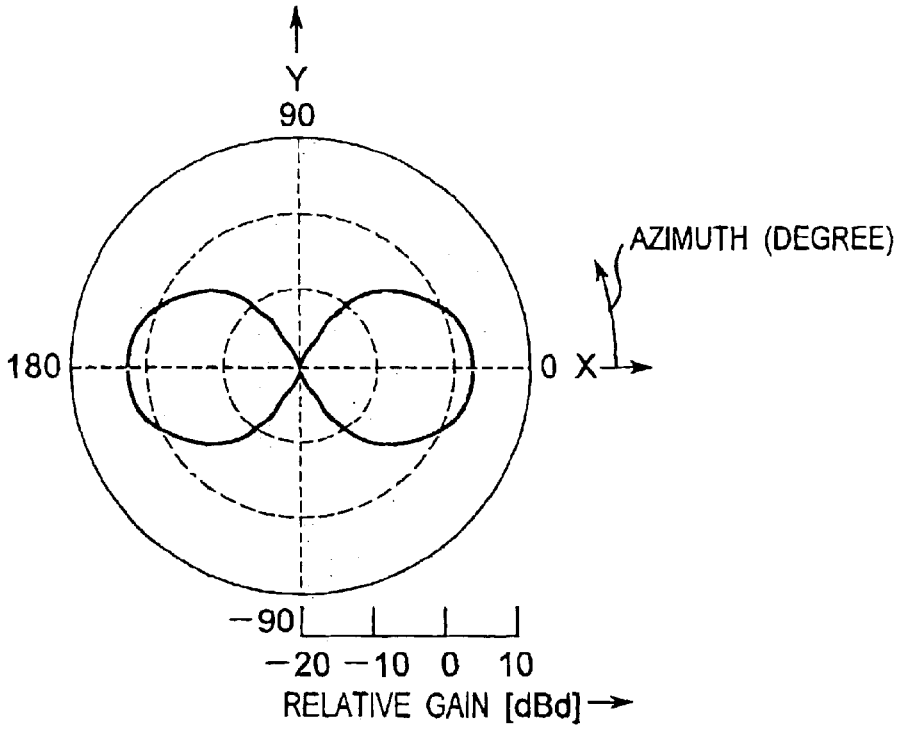
Fig.60A PRIOR ART
FIG. 60A is a graph showing a radiation directivity pattern on the X-Y plane of the antenna apparatus of FIG. 59.
Figure 60B:
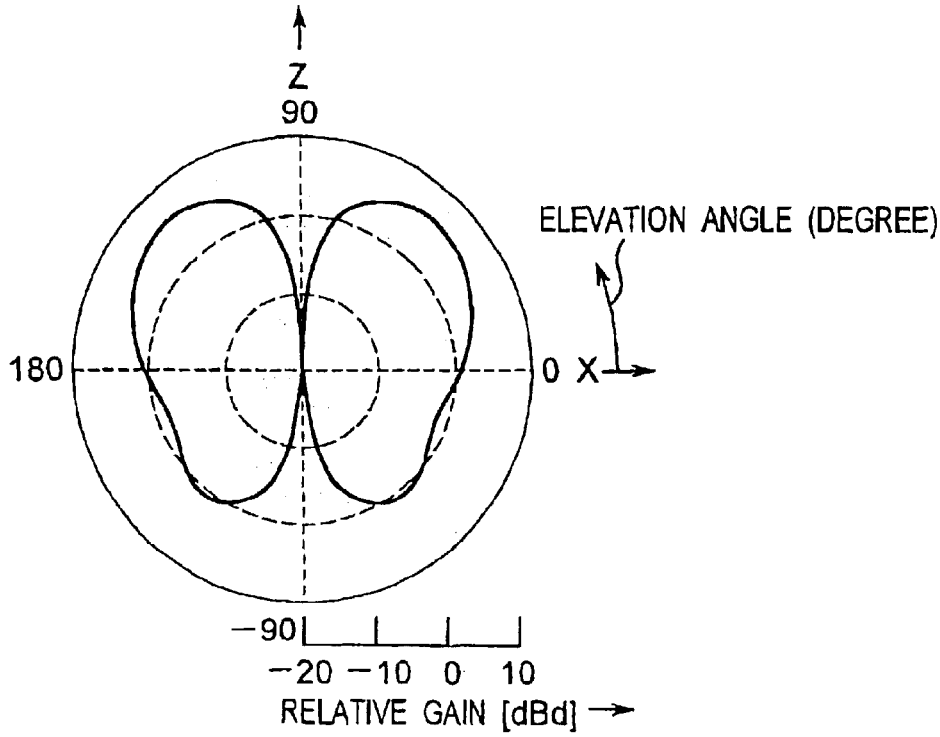
Fig.60B PRIOR ART
FIG. 60B is a graph showing a radiation directivity pattern on the X-Z plane of the antenna apparatus of FIG. 59.

FIG. 58 is a top view of an array antenna apparatus that employs two open-ended waveguide antenna apparatuses 401-1 and 401-2 of FIG. 1 according to the seventh preferred embodiment of the present invention. In the present preferred embodiment, the two waveguide antenna apparatuses 401-1 and 401-2 are provided with their short-circuit ends opposed to each other, and the grounding conductors 11 of the two waveguide antenna apparatuses 401-1 and 401-2 are electrically and mechanically connected with each other via a grounding conductor 11B. In this case, the feeding point of the waveguide antenna apparatus 401-1 is connected with a diversity selector circuit 410 via a coaxial cable 405-1, while the feeding point of the waveguide antenna apparatus 401-2 is connected with the diversity selector circuit 410 via a coaxial cable 405-2. The radio signals received by the waveguide antenna apparatuses 401-1 and 401-2 are inputted to the diversity selector circuit 410 via the coaxial cables 405-1 and 405-2, respectively, and the diversity selector circuit 410 selects the radio signal having a larger signal intensity out of these two radio signals, and outputs the selected radio signal to the radio receiver 420. The radio receiver 420 subjects the inputted radio signal to the processing of low-noise amplification, lower-frequency conversion and demodulation, and outputs the demodulated baseband signal. The array antenna apparatus constructed as above has main beams having directions different from each other and is able to receive the radio signal with comparatively great signal intensity even if the arrival direction of the radio signal is changed.

In the above-mentioned seventh preferred embodiment, the grounding conductors 11 of the two waveguide antenna apparatuses 401-1 and 401-2 are electrically and mechanically connected with each other via the grounding conductor 11B. However, the grounding conductors may be formed by unconnected separate bodies not via the grounding conductor 11B.

Advantageous Effects of Preferred Embodiments

As described above in detail, according to the waveguide antenna apparatus of one aspect of the preferred embodiments, there is provided a waveguide antenna apparatus includes a rectangular waveguide having one end short-circuited by a terminating conductor and another end opened. The rectangular waveguide includes a grounding conductor and a ceiling conductor that are opposed to each other, and further includes two side surface conductors that join the grounding conductor with the ceiling conductor and are opposed to each other. An antenna element having one end and another end is provided, where one end of the antenna element is electrically connected with a position in the ceiling conductor in a vicinity of opened another end of the rectangular waveguide, and another end of the antenna element is electrically connected with a feeding portion located in the grounding conductor. The ceiling conductor includes a removed portion on the side of opened another end of the rectangular waveguide, and this leads to that an electromagnetic wave of a radio signal fed to the feeding portion is radiated from the removed portion of the ceiling conductor and opened another end of the rectangular waveguide.

Moreover, according to another aspect of the preferred embodiments, there is provided a waveguide antenna apparatus including a rectangular waveguide having one end and another end both of which are short-circuited respectively by terminating conductors. The rectangular waveguide includes a grounding conductor and a ceiling conductor that are opposed to each other, and further includes two side surface conductors that join the grounding conductor with the ceiling conductor and are opposed to each other. The waveguide antenna apparatus further includes an antenna element having one end and another end, where one end of the antenna element is electrically connected with the ceiling conductor, another end of the antenna element is electrically connected with a feeding portion located in the grounding conductor. At least one slit is preferably formed in the ceiling conductor in the widthwise direction of the rectangular waveguide, and the slit is located in a position of which a distance to one end of the rectangular waveguide is substantially different from a distance to another end of the rectangular waveguide. This leads to that an electromagnetic wave of a radio signal fed to the feeding portion is radiated from the slit.

Furthermore, according to a further aspect of the preferred embodiments, there is provided a waveguide antenna apparatus including a rectangular waveguide having one end short-circuited by a terminating conductor and another end opened. The rectangular waveguide includes a grounding conductor and a ceiling conductor that are opposed to each other, and further includes two side surface conductors that join the grounding conductor with the ceiling conductor and are opposed to each other. The waveguide antenna apparatus further includes an antenna element having one end and another end, where one end of the antenna element is electrically connected with a position in the ceiling conductor in a vicinity of opened another end of the rectangular waveguide, and another end of the antenna element is electrically connected with a feeding portion located in the grounding conductor. The waveguide antenna apparatus further includes at least one slit formed in the ceiling conductor in the widthwise direction of the rectangular waveguide. The ceiling conductor includes a first removed portion on the side of opened another end of the rectangular waveguide, and the two side surface conductors includes a second removed portion on the side of opened another end of the rectangular waveguide. This leads to that an electromagnetic wave of a radio signal fed to the feeding portion is radiated from the first removed portion of the ceiling conductor and opened another end of the rectangular waveguide.

According to a still further aspect of the preferred embodiments, there is provided an array antenna apparatus including two ones of the above-mentioned waveguide antenna apparatus. The two waveguide antenna apparatuses are provided so that respective opened another ends of the rectangular waveguides of the waveguide antenna apparatuses are opposed to each other. Accordingly, the array antenna apparatus that has two main beam directions different from each other can be provided by employing the two waveguide antenna apparatuses.

According to a still more further aspect of the preferred embodiments, there is provided an array antenna apparatus having two waveguide antenna apparatuses, and the two waveguide antenna apparatuses are provided so that the short-circuit one end portions of the waveguide antenna apparatuses are opposed to each other. Accordingly, the array antenna apparatus that has two main beam directions different from each other can be provided by employing the two waveguide antenna apparatuses.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A waveguide antenna apparatus comprising:

a rectangular waveguide having one end short-circuited by a terminating conductor and another end opened, said rectangular waveguide including a grounding conductor and a ceiling conductor that are opposed to each other, and further including two side surface conductors that join said grounding conductor with said ceiling conductor and are opposed to each other; and an antenna element having one end and another end, one end of said antenna element being electrically connected with a position in said ceiling conductor in a vicinity of opened another end of said rectangular waveguide, another end of said antenna element being electrically connected with a feeding portion located in the grounding conductor, wherein said ceiling conductor includes a removed portion on the side of opened another end of said rectangular waveguide, whereby an electromagnetic wave of a radio signal fed to the feeding portion is radiated from the removed portion of said ceiling conductor and opened another end of said rectangular waveguide.

2. The waveguide antenna apparatus as claimed in claim 1, further comprising at least one matching conductor for adjusting an input impedance of said waveguide antenna apparatus, said matching conductor being electrically connected with said grounding conductor.

3. The waveguide antenna apparatus as claimed in claim 2, wherein at least one of said matching conductors is electrically connected with said antenna element.

4. The waveguide antenna apparatus as claimed in claim 2, wherein at least one of said matching conductors is electrically connected with said ceiling conductor.

5. The waveguide antenna apparatus as claimed in claim 1, further comprising at least one directivity pattern controlling conductor for changing a directivity pattern of said waveguide antenna apparatus, said directivity pattern controlling conductor being electrically connected with said grounding conductor.

6. The waveguide antenna apparatus as claimed in claim 5, wherein said directivity pattern controlling conductor comprises:

a first conductor portion for controlling a directivity pattern on a plane substantially perpendicular to said grounding conductor, said first conductor portion being electrically connected with said grounding conductor and provided so as to be substantially perpendicular to said grounding conductor; and a second conductor portion for controlling a directivity pattern on a plane substantially parallel to said grounding conductor, said second conductor portion being connected with said first conductor portion and provided so as to be substantially parallel to said grounding conductor.

7. The waveguide antenna apparatus as claimed in claim 1, wherein said two side surface conductors are formed so as to be further apart from each other at opened another end of said rectangular waveguide than at one end of said rectangular waveguide short-circuited by said terminating conductor.

8. The waveguide antenna apparatus as claimed in claim 1, wherein said two side surface conductors are formed so as to be closer to each other at opened another end of said rectangular waveguide than at one end of said rectangular waveguide short-circuited by said terminating conductor.

9. The waveguide antenna apparatus as claimed in claim 1, wherein said terminating conductor is formed so that a length in an electromagnetic wave propagation direction of said rectangular waveguide in an approximately center portion of said terminating conductor in a widthwise direction of said rectangular waveguide is larger than that at widthwise end portions of said terminating conductor respectively connected with said two side surface conductors.

10. The waveguide antenna apparatus as claimed in claim 1, wherein at least one part of an internal space of said rectangular waveguide is filled with a dielectric material.

11. The waveguide antenna apparatus as claimed in claim 10, wherein said grounding conductor is formed by a conductor pattern formed on a first surface of a dielectric substrate having first and second surfaces that oppose to each other, wherein said ceiling conductor is formed by a conductor pattern formed on the second surface of said dielectric substrate, and wherein said side surface conductors and said terminating conductor are formed by a plurality of through hole conductors that are obtained by filling said dielectric substrate with through holes formed in a direction of thickness.

12. The waveguide antenna apparatus as claimed in claim 1, wherein said terminating conductor is formed so that a length in an electromagnetic wave propagation direction of said rectangular waveguide is larger in an approximately center portion of said terminating conductor in a direction of height of said rectangular waveguide than that at end portions of said terminating conductor in the direction of height of said rectangular waveguide that are connected with said grounding conductor and said ceiling conductor.

13. The waveguide antenna apparatus as claimed in claim 1, wherein said terminating conductor is formed so that a length in an electromagnetic wave propagation direction of said rectangular waveguide is made larger from said ceiling conductor toward said grounding conductor.

14. The waveguide antenna apparatus as claimed in claim 1, wherein said waveguide antenna apparatus is covered with a radome having a circular bottom surface.

15. A waveguide antenna apparatus comprising:

a rectangular waveguide having one end and another end both of which are short-circuited respectively by terminating conductors, said rectangular waveguide including a grounding conductor and a ceiling conductor that are opposed to each other, and further including two side surface conductors that join said grounding conductor with said ceiling conductor and are opposed to each other;

an antenna element having one end and another end, one end of said antenna element being electrically connected with said ceiling conductor, another end of said antenna element being electrically connected with a feeding portion located in the grounding conductor; and at least one slit formed in said ceiling conductor in the widthwise direction of the rectangular waveguide, said slit being located in a position of which a distance to one end of said rectangular waveguide is substantially different from a distance to another end of said rectangular waveguide, whereby an electromagnetic wave of a radio signal fed to said feeding portion is radiated from said slit.

16. The waveguide antenna apparatus as claimed in claim 15, wherein said slit is formed in a position located between (a) a connection point in said ceiling conductor that connects said ceiling conductor with said antenna element, and (b) said terminating conductor.

17. The waveguide antenna apparatus as claimed in claim 15, further comprising at least one matching conductor for adjusting an input impedance of said waveguide antenna apparatus, said matching conductor being electrically connected with said grounding conductor.

18. The waveguide antenna apparatus as claimed in claim 17, wherein at least one of said matching conductors is electrically connected with said antenna element.

19. The waveguide antenna apparatus as claimed in claim 17, wherein at least one of said matching conductors is electrically connected with said ceiling conductor.

20. A waveguide antenna apparatus comprising:

a rectangular waveguide having one end short-circuited by a terminating conductor and another end opened, said rectangular waveguide including a grounding conductor and a ceiling conductor that are opposed to each other, and further including two side surface conductors that join said grounding conductor with said ceiling conductor and are opposed to each other;

an antenna element having one end and another end, one end of said antenna element being electrically connected with a position in said ceiling conductor in a vicinity of opened another end of said rectangular waveguide, another end of said antenna element being electrically connected with a feeding portion located in the grounding conductor; and at least one slit formed in said ceiling conductor in the widthwise direction of the rectangular waveguide, wherein said ceiling conductor includes a first removed portion on the side of opened another end of said rectangular waveguide, and wherein said two side surface conductors includes a second removed portion on the side of opened another end of said rectangular waveguide, whereby an electromagnetic wave of a radio signal fed to the feeding portion is radiated from the first removed portion of said ceiling conductor and opened another end of said rectangular waveguide.

21. The waveguide antenna apparatus as claimed in claim 20, further comprising at least one matching conductor for adjusting an input impedance of said waveguide antenna apparatus, said matching conductor being electrically connected with said grounding conductor.

22. The waveguide antenna apparatus as claimed in claim 21, wherein at least one of said matching conductors is electrically connected with said antenna element.

23. The waveguide antenna apparatus as claimed in claim 21, wherein at least one of said matching conductors is electrically connected with said ceiling conductor.

24. The waveguide antenna apparatus as claimed in claim 20, further comprising at least one directivity pattern controlling conductor for changing a directivity pattern of said waveguide antenna apparatus, said directivity pattern controlling conductor being electrically connected with said grounding conductor.

25. The waveguide antenna apparatus as claimed in claim 24, wherein said directivity pattern controlling conductor comprises:

a first conductor portion for controlling a directivity pattern on a plane substantially perpendicular to said grounding conductor, said first conductor portion being electrically connected with said grounding conductor and provided so as to be substantially perpendicular to said grounding conductor; and a second conductor portion for controlling a directivity pattern on a plane substantially parallel to said grounding conductor, said second conductor portion being connected with said first conductor portion and provided so as to be substantially parallel to said grounding conductor.

26. The waveguide antenna apparatus as claimed in claim 20, wherein said two side surface conductors are formed so as to be further apart from each other at opened another end of said rectangular waveguide than at one end of said rectangular waveguide short-circuited by said terminating conductor.

27. The waveguide antenna apparatus as claimed in claim 20, wherein said two side surface conductors are formed so as to be closer to each other at opened another end of said rectangular waveguide than at one end of said rectangular waveguide short-circuited by said terminating conductor.

28. The waveguide antenna apparatus as claimed in claim 20, wherein said terminating conductor is formed so that a length in an electromagnetic wave propagation direction of said rectangular waveguide in an approximately center portion of said terminating conductor in a widthwise direction of said rectangular waveguide is larger than that at widthwise end portions of said terminating conductor respectively connected with said two side surface conductors.

29. An array antenna apparatus comprising two waveguide antenna apparatuses, wherein each of said waveguide antenna apparatuses comprises:

a rectangular waveguide having one end short-circuited by a terminating conductor and another end opened, said rectangular waveguide including a grounding conductor and a ceiling conductor that are opposed to each other, and further including two side surface conductors that join said grounding conductor with said ceiling conductor and are opposed to each other; and an antenna element having one end and another end, one end of said antenna element being electrically connected with a position in said ceiling conductor in a vicinity of opened another end of said rectangular waveguide, another end of said antenna element being electrically connected with a feeding portion located in the grounding conductor, wherein said ceiling conductor includes a removed portion on the side of opened another end of said ceiling conductor, whereby an electromagnetic wave of a radio signal fed to the feeding portion is radiated from the removed portion of said ceiling conductor and opened another end of said rectangular waveguide, and wherein said two waveguide antenna apparatuses are provided so that respective opened another ends of the rectangular waveguides of said waveguide antenna apparatuses are opposed to each other.

30. The array antenna apparatus as claimed in claim 29, further comprising diversity selection means for selecting and outputting a received signal having a larger signal intensity out of two received signals received respectively by said two waveguide antenna apparatuses.

31. An array antenna apparatus comprising two waveguide antenna apparatuses, wherein each of said waveguide antenna apparatuses comprises:

a rectangular waveguide having one end short-circuited by a terminating conductor and another end opened, said rectangular waveguide including a grounding conductor and a ceiling conductor that are opposed to each other, and further including two side surface conductors that join said grounding conductor with said ceiling conductor and are opposed to each other; and an antenna element having one end and another end, one end of said antenna element being electrically connected with a position in said ceiling conductor in a vicinity of opened another end of said rectangular waveguide, another end of said antenna element being electrically connected with a feeding portion located in the grounding conductor, wherein said ceiling conductor includes a removed portion on the side of opened another end of said ceiling conductor, whereby an electromagnetic wave of a radio signal fed to the feeding portion is radiated from the removed portion of said ceiling conductor and opened another end of said rectangular waveguide, and wherein said two waveguide antenna apparatuses are provided so that respective short-circuited one ends of the rectangular waveguides of said waveguide antenna apparatuses are opposed to each other.

32. The array antenna apparatus as claimed in claim 31, further comprising diversity selection means for selecting and outputting a received signal having a larger signal intensity out of two received signals received respectively by said two waveguide antenna apparatuses.

* * * * *